US008467705B2

(12) United States Patent
Ryu et al.

(10) Patent No.: US 8,467,705 B2
(45) Date of Patent: Jun. 18, 2013

(54) IMAGE FORMING APPARATUS AND IMAGE MAGNIFICATION ADJUSTMENT METHOD

(75) Inventors: Gunmun Ryu, Osaka (JP); Okito Ogasahara, Osaka (JP); Kenichi Ohnishi, Osaka (JP); Naohiro Anan, Osaka (JP); Yuichi Sugiyama, Osaka (JP)

(73) Assignee: Kyocera Mita Corporation (JP)

( * ) Notice: Subject to any disclaimer, the term of this patent is extended or adjusted under 35 U.S.C. 154(b) by 285 days.

(21) Appl. No.: 12/981,698

(22) Filed: Dec. 30, 2010

(65) Prior Publication Data

US 2011/0188891 A1 Aug. 4, 2011

(30) Foreign Application Priority Data

Jan. 29, 2010 (JP) ..... 2010-018879
Jan. 29, 2010 (JP) ..... 2010-018880
Jan. 29, 2010 (JP) ..... 2010-018881
Jan. 29, 2010 (JP) ..... 2010-018882
Jan. 29, 2010 (JP) ..... 2010-018883

(51) Int. Cl.
*G03G 15/16* (2006.01)

(52) U.S. Cl.
USPC ..... 399/121

(58) Field of Classification Search
USPC ..... 399/121, 302, 308
See application file for complete search history.

(56) References Cited

U.S. PATENT DOCUMENTS

2011/0064465 A1* 3/2011 Kaseda ..... 399/121

FOREIGN PATENT DOCUMENTS

| | | | | |
|---|---|---|---|---|
| JP | 950222 | | | 2/1997 |
| JP | 2001005311 | A | * | 1/2001 |
| JP | 2002014550 | A | * | 1/2002 |
| JP | 2006-259173 | | | 9/2006 |
| JP | 20073714 | | | 1/2007 |
| JP | 200757715 | | | 3/2007 |
| JP | 2008216316 | | | 9/2008 |
| JP | 2009282120 | A | * | 12/2009 |
| JP | 2010044317 | A | * | 2/2010 |

* cited by examiner

*Primary Examiner* — Quana M Grainger
(74) *Attorney, Agent, or Firm* — Gerald E. Hespos; Michael J. Porco; Matthew T. Hespos

(57) ABSTRACT

An image forming apparatus has an intermediate transfer belt stretched lightly across rollers to move endlessly in a sub-scanning direction upon image formation and has an outer surface to which a toner image formed by a development unit is transferred. A secondary transfer opposing roller is one of the rollers across which the intermediate transfer belt is stretched. A secondary transfer roller contacts the outer surface of the intermediate transfer belt and transfers the toner image on the intermediate transfer belt to recording paper. A movement mechanism moves at least one of the rollers or the secondary transfer roller and changes a pressed state of the intermediate transfer belt by the secondary transfer roller at a nip of the secondary transfer opposing roller and the secondary transfer roller. A movement mechanism control unit controls a travel distance of the roller to be moved by the movement mechanism.

20 Claims, 17 Drawing Sheets

IMAGE FORMING APPARATUS AND IMAGE MAGNIFICATION ADJUSTMENT METHOD

BACKGROUND OF THE INVENTION

1. Field of the Invention

The present invention relates to technology for correcting the magnification deviation in a sub scanning direction in an image forming apparatus which performs image formation on recording paper based on a secondary transfer method using an intermediate transfer belt.

2. Description of the Related Art

With an image forming apparatus which performs image formation on recording paper based on a secondary transfer method using an intermediate transfer belt, there are cases where so-called magnification deviation occurs; specifically, an image of a size that is different from the scheduled size is formed on the recording paper due to the expansion and contraction of the intermediate transfer belt caused by temperature change or the like. For example, if the temperature of the intermediate transfer belt rises, the intermediate transfer belt will expand and the toner image transferred to the surface of the intermediate transfer belt will become stretched, and an image of a size that is larger than the manuscript size is formed on the recording paper.

In order to correct the magnification deviation, there is a conventional image forming apparatus which detects a sub scanning magnification error of a transfer transport device based on rate information of the transfer transport device, calculates a correction amount of the detected sub scanning magnification error, and performs control so as to change the drive rate of the transfer transport device in order to reduce the sub scanning magnification error based on the calculated correction amount.

SUMMARY OF THE INVENTION

The present invention is an improvement of the foregoing conventional technology.

Specifically, the present invention provides an image forming apparatus, comprising: a development unit that forms a toner image according to image data; an intermediate transfer belt tightly stretched across a plurality of rollers so as to be able to move endlessly in a sub scanning direction upon image formation, and having an outer circumferential surface to which the toner image formed with the development unit is transferred; a secondary transfer opposing roller which is one of the plurality of rollers and across which the intermediate transfer belt is tightly stretched; a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper; a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper; and a movement mechanism control unit that controls a travel distance of the roller to be moved by the movement mechanism.

BRIEF DESCRIPTION OF THE DRAWINGS

FIGS. 5A to 5C are diagrams respectively corresponding to FIG. 4A to FIG. 4C.

FIG. 7A shows a state where the secondary transfer roller is in a position of not pressing the intermediate transfer belt in the inner circumferential direction, FIG. 7B shows a state where the secondary transfer roller presses the intermediate transfer belt in the inner circumferential direction, and FIG. 7C shows a state where the secondary transfer roller presses the intermediate transfer belt further in the inner circumferential direction than the state of FIG. 7B, respectively.

FIG. 8A shows a state where the secondary transfer roller is in a position that is farthest from the driving roller (secondary transfer opposing roller), and FIG. 8B shows a state where the secondary transfer roller is in a position that is closest to the driving roller, respectively.

DETAILED DESCRIPTION OF THE PREFERRED EMBODIMENTS

Embodiments of the image forming apparatus and image magnification adjustment method according to the present invention are now explained in detail with reference to the attached drawings. Note that the present invention can be applied to an image forming apparatus that adopts the electrophotographic system and comprises an intermediate transfer belt; for instance, a copy machine, printer, facsimile, and a multifunction machine comprising the foregoing functions.

Figure 1:
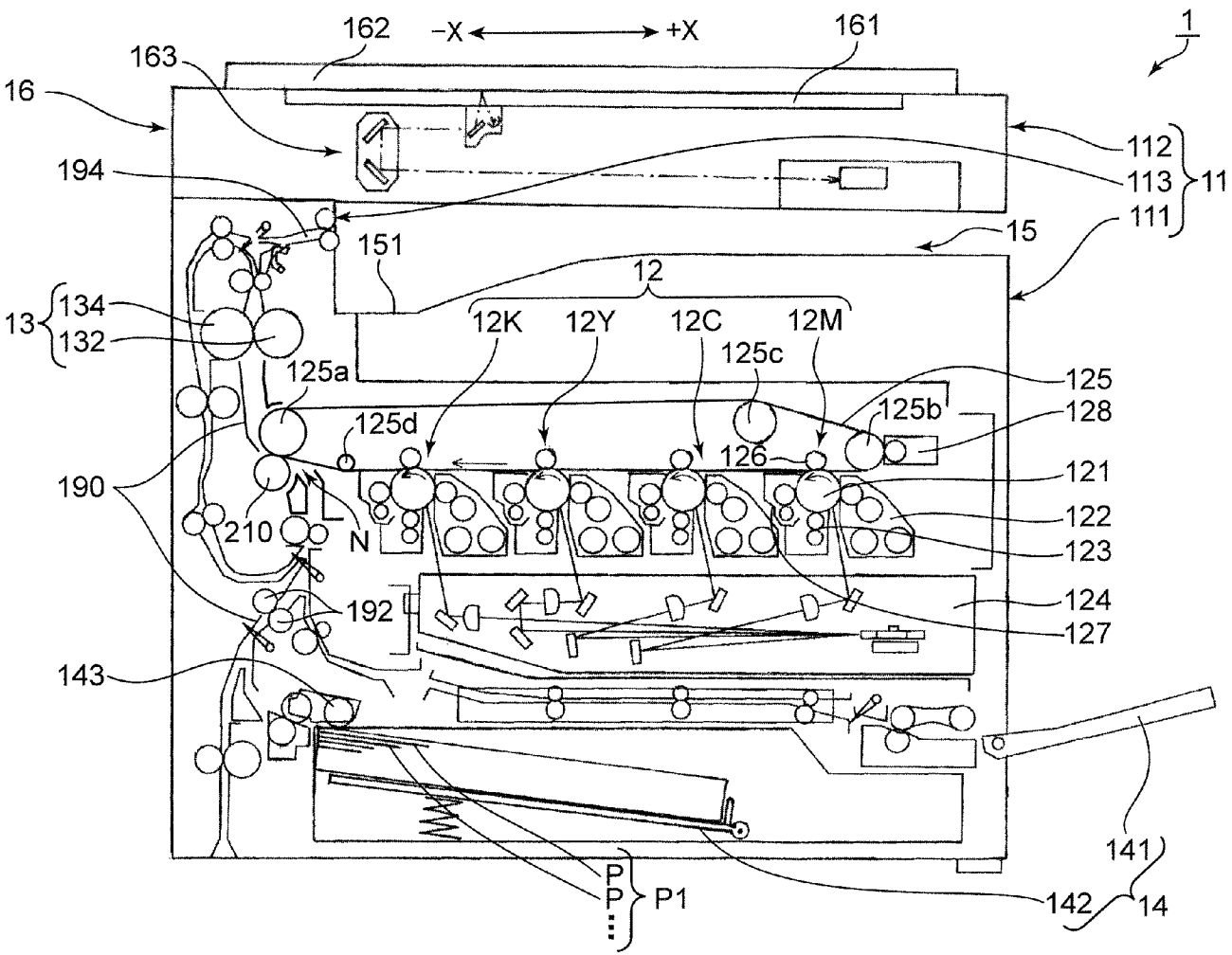
FIG. 1 is a front cross section showing the structure of the image forming apparatus according to the first embodiment of the present invention.
Figure 2:
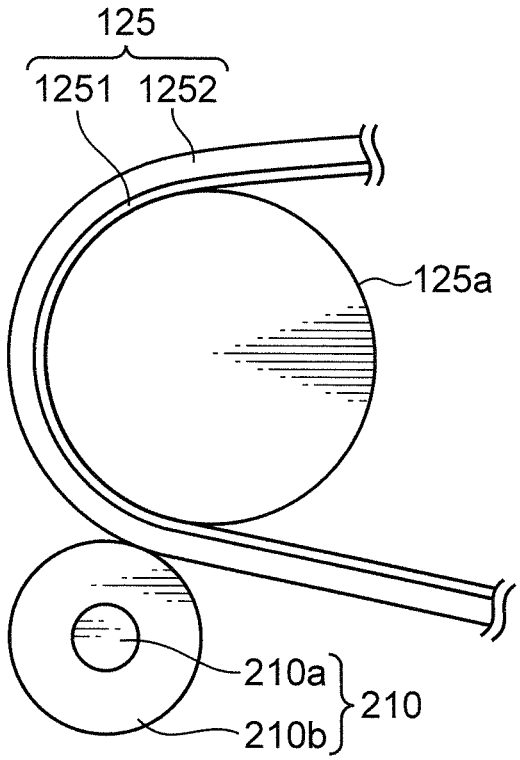
FIG. 2 is a diagram showing the cross section structure of the intermediate transfer belt of the image forming apparatus illustrated in FIG. 1.

FIG. 1 is a front cross section showing the structure of an image forming apparatus 1 according to the first embodiment of the present invention. FIG. 2 is a diagram showing the cross section structure of an intermediate transfer belt 125 and a secondary transfer roller 210. FIG. 2 is an enlarged view showing the portion where the intermediate transfer belt 125 is tightly stretched across a driving roller 125*a*.

As shown in FIG. 1, the image forming apparatus 1 is configured by comprising an image forming unit 12, a fixing device 13, a paper feed unit 14, a sheet discharge part 15, a manuscript reading unit 16 and the like in an apparatus body 11.

The apparatus body 11 comprises a lower body 111, an upper body 112 disposed upward and opposite to the lower body 111, and a connection 113 interposed between the upper body 112 and the lower body 111. The connection 113 is a structure for mutually connecting the lower body 111 and upper body 112 in a state of forming a sheet discharge part 15 therebetween, is erected from the left part and rear part of the lower body 111, and takes on an L-shape in a planar view. The upper body 112 is supported by the upper end of the connection 113.

The lower body 111 is internally provided with the image forming unit 12, the fixing device 13 and the paper feed unit 14, and the upper body 112 is mounted with the manuscript reading unit 16. The paper feed unit 14 includes a paper feed cassette 142 that can be inserted into and removed from the apparatus body 11. The paper feed cassette 142 houses a sheet bundle P1 in which recording paper P is stacked. Note that, although the paper feed cassette 142 is provided as one row in this embodiment, it may also be provided as two or more rows.

The image forming unit 12 performs the image formation operation of forming a toner image on the recording paper P that was fed from the paper feed unit 14. The image forming unit 12 comprises a magenta development unit 12M which uses a magenta-colored toner, a cyan development unit 12C which uses a cyan-colored toner, a yellow development unit 12Y which uses a yellow-colored toner and a black development unit 12K which uses a black-colored toner, which are sequentially disposed from the upstream side toward the downstream side (if the respective development units are referred to without differentiation, they are hereinafter respectively referred to as the "development unit 12"), an intermediate transfer belt 125 which is tightly stretched across a plurality of rollers such as a driving roller 125*a* (secondary transfer opposing roller) so as to be able to move endlessly in a sub scanning direction upon image formation, a secondary transfer roller 210 which comes into contact with the outer circumferential surface of the intermediate transfer belt 125 at a portion where the intermediate transfer belt 125 is tightly stretched across the driving roller 125*a*, and a belt cleaning device 128.

Each development unit 12 integrally comprises a photoreceptor drum 121 (photoreceptor), a development device 122 for supplying the toner to the photoreceptor drum 121, a toner cartridge (not shown) for housing the toner, a charging device 123, an exposure device 124, an intermediate transfer roller 126, and a drum cleaning device 127.

The photoreceptor drum 121 forms an electrostatic latent image on its circumferential surface and a toner image along the electrostatic latent image. The development device 122 supplies the toner to the photoreceptor drum 121. The toner is appropriately supplied from the toner cartridge to the respective development devices 122.

The charging device 123 is provided at a position that is immediately below the respective photoreceptor drums 121. The exposure device 124 is provided to the lower position of the respective charging devices 123. The charging device 123 uniformly charges the circumferential surface of the respective photoreceptor drums 121. The exposure device 124 irradiates a laser beam corresponding to the respective colors based on the image data input from a computer or the like or the image data acquired by the manuscript reading unit 16 onto the circumferential surface of the charged photoreceptor drum 121, and forms an electrostatic latent image on the circumferential surface of the respective photoreceptor drums 121. The development device 122 supplies the toner to the electrostatic latent image of the circumferential surface of the photoreceptor drum 121 rotating in the arrow direction and thereby laminates the toner, and forms the toner image according to the image data on the circumferential surface of the photoreceptor drum 121.

The intermediate transfer belt 125 is disposed at the upper position of the respective photoreceptor drums 121. The intermediate transfer belt 125 is tightly stretched across the driving roller 125*a* on the left side of FIG. 1 and the driven roller 125*b* on the right side of FIG. 1, and the intermediate transfer roller 126 provided in correspondence with the respective photoreceptor drums 121, and the lower outer circumferential surface thereof is in contact with the circumferential surface of the respective photoreceptor drums 121. With the intermediate transfer belt 125, an image carrying surface to which the toner image is transferred is set on its outer circumferential surface, and, in a state of being pressed against the circumferential surface of the photoreceptor drum 121 by the intermediate transfer roller 126, achieves an endless motion between the driving roller 125*a* and the driven roller 125*b* while synchronizing with the respective photoreceptor drums 121 by being driven with the driving roller 125*a*.

As shown in FIG. 2, in this embodiment, the intermediate transfer belt 125 is configured based on the lamination of a base layer 1251 made of a resin material such as polyvinylidene fluoride (PVDF) formed on the inner circumferential side, and an elastic layer 1252 made or chloroprene rubber, urethane rubber or the like formed on the outer circumferential side. Since the following performance of the intermediate transfer belt 125 to the recording paper P will improve by providing the elastic layer 1252 on the intermediate transfer belt 125, the transfer characteristics of the color image to the recording paper P will improve, and the image quality of the color image that is secondarily transferred to the recording paper P will consequently improve.

Returning to FIG. 1, in this embodiment, a roller 125*c* is provided between the driving roller 125*a* and the driven roller 125*b* at a position that is closer to the driven roller 125*b*. The roller 125*c* is a roller for applying tension to the intermediate transfer belt 125, and is biased upward with the biasing force of a biasing member not shown. Accordingly, the intermediate transfer belt 125 is pushed upward by the roller 125*c*, and the intermediate transfer belt 125 thereby takes on a chevron shape with the portion of the roller 125*c* as the peak.

The control unit 31 described later moves the intermediate transfer belt 125 in an endless motion, causes the image forming unit 12 to transfer a magenta toner image based on the magenta development unit 12M to the surface of the intermediate transfer belt 125, subsequently transfer a cyan toner image based on the cyan development unit 12C to the same position of the intermediate transfer belt 125, subsequently transfer a yellow toner image based on the yellow development unit 12Y to the same position of the intermediate transfer belt 125, and finally transfer a black toner image based on the black development unit 12K, and a color toner image in which the toners of the respective colors are overlapped on the surface of the intermediate transfer belt 125 is thereby formed (intermediate transfer (primary transfer)).

The secondary transfer roller 210 is subjected to a transfer bias with a transfer bias application mechanism not shown, and secondarily transferring the color toner image formed on the surface of the intermediate transfer belt 125 to the recording paper P transported from the paper feed unit 14. The secondary transfer roller 210 is provided to the sheet transport path 190 of the portion where the intermediate transfer belt 125 is tightly stretched across the driving roller 125*a* in a manner of coming in contact with the outer circumferential surface of the intermediate transfer belt 125. Specifically, the driving roller 125*a* functions as a secondary transfer opposing roller. The secondary transfer roller 210 forms, together with the driving roller 125*a*, a nip part N where the toner image is secondarily transferred to the recording paper P. The recording paper P that is being transported along the sheet transport path 190 is pressed and sandwiched between the driving roller 125*a* and the secondary transfer roller 210 at the nip part N, and the toner image on the intermediate transfer belt 125 is thereby secondarily transferred to the recording paper P.

The secondary transfer roller 210 is disposed movably in the sub scanning direction of the driving roller 125*a*, and is configured such that it is moved in the sub scanning direction, in the circumferential surface direction of the driving roller 125*a* in this embodiment, by the movement mechanism 200 described later, presses the outer circumferential surface of the intermediate transfer belt 125 to the inner circumferential side of the intermediate transfer belt 125 at the nip part N, and thereby changes the pressed state of the intermediate transfer belt 125 by the secondary transfer roller 210.

As another mechanism for moving the secondary transfer roller 210, it is also possible to adopt a configuration of moving the secondary transfer roller 210, in a state of being in contact with the intermediate transfer belt 125, in a direction of moving toward and away from the shaft center of the driving roller 125*a* in the inter-axis direction of the secondary transfer roller 210 and the driving roller 125*a* by a movement mechanism 200B (described in detail later) as an embodiment that is different from the foregoing embodiment.

Note that, as shown in FIG. 2, the secondary transfer roller 210 is configured by providing an elastic layer 210*b* made of EPDM (ethylene propylene diene rubber) foam or the like around a metal rotation axis 210*a*.

Returning to FIG. 1 once again, the drum cleaning device 127 is provided at the leftward position of the respective photoreceptor drums 121, and removes the residual toner and cleans the circumferential surface of the photoreceptor drum 121. The circumferential surface of the photoreceptor drum 121 that was cleaned with the drum cleaning device 127 heads to the charging device 123 for new charge treatment.

The belt cleaning device 128 is provided at a position that is opposite to the driven roller 125*b* via the intermediate transfer belt 125. The belt cleaning device 128 removes the residual toner remaining on the intermediate transfer belt 125 after the toner image formed on the intermediate transfer belt 125 is transferred to the recording paper P, and thereby cleans the intermediate transfer belt 125.

A sheet transport path 190 extending in the vertical direction is formed at the leftward position of the image forming unit 12. A transport roller pair 192 is provided at a suitable location on the sheet transport path 190, and the transport roller pair 192 transports the recording paper P fed from the paper feed unit 14 toward the nip part N.

The fixing device 13 comprises a heating roller 132 internally comprising a conductive heating element as a heating source, and a pressure roller 134 disposed opposite to the heating roller 132. The fixing device 13 performs fixation treatment to the toner image on the recording paper P that was transferred with the image forming unit 12 by applying heat from the heating roller 132 while the recording paper P passes through the fixation nip part between the heating roller 132 and the pressure roller 134. The color-printed recording paper P in which the fixation treatment is complete is discharged toward a catch tray 151 provided at the apex of the apparatus body 11 upon passing through the paper discharge path 194 extending from the upper part of the fixing device 13.

The paper feed unit 14 comprises a manual feed tray 141 provided in a freely openable and closable manner to the right-side wall in FIG. 1 of the apparatus body 11, and a paper feed cassette 142 mounted in an insertable and removable manner at a position that is lower than the exposure device 124 in the apparatus body 11.

The manual feed tray 141 is a tray provided at the lower position on the right side of the lower body 111 for feeding the recording paper P, one sheet at a time, toward the image forming unit 12 based on manual operation. The paper feed cassette 142 houses a sheet bundle P1 in which a plurality of recording papers P are stacked. A pickup roller 143 is provided above the paper feed cassette 142, and the pickup roller 143 feeds the uppermost recording layer P of the sheet bundle P1 housed in the paper feed cassette 142 toward the sheet transport path 190.

The sheet discharge part 15 is formed between the lower body 111 and the upper body 112. The sheet discharge part 15 comprises a catch tray 151 formed on the upper surface of the lower body 111. The catch tray 151 is a tray for catching the recording paper P to which the toner image has been formed with the image forming unit 12 after being subjected to the fixation treatment with the fixing device 13.

The manuscript reading unit 16 comprises a contact glass 161 mounted on the upper surface opening of the upper body 112 for mounting the manuscript, a freely openable and closable manuscript holding cover 162 for holding the manuscript mounted on the contact glass 161, and a scanning mechanism 163 for scanning and reading the image on the manuscript mounted on the contact glass 161. The scanning mechanism 163 optically reads the image of the manuscript using an image sensor such as a CCD (Charge Coupled Device) or CMOS (Complementary Metal Oxide Semiconductor), and thereby generates image data.

Figure 3:
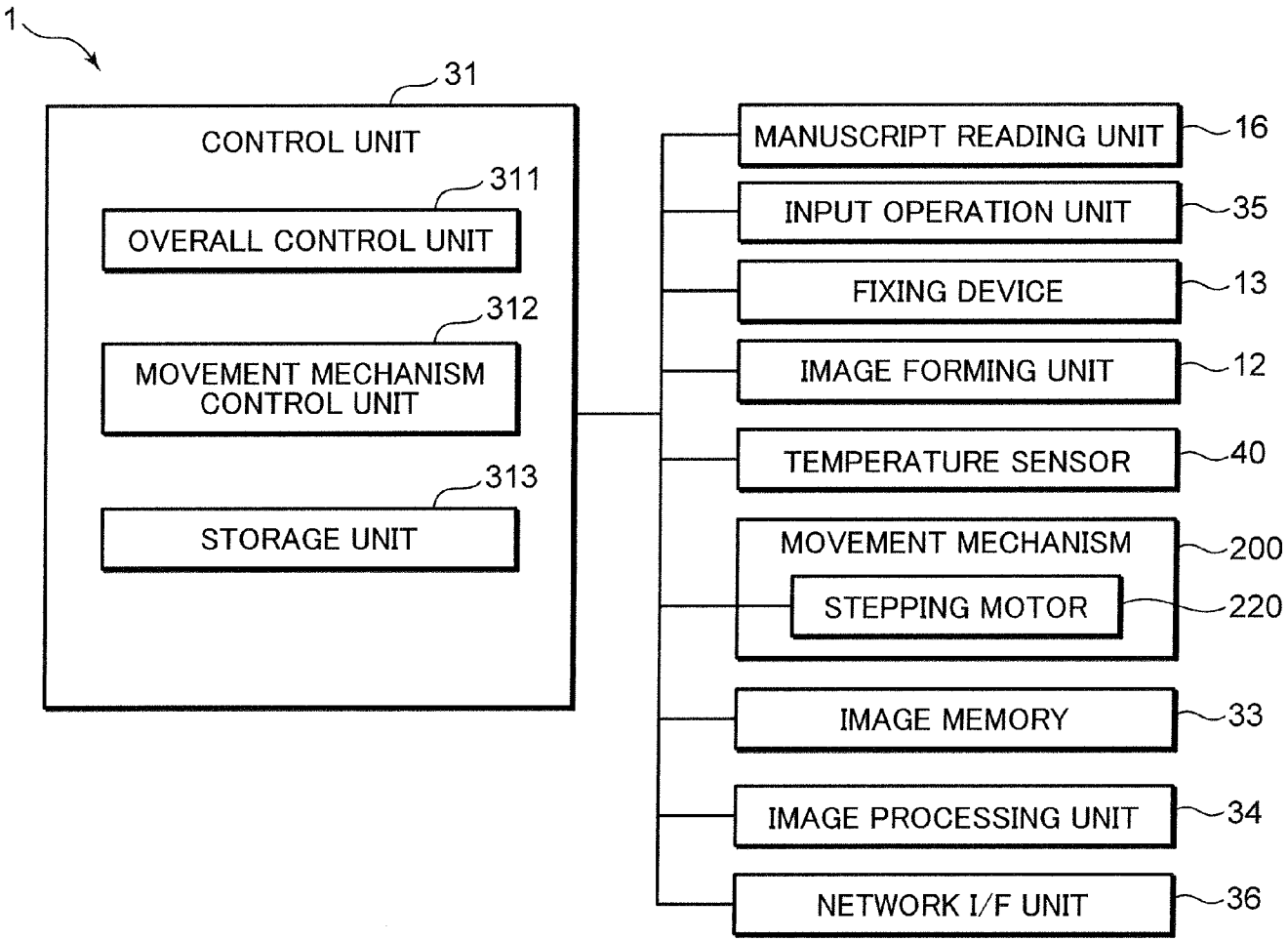
FIG. 3 is a functional block diagram showing the electrical configuration of the image forming apparatus illustrated in FIG. 1.

FIG. 3 is a functional block diagram showing the electrical configuration of the image forming apparatus 1. The image forming apparatus 1 is configured by comprising a control unit 31, an image forming unit 12, a fixing device 13, a manuscript reading unit 16, an image memory 33, an image processing unit 34, an input operation unit 35, a network I/F unit 36, a temperature sensor 40, and a movement mechanism 200. Note that the explanation of the image forming unit 12, the fixing device 13, and the manuscript reading unit 16 is omitted below since they have been explained with reference to FIG. 1.

The image memory 33 temporarily stores the image data output from the manuscript reading unit 16 or the image data sent from an external device via the network I/F unit 36. The image processing unit 34 implements image processing of image correction, expansion, reduction and the like to the image data stored in the image memory 33.

The input operation unit 35 includes a display panel for the user to view the operation screen and various messages, a power key, a numerical keypad for inputting the print copies and so on, a start button for commanding the start of reading the manuscript, and other operating buttons for inputting various operation commands. The input operation unit 35 sets the type of recording paper P such as plain paper or cardboard and the print copies by receiving the input of the foregoing operation commands from the user. Note that the input operation unit 35 functions as the paper thickness setting unit for setting the paper thickness according to the recording paper P by setting the type of the recording paper P. Moreover, if the user is to set the type of recording paper P or the print copies using the computer connected via the network I/F unit 36, the computer will function as the paper thickness setting unit.

The network I/F unit 36 is configured from a communication module such as a LAN (Local Area Network) board, and sends and receives various types of data to and from the external device. The temperature sensor 40 is a contact or noncontact temperature provided, for example, in the vicinity of the nip part N within the image forming apparatus 1, and detects the temperature of the intermediate transfer belt 125.

The movement mechanism 200 comprises a stepping motor 220, and moves the secondary transfer roller 210 based on the drive of the stepping motor 220. Details regarding the movement mechanism 200 will be explained later.

The control unit 31 is configured by comprising a storage unit 313 including a RAM (Random Access Memory), a ROM (Read Only Memory) and the like, and a CPU (Central Processing Unit). The control unit 31 additionally comprises an overall control unit 311 and a movement mechanism control unit 312.

The overall control unit 311 reads and executes programs stored in the storage unit 313 according to a command signal or the like input from the input operation unit 35 or a computer not shown connected via network I/F unit 36, and governs the overall control of the image forming apparatus 1 by outputting command signals to the respective functional units or performing data transfer and the like.

The movement mechanism control unit 312 outputs a drive pulse number according to the temperature of the intermediate transfer belt 125 of the image forming apparatus 1 detected with the temperature sensor 40 and the paper thickness corresponding to the type of recording paper P set with the input operation unit 35 to the stepping motor 220 of the movement mechanism 200, and thereby controls the travel distance of the secondary transfer roller 210.

Figure 4A:
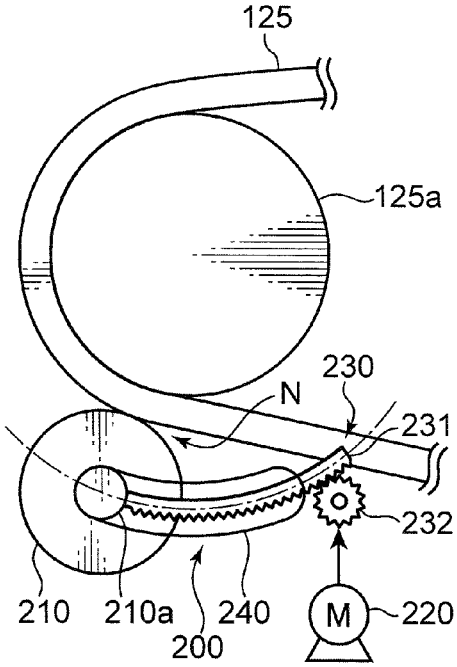
FIG. 4A is a front cross section showing an example of the movement mechanism according to the first embodiment, and is a diagram showing a state where the secondary transfer roller is in a position of not pressing the intermediate transfer belt in the inner circumferential direction.
Figure 4B:
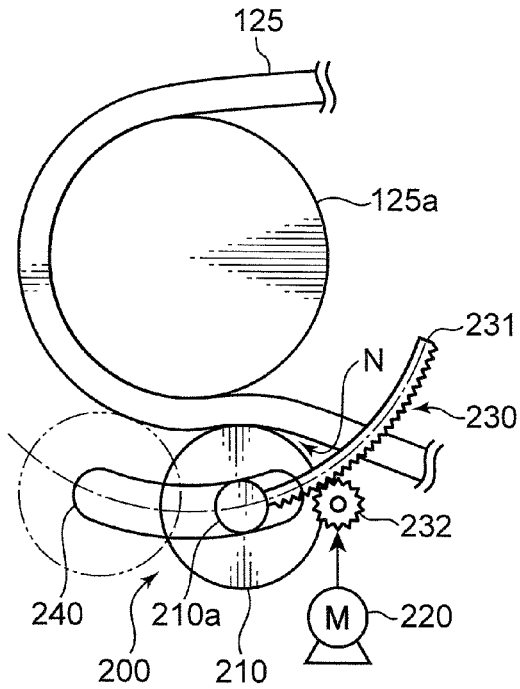
FIG. 4B is a diagram showing a state where the secondary transfer roller presses the intermediate transfer belt in the inner circumferential direction.
Figure 4C:
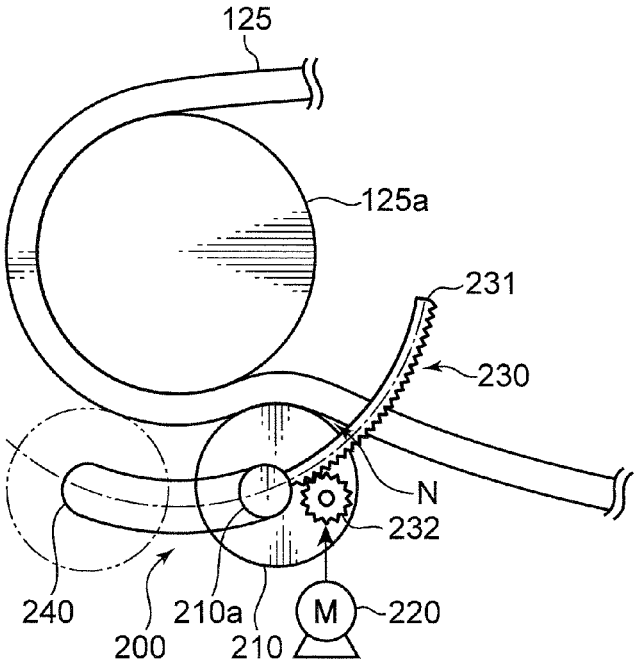
FIG. 4C is a diagram showing a state where the secondary transfer roller presses the intermediate transfer belt further in the inner circumferential direction than the state of FIG. 4B.

FIG. 4 is a front cross section showing an example of the movement mechanism 200 according to the first embodiment. FIG. 4A shows a state where the secondary transfer roller 210 is in a position of not pressing the intermediate transfer belt in the inner circumferential direction, FIG. 4B shows a state where the secondary transfer roller 210 presses the intermediate transfer belt in the inner circumferential direction, and FIG. 4C shows a state where the secondary transfer roller 210 presses the intermediate transfer belt further in the inner circumferential direction than the state of FIG. 4B.

The movement mechanism 200 is configured by comprising a stepping motor 220, a rack-and-pinion mechanism 230 (drive force transmission unit), and a guide member 240.

The guide member 240 is a member for pivotally supporting both ends of the rotation axis 210*a* of the secondary transfer roller 210 in a loosely fitted state and movable in the sub scanning direction upon image formation; that is, in the circumferential surface direction of the driving roller 125*a* in this embodiment, and is formed as a part of the case of the lower body 111 in a shape following the circumferential surface of the driving roller 125*a*. Note that the shape of the guide member 240 in this embodiment is merely an example, and the shape of the guide member 240 may be any shape so as long as it extends in the sub scanning direction.

The rack-and-pinion mechanism 230 comprises a rack 231 and a pinion 232 which engages with the rack 231, and moves the secondary transfer roller 210, in which the rotation axis 210*a* is loosely fitted in the guide member 240, along the guide member 240 based on the drive of the stepping motor 220.

The rack 231 is a circular flex member with approximately the same curvature as the center line (line shown with a dashed line) in the longitudinal direction forming the circular shape of the guide member, and one end thereof is loosely fitted in an end of the rotation axis 210*a* of the secondary transfer roller 210 in a state where the circular arc forming the longitudinal direction becomes approximately parallel with the center line in the longitudinal direction of the guide member. The pinion 232 is driven with the stepping motor 220, and rotates in the rotation frequency according to the drive pulse number of the stepping motor 220. Since the rotation axis 210*a* is loosely fitted in the guide member 240, the secondary transfer roller 210 moves in the circumferential surface direction (on the line shown with a dashed line) of the driving roller 125*a* pursuant to the movement of the guide member of the rack 231 in the circular arc direction based on the rotation of the pinion 232.

As shown in FIGS. 4A to 4C, pursuant to the increase in the travel distance of the secondary transfer roller 210 in the counterclockwise direction, the intermediate transfer belt 125 is subjected to stronger pressing force to the inner circumferential direction from the secondary transfer roller 210, and is pressed further in the inner circumferential direction.

Figure 5A:
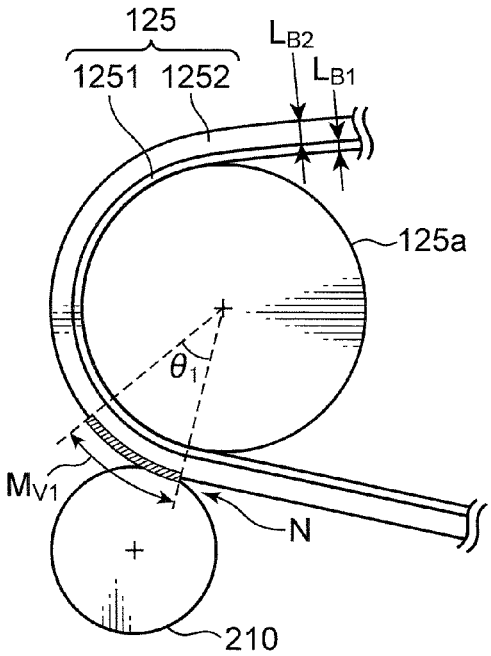
FIGS. 5A, 5B, 5C are diagrams schematically showing a state where the intermediate transfer belt is subjected to expansion and contraction due to the pressing by the secondary transfer roller pursuant to the movement of the secondary transfer roller based on the movement mechanism shown in FIGS. 4A, 4B, 4C, whereby
Figure 5B:
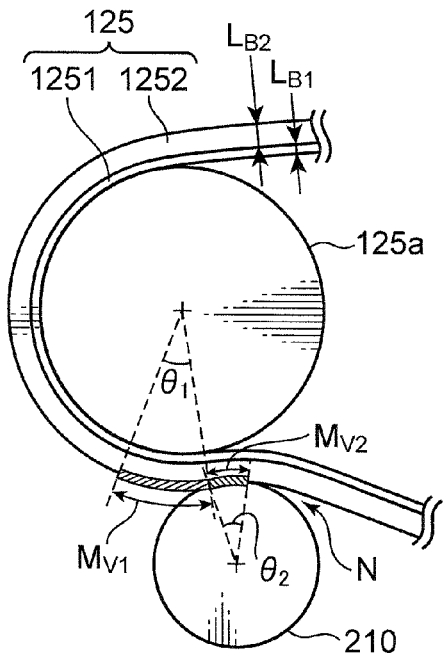
Figure 5C:
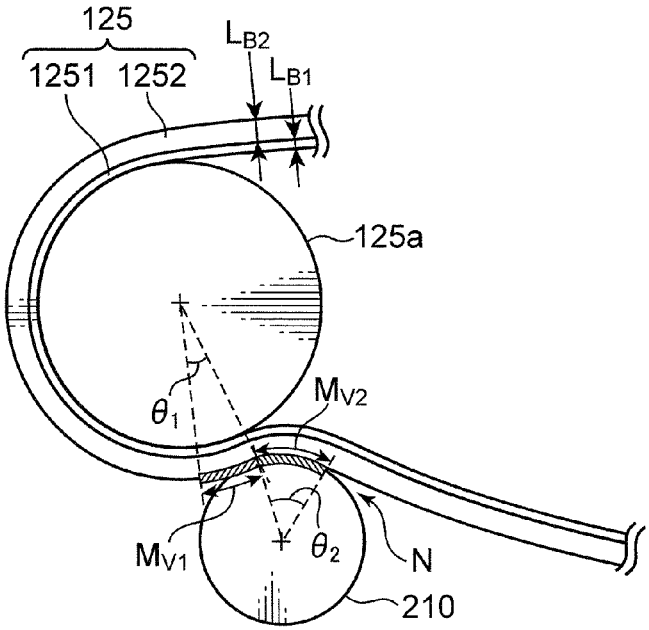

FIG. 5 is a diagram schematically showing a state where the intermediate transfer belt 125 is subjected to expansion and contraction due to the pressing by the secondary transfer roller 210 pursuant to the movement of the secondary transfer roller 210 based on the movement mechanism 200. FIGS. 5A to 5C respectively correspond to FIGS. 4A to 4C.

With respect to the portions of FIG. 5 shown as $M_{v1}$ and $M_{v2}$ where secondary transfer is performed at the outer circumferential surface of the intermediate transfer belt 125, the toner image becomes elongated at the portion that is convex in the outer circumferential direction shown in $M_{v1}$, and the toner image becomes contracted at the portion that is convex in the inner circumferential direction shown in $M_{v2}$. If the boundary of the base layer 1251 and the elastic layer 1252 of the intermediate transfer belt 125 is to be used as the rate deciding surface, and $D_1$: Roller outer diameter (mm) of the driving roller 125*a*

$D_2$: Roller outer diameter (mm) of the secondary transfer roller 210

$L_{B1}$: Thickness (mm) of the base layer 1251

$L_{B2}$: Thickness (mm) of the elastic layer 1252

$\theta_1$: Angle (radian) formed by both ends of $M_{v1}$ and the center of the driving roller 125*a*

$\theta_2$: Angle (radian) formed by both ends of $M_{v2}$ and the center of the secondary transfer roller 210, lengths of $M_{v1}$ and $M_{v2}$ relative to the rotating direction of the intermediate transfer belt can be respectively represented with the following formulae.

$$M_{v1}=\pi\times(D_1+2(L_{B1}+L_{B2}))\times\theta_1 \text{ (mm)} \quad \text{Formula (1)}$$

$$M_{v2}=\pi\times D_2\times\theta_2 \text{ (mm)} \quad \text{Formula (2)}$$

Here, if the length of the rate reference surface corresponding to $M_{v1}$ is $A_1$, and the length of the rate reference surface corresponding to $M_{v2}$ is $A_2$, $$A_1=\pi\times(D_1+2L_{B1})\times\theta_1 \text{ (mm)} \quad \text{Formula (3)}$$

$$A_2=\pi\times(D_2+2L_{B2})\times\theta_2 \text{ (mm)} \quad \text{Formula (4)}$$

and, therefore, $M_{v1}$ and $M_{v2}$ can be represented as $$M_{v1}=A_1+2\pi\times L_{B2}\times\theta_1 \text{ (mm)} \quad \text{Formula (5)}$$

$$M_{v2}=\pi\times(D_2+2(L_{B2}-L_{B2}))\times\theta_2=A_2-2\pi\times L_{B2}\times\theta_2 \text{ (mm)} \quad \text{Formula (6).}$$

Here, if the secondary transfer magnification is $M_2$, since $$M_2=(M_{v1}+M_{v2})/(A_1+A_2),$$

$$M_2=(A_1+A_2+2\pi\times L_{B2}\times(\theta_1-\theta_2))/(A_1+A_2) \quad \text{Formula (7).}$$

Specifically, if $\theta_1$ is set to be greater than $\theta_2$, the toner image on the intermediate transfer belt 125 is enlarged and secondarily transferred to the recording paper P, and if $\theta_1$ is set to be smaller than $\theta_2$, the toner image on the intermediate transfer belt 125 is reduced and secondarily transferred to the recording paper P.

Since the movement mechanism 200 moves the secondary transfer roller 210 which is movable in the circumferential surface direction of the driving roller 125*a*; that is, the sub scanning direction, by changing $\theta_1$ and $\theta_2$, it is possible to change the secondary transfer magnification $M_2$ and correct the magnification deviation in the sub scanning direction.

Meanwhile, if the temperature of the intermediate transfer belt 125 increases, since the intermediate transfer belt 125 will expand, the toner image formed on the outer circumferential surface of the intermediate transfer belt 125 becomes elongated. Specifically, the secondary transfer magnification $M_2$ increases. Contrarily, if the temperature of the intermediate transfer belt 125 decreases, since the intermediate transfer belt 125 will contract, the toner image becomes contracted. Specifically, the secondary transfer magnification $M_2$ decreases.

For example, rubber such as chloroprene rubber and urethane rubber has a greater coefficient of thermal expansion than a resin material such as PVDF. Accordingly, in cases as with this embodiment where an elastic layer 1252 made of chloroprene rubber or urethane rubber is formed on the outer circumferential side of the intermediate transfer belt 125, for example, magnification deviation is more likely to occur in comparison to cases of configuring the intermediate transfer belt 125 only with a resin material such as PVDF.

Thus, in this embodiment, the movement mechanism control unit 312 reads the temperature of the intermediate transfer belt 125 detected with the temperature sensor 40 at prescribed sampling intervals, outputs a drive pulse number DP1 proportional to a variation $\Delta T$ of the temperature T of the intermediate transfer belt 125 detected with the temperature sensor 40, moves the secondary transfer roller 210 by a travel distance proportional to the drive pulse number DP1, and thereby corrects the magnification deviation in the sub scanning direction that occurs pursuant to the increase and decrease of the temperature T of the intermediate transfer belt 125. Specifically, in order to increase the value of $\theta_2$ and reduce the secondary transfer magnification $M_2$ according to the increase in the temperature T of the intermediate transfer belt 125 detected with the temperature sensor 40, the movement mechanism control unit 312 outputs the drive pulse number DP1 corresponding to the variation $\Delta T$ at such time to the stepping motor 220 and moves the secondary transfer roller 210 in the counterclockwise direction in FIG. 4 and FIG. 5.

Note that, in this embodiment, a table which associates the drive pulse number DP1 of the stepping motor 220 for deciding the position of the secondary transfer roller 210 and the variation $\Delta T$ is stored in the storage unit 313 in advance, and the movement mechanism control unit 312 reads the drive pulse number DP1 corresponding to the variation $\Delta T$ from the foregoing table. In addition, the drive pulse number DP1 takes on both positive and negative values, and the stepping motor 220 is able to output the drive force bi-directionally in the clockwise direction and the counterclockwise direction (thus, in FIG. 4, the pinion 232 rotates bi-directionally in the clockwise direction and the counterclockwise direction).

Moreover, if the paper thickness increases according to the type of recording paper P that is transported to the nip part N, the intermediate transfer belt 125 is pressed more in the inner circumferential direction at the nip part N due to the recording paper P. Specifically, $\theta_2$ increases and the secondary transfer magnification $M_2$ decreases.

Thus, in this embodiment, the movement mechanism control unit 312 outputs a drive pulse number DP2 corresponding to the variation of $\theta_2$ which changes according to the type of recording paper P set with the input operation unit, moves the secondary transfer roller 210 by a travel distance proportional to the drive pulse number, and thereby corrects the magnification deviation in the sub scanning direction that occurs pursuant to the difference in the type of recording paper P. Specifically, in order to reduce the value of $\theta_2$ and increase the secondary transfer magnification $M_2$ in cases where a sheet with a large paper thickness such as a cardboard is set as the recording paper with the input operation unit 35, the movement mechanism control unit 312 outputs the drive pulse number DP2 corresponding to the variation of $\theta_2$ which occurs due to the difference in paper thickness between the recording paper and plain paper to the stepping motor 220, and moves the secondary transfer roller 210 more in the clockwise direction in FIG. 4 and FIG. 5 than the position upon printing plain paper.

Storing a table which associates the drive pulse number DP2 and the variation of $\theta_2$ in advance in the storage unit 313, the movement mechanism control unit 312 reading the drive pulse number DP2 corresponding to the variation of $\theta_2$ from the foregoing table, and the drive pulse number DP2 taking on both positive and negative values are the same as the case of the drive pulse number DP1 that is output by the movement mechanism control unit 312 upon correcting the magnification deviation in the sub scanning direction that occurs pursuant to the increase and decrease in the temperature T of the intermediate transfer belt 125.

In this embodiment, the movement mechanism control unit 312 outputs the drive pulse number (DP1+DP2) obtained by adding the drive pulse number DP2 to the drive pulse number DP1 to the stepping motor 220, and thereby moves the secondary transfer roller 210.

Figure 6:
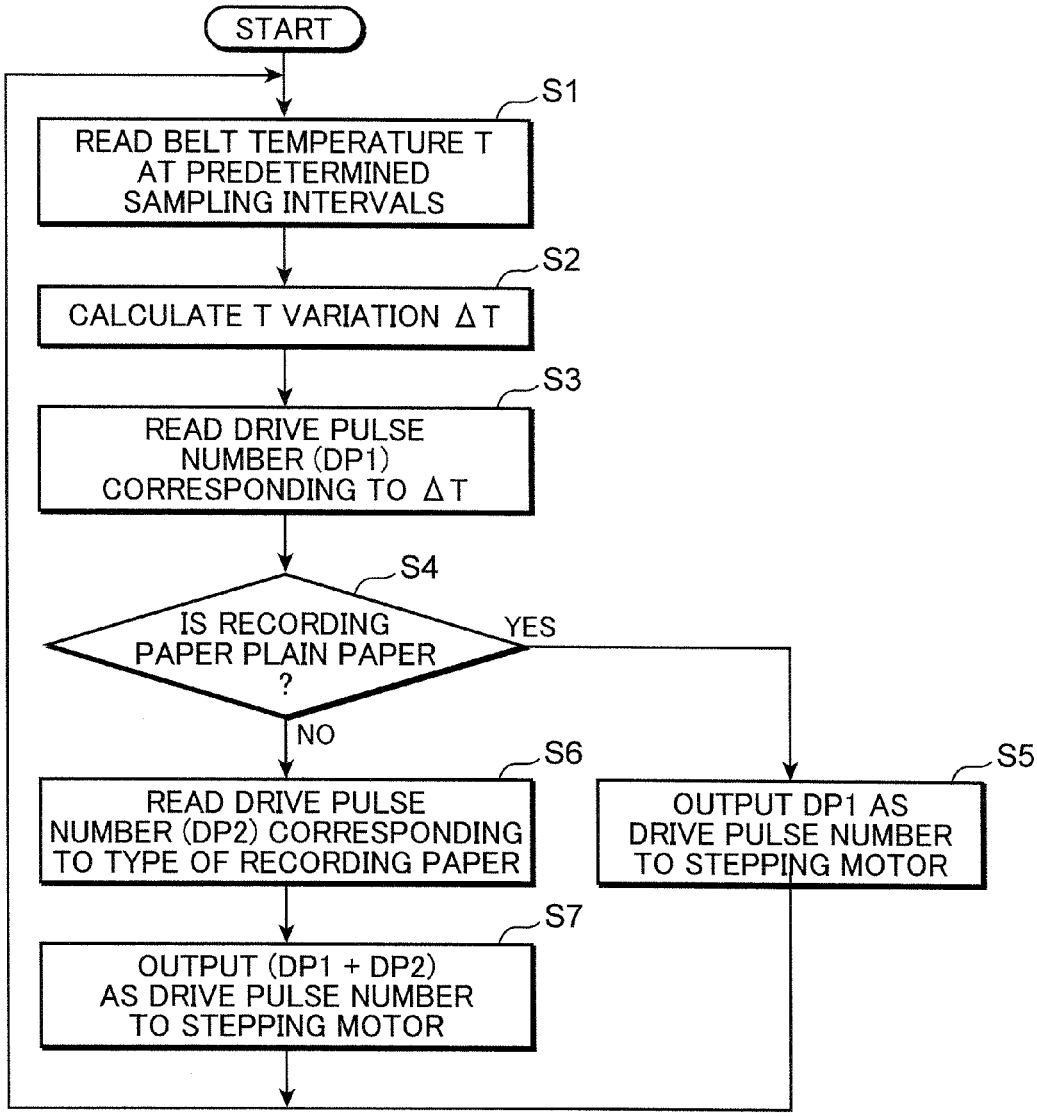
FIG. 6 is a flowchart showing the control for the movement mechanism control unit to decide the drive pulse number of the stepping motor and cause the movement mechanism to move the secondary transfer roller.

FIG. 6 is a flowchart showing the control of the movement mechanism control unit deciding the drive pulse number of the stepping motor 220 according to the temperature of the intermediate transfer belt 125 detected with the temperature sensor 40 and the type of recording paper P set with the input operation unit 35, and causing the movement mechanism 200 to move the secondary transfer roller 210. When the image formation operation by the image forming unit 12 is started, the movement mechanism control unit 312 reads the temperature T of the intermediate transfer belt 125 detected with the temperature sensor 40 at prescribed sampling intervals (step S1), and calculates the variation ΔT of the temperature T of the intermediate transfer belt 125 in the sampling intervals (step S2). Subsequently, the movement mechanism control unit 312 reads the drive pulse number DP1 corresponding to the variation ΔT from the table stored in the storage unit 313 (step S3).

If the recording paper P set with the input operation unit 35 is plain paper (YES at step S4), the movement mechanism control unit 312 outputs the read drive pulse number DP1 to the stepping motor 220 (step S5). Meanwhile, if the recording paper P set with the input operation unit 35 is not plain paper (NO at step S4), the movement mechanism control unit 312 reads the drive pulse number DP2 corresponding to the type of recording paper P from the table stored in the storage unit 313 (step S6), and outputs the drive pulse number (DP1+DP2) in which DP2 is added to DP1 to the stepping motor 220 (step S7). Consequently, the secondary transfer roller 210 moves by a travel distance proportional to the drive pulse number (DP1+DP2), and the magnification deviation in the sub scanning direction which occurs pursuant to the increase and decrease in the temperature T of the intermediate transfer belt 125 and the difference in the type of recording paper P is thereby corrected.

Note that it is also possible to adopt a mode where the movement mechanism control unit 312 decides the drive pulse number to be output only with respect to the variation ΔT of the temperature T of the intermediate transfer belt 125 detected with the temperature sensor 40, or the variation of $\theta_2$ which changes according to the type of recording paper P set with the input operation unit 35.

Figure 7A:
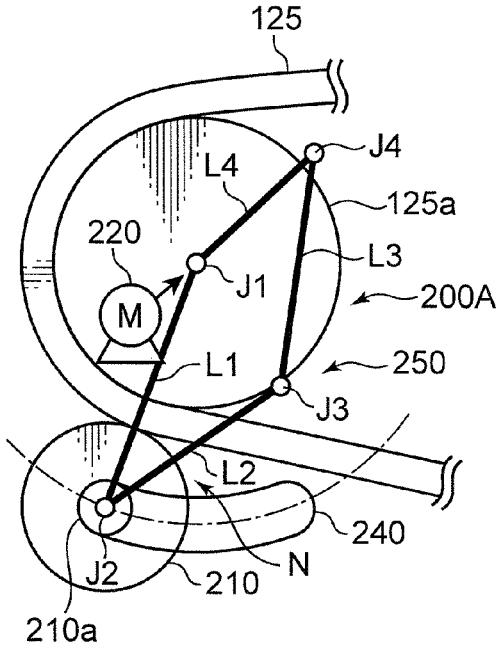
FIGS. 7A, 7B, 7C are front cross sections showing another example of the movement mechanism, whereby
Figure 7B:
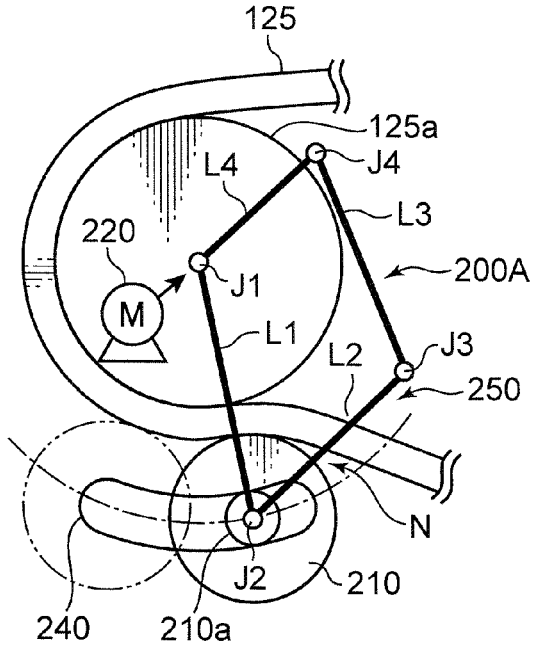
Figure 7C:
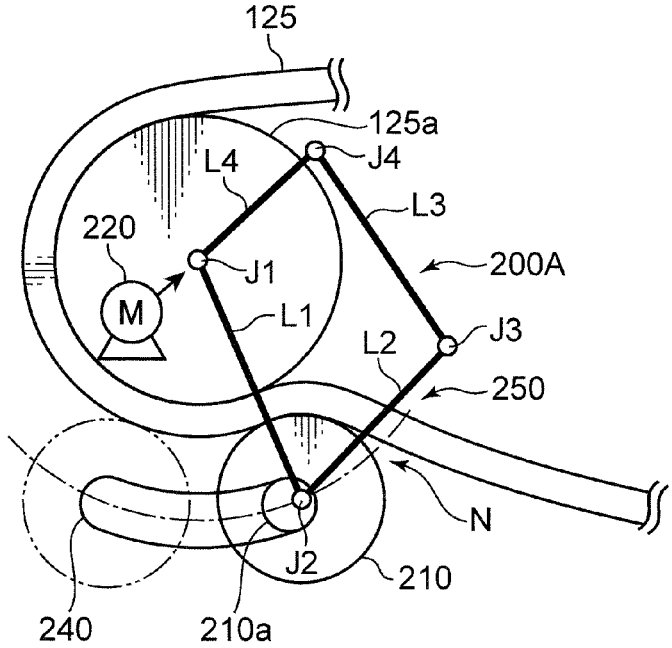

Another example of the foregoing movement mechanism 200 is now explained. As shown in FIG. 7, the movement mechanism 200A can also be configured from a stepping motor 220, a four-joint linkage mechanism 250 (drive force transmission unit), and a guide member 240. The configuration of the guide member 240 is the same as the example shown in FIG. 4, and the four-joint linkage mechanism 250 moves the secondary transfer roller 210, in which the rotation axis 210*a* is loosely fitted in the guide member 240, along the guide member 240 based on the drive of the stepping motor 220.

The four joint linkage mechanism 250 is provided by being positioned at both ends in the longitudinal direction of the secondary transfer roller 210 and the driving roller 125*a*, and comprises the four links of movable links L1 to L3 and a fixed link L4, and four joints J1 to J4 which are rotatably connected to the respective links of L1 to L4 at one degree of freedom. Specifically, one end of the fixed link L4 is fixed to the joint J1 at the shaft center position of the driving roller 125*a* and the other end is fixed to the joint J4, one end of the movable link L1 is turnably connected to the fixed link L4 with the joint J1 and the other end is turnably connected to the movable link L2 with the joint J2, one end of the movable link L2 is turnably connected to the movable link L1 with the joint J2 and the other end is turnably connected to the movable link L3 with the joint J3, and one end of the movable link L3 is turnably connected to the movable link L2 with the joint J3 and the other end is turnably connected to the fixed link L4 with the joint J4.

The joint J2 is provided respectively to both ends of the rotation axis 210*a* of the secondary transfer roller 210, and connects the movable links L1 and the movable links L2 to the secondary transfer roller 210. Based on the drive of the stepping motor 220, the movable links L1 to L3 move so that the joint J2 moves in a concentric shape (on the line shown with a dashed line) along the circumferential surface of the driving roller 125*a* around the joint J1 positioned at the shaft center of the driving roller 125*a*. Thus, the secondary transfer roller 210 connected to the movable link L1 and the movable link L2 with the joint J2 also moves in a concentric shape along the circumferential surface of the driving roller 125*a* around the joint J1 positioned at the shaft center of the driving roller 125*a*.

The second embodiment of the movement mechanism 200 is now explained. FIG. 8 is a front cross section showing an example of the movement mechanism 200B according to the second embodiment. In this embodiment, the secondary transfer roller 210 is biased toward the shaft center of the driving roller 125*a* in the inter-axis direction of the secondary transfer roller 210 and the driving roller 125*a* by a biasing member not shown, and is configured to be movable in a direction of moving toward and away from the shaft center of the driving roller 125*a* in the inter-axis direction of the secondary transfer roller 210 and the driving roller 125*a* in a state of being in contact with the intermediate transfer belt 125 based on the movement mechanism 200B.

The movement mechanism 200B according to the second embodiment moves the secondary transfer roller 210 in a direction of moving toward and away from the shaft center of the driving roller 125*a* in the inter-axis direction of the secondary transfer roller 210 and the driving roller 125*a* (secondary transfer opposing roller), and changes the pressed state of the intermediate transfer belt 125 by the secondary transfer roller 210 at the nip part N of the driving roller 125*a* and the secondary transfer roller 210. The second embodiment is applied in substitute of the foregoing first embodiment.

Figure 8B:
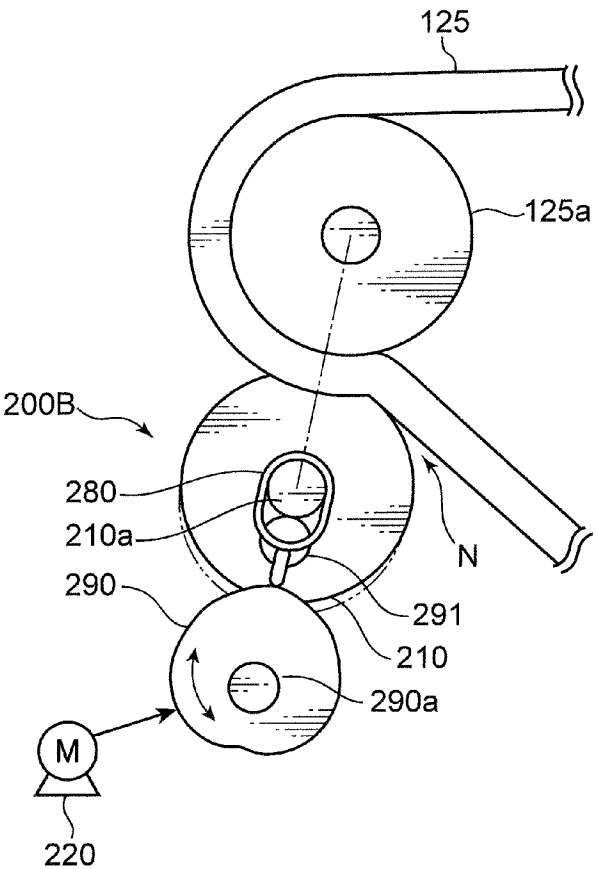
FIGS. 8A, 8B are front cross sections showing an example of the movement mechanism according to the second embodiment, whereby
Figure 8A:
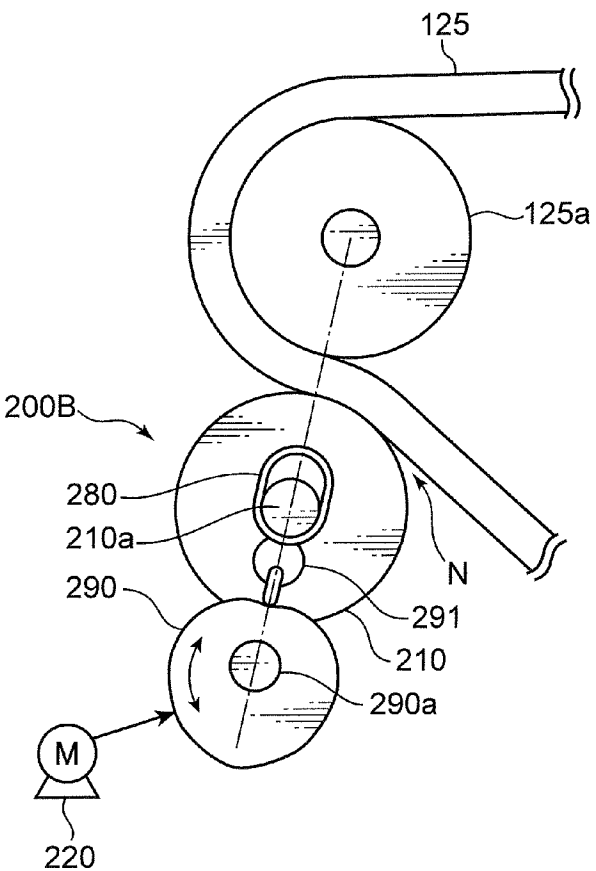

FIG. 8A shows a state where the secondary transfer roller 210 is positioned farthest from the driving roller 125*a*, and FIG. 8B shows a state where the secondary transfer roller 210 is positioned closes to the driving roller 125*a*, respectively. The movement mechanism 200B comprises a stepping motor 220, a cam 290 as an example of the drive force transmission unit, a roller 291, and a guide member 280, and changes the pressed state of the intermediate transfer belt 125 by the secondary transfer roller 210 at the nip part N where the toner image on the intermediate transfer belt 125 is transferred from the intermediate transfer belt 125 to the recording paper P.

The guide member 280 is a member for pivotally supporting both ends of the rotation axis 210*a* of the secondary transfer roller 210 in a loosely fitted state, and is formed as a part of the case of the lower body 111 along the inter-axis direction of the secondary transfer roller 210 and the driving roller 125*a*.

The cam 290 comprises a rotation axis 290*a* which is rotatably fixed to the case of the lower body 111, and rotates at an angle of rotation according to the drive pulse number of the stepping motor 220 around the rotation axis 290*a* as a result of being driven by the stepping motor 220.

The roller 291 is configured to slidingly contact the rotation axis 210*a* of the secondary transfer roller 210 at a position that is opposite to the nip part N and slidingly contact the cam 290 on the side that is opposite to the side in which it slidingly contacts the rotation axis 210*a* so as to move along the inter-axis direction of the secondary transfer roller 210 and the driving roller 125*a*.

Pursuant to the rotation of the cam 290, the rotation axis 210*a* of the secondary transfer roller 210 is pressed by the cam 290 via the roller 291, and the secondary transfer roller 210 moves in a direction of moving toward and away from the shaft center of the driving roller 125*a* in the inter-axis direction of the secondary transfer roller 210 and the driving roller 125*a* along the guide member 280. The pressed state of the intermediate transfer belt 125 by the secondary transfer roller 210 is thereby changed at the nip part N. In this embodiment, in order to cause the drive pulse number of the stepping motor 220 and the travel distance of the secondary transfer roller 210 to be proportional, the cam 290 has a cam profile where the cam diagram becomes a straight line. Note that the configuration may be such that the roller 291 is omitted and the cam 290 and the rotation axis 210*a* of the secondary transfer roller 210 are in direct sliding contact.

Moreover, with the movement mechanism 200B, the size of the guide member 280 and the cam 290 is decided so that the secondary transfer roller 210 is able to maintain sliding contact with the intermediate transfer belt 125 in a state where the travel distance of the secondary transfer roller 210 is such that the secondary transfer roller 210 is positioned farthest from the driving roller 125*a* as shown in FIG. 8A. Specifically, in the state shown in FIG. 8A, the movement mechanism 200B is configured such that the inter-axis distance of the secondary transfer roller 210 and the driving roller 125*a* is less than the total value of the radius of the secondary transfer roller 210 and the radius of the driving roller 125*a* and the thickness of the intermediate transfer belt 125.

Note that the configuration of using the cam 290 in the movement mechanism 200B is merely an example, and it will suffice so as long as the movement mechanism 200B is configured to move the secondary transfer roller 210 in a direction of moving toward and away from the shaft center of the driving roller 125*a* in the inter-axis direction of the secondary transfer roller 210 and the driving roller 125*a* in a state of being in contact with the intermediate transfer belt 125.

Figure 9A:
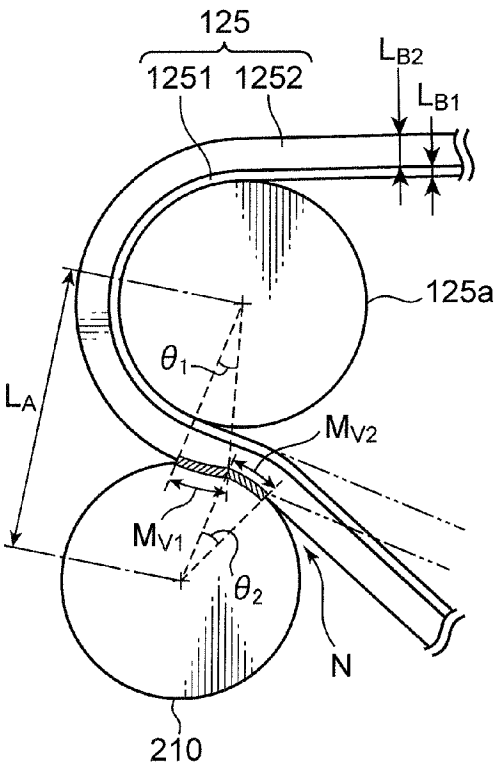
FIGS. 9A, 9B, 9C are diagrams schematically showing a state where the intermediate transfer belt is subjected to expansion and contraction due to the pressing by the secondary transfer roller pursuant to the movement of the secondary transfer roller based on the movement mechanism shown in FIG. 8, whereby FIG. 9A to FIG. 9C sequentially show a state where the secondary transfer roller is approaching the driving roller.
Figure 9B:
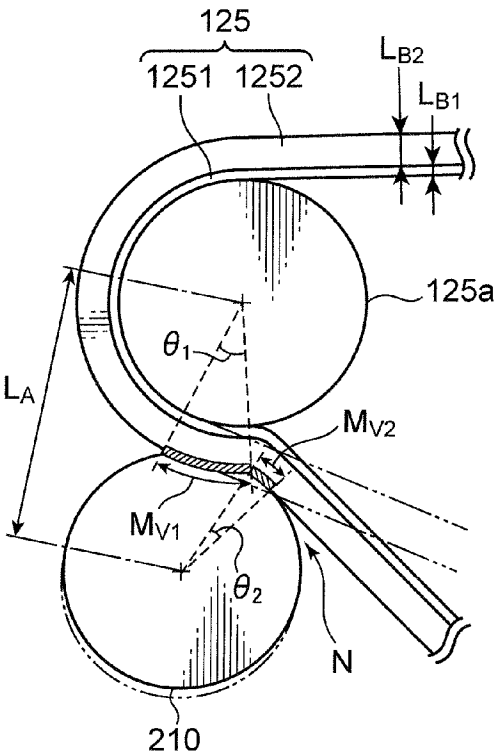
Figure 9C:
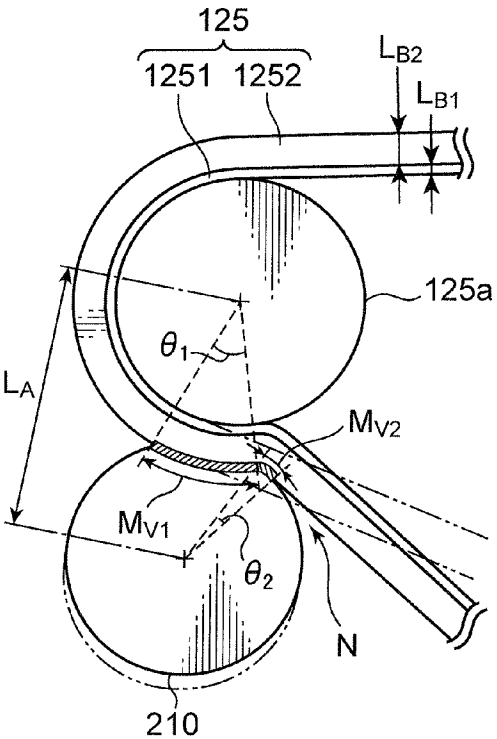

FIG. 9 is a diagram schematically showing a state where the intermediate transfer belt 125 is subjected to expansion and contraction due to the pressing by the secondary transfer roller 210 pursuant to the movement of the secondary transfer roller 210 based on the movement mechanism 200B. FIG. 9A to FIG. 9C sequentially show a state where the secondary transfer roller 210 is approaching the driving roller 125*a*.

At the nip part N (portion where the secondary transfer is performed at the outer circumferential surface of the intermediate transfer belt 125) of FIG. 9 shown as $M_{v1}$ and $M_{v2}$, the toner image becomes elongated at the portion that is convex in the outer circumferential direction shown in $M_{v1}$, and the toner image becomes contracted at the portion that is convex in the inner circumferential direction shown in $M_{v2}$. If the secondary transfer roller 210 is moved in a direction in which the distance (indicated as $L_A$) between the axes becomes shorter in the inter-axis direction of the secondary transfer roller 210 and the driving roller 125*a*, as shown in FIG. 9A to FIG. 9C, with the secondary transfer roller 210 formed from an elastic member, its outer circumferential surface sinks in considerably due to the inner circumferential side of the secondary transfer roller 210, the length of $M_{v1}$ increases at the nip part N, and the toner image formed on the outer circumferential surface is stretched even further. Meanwhile, the opposite will occur if the secondary transfer roller 210 is moved in a direction where $L_A$ becomes longer in the inter-axis direction.

Based on the respective formulae shown in the explanation of FIG. 5 regarding the movement mechanism 200 according to the first embodiment, since there is no practical problem upon deeming $\theta_1+\theta_2=k$ (constant) in the foregoing case, the secondary transfer magnification $M_2$ can be obtained as the function of the inter-axis distance $L_A$.

Since the movement mechanism 200B moves the secondary transfer roller 210 in the inter-axis direction of the secondary transfer roller 210 and the driving roller 125*a*, $L_A$ can be changed in order to change the secondary transfer magnification $M_2$ in the sub scanning direction.

In the second embodiment also, the movement mechanism control unit 312 performs control of deciding the drive pulse number of the stepping motor 220 according to the temperature of the intermediate transfer belt 125 detected with the temperature sensor 40 and the type of recording paper P set with the input operation unit 35, and causing the movement mechanism 200 to move the secondary transfer roller 210. The foregoing control is the same as the control explained with reference to FIG. 6 regarding the movement mechanism 200 according to the first embodiment.

In the second embodiment also, the control explained with reference to FIG. 6 regarding the movement mechanism 200 according to the first embodiment is adopted. In the second embodiment also, as with the control explained with reference to FIG. 6 regarding the movement mechanism 200 according to the first embodiment, the movement mechanism control unit 312 reads the temperature of the intermediate transfer belt 125 detected with the temperature sensor 40 at prescribed sampling intervals, outputs a drive pulse number DP1 proportional to a variation ΔT of the temperature T of the intermediate transfer belt 125 detected with the temperature sensor 40, moves the secondary transfer roller 210 by a travel distance proportional to the drive pulse number DP1, and thereby corrects the magnification deviation in the sub scanning direction that occurs pursuant to the increase and decrease of the temperature T of the intermediate transfer belt 125. Specifically, in order to increase the inter-axis distance $L_A$ and reduce the secondary transfer magnification $M_2$ according to the increase in the temperature T of the intermediate transfer belt 125 detected with the temperature sensor 40, the movement mechanism control unit 312 outputs the drive pulse number DP1 corresponding to the variation ΔT at such time to the stepping motor 220 and moves the secondary transfer roller 210 in a direction of being separated from the driving roller 125*a*.

Note that, also in the control of the movement mechanism 200B according to the second embodiment, a table which associates the drive pulse number DP1 of the stepping motor 220 for deciding the position of the secondary transfer roller 210 and the variation ΔT is stored in the storage unit 313 in advance, and the movement mechanism control unit 312 reads the drive pulse number DP1 corresponding to the variation ΔT from the foregoing table. In addition, the drive pulse number DP1 takes on both positive and negative values, and the stepping motor 220 is able to output the drive force bidirectionally in the clockwise direction and the counterclockwise direction (thus, in FIG. 8, the cam 290 rotates bi-directionally in the clockwise direction and the counterclockwise direction).

Moreover, if the paper thickness increases according to the type of recording paper P that is transported to the nip part N, the intermediate transfer belt 125 is pressed more in the inner circumferential direction at the nip part N due to the recording paper P. Specifically, $\theta_2$ increases and the secondary transfer magnification $M_2$ decreases.

Thus, also in the control of the movement mechanism 200B according to the second embodiment, the movement mechanism control unit 312 outputs a drive pulse number DP2 corresponding to the variation of $\theta_2$ which changes according to the type of recording paper P set with the input operation unit, moves the secondary transfer roller 210 by a travel distance proportional to the drive pulse number, and thereby corrects the magnification deviation in the sub scanning direction that occurs pursuant to the difference in the type of recording paper P. Specifically, in order to reduce the value of $\theta_2$ and increase the secondary transfer magnification $M_2$ in cases where a sheet with a large paper thickness such as a cardboard is set as the recording paper with the input operation unit 35, the movement mechanism control unit 312 outputs the drive pulse number DP2 corresponding to the variation of $\theta_2$ which occurs due to the difference in paper thickness between the recording paper and plain paper to the stepping motor 220, and moves the secondary transfer roller 210 in a direction of approaching the driving roller 125*a* than the position upon printing plain paper.

The image forming apparatus according to the present invention was explained above based on the configuration and processing of the image forming apparatus 1 according to the relevant embodiment, but the image magnification adjustment method based on the processing and control for correcting the image magnification in the sub scanning direction which is performed in each of the foregoing embodiments is also an embodiment of the image magnification adjustment method according to the present invention.

According to each of the foregoing embodiments described above, it is possible to correct the magnification deviation in the sub scanning direction, without deteriorating the productivity, in an image forming apparatus which performs image formation on recording paper based on a secondary transfer method using an intermediate transfer belt. Specifically, according to the foregoing embodiments, it is possible to avoid the deterioration in the printing rate and the deterioration in the productivity which were seen in the conventional image forming apparatus described in the Description of the Background Art upon changing the drive rate of the transfer transport device; that is, changing the recording paper transport rate in order to correct the magnification deviation, and at the same time easily correct the magnification deviation in the sub scanning direction upon image formation.

In addition, according to the foregoing embodiments, since the movement mechanism control unit 312 controls the pressing amount of the intermediate transfer belt 125 according to at least one of the variation $\Delta T$ of the temperature T of the intermediate transfer belt 125 detected with the temperature sensor 40, and the paper thickness of the recording paper P, the magnification deviation in the sub scanning direction can be corrected accurately.

The image forming apparatus 1 according to an embodiment of the present invention was explained above, but such embodiment is merely an example. Specifically, the present invention is not limited to the foregoing embodiment, and may be variously modified and improved to the extent that it does not deviate from the gist thereof, and, for example, the present invention may take on the following modified embodiments.

For example, in the movement mechanism 200 according to the first embodiment, the guide member 240 was formed in a shape following the circumferential surface of the driving roller 125*a*, but the shape of the guide member 240 may be a shape extending in the sub scanning direction of the driving roller 125*a*. It is thereby possible to change the pressed state of the intermediate transfer belt 125 by the secondary transfer roller 210 at the nip part N to a direction of countering the expansion and contraction of the intermediate transfer belt 125 in the sub scanning direction, move the secondary transfer roller 210 in the sub scanning direction according to the expansion and contraction of the intermediate transfer belt and change the pressed state of the intermediate transfer belt 125 by the secondary transfer roller 210, and thereby correct the magnification deviation in the sub scanning direction.

Moreover, since the rubber such as chloroprene rubber and urethane rubber used as the elastic layer 1252 in each of the foregoing embodiments expands due to moisture absorption even though its influence is small in comparison to the expansion and contraction caused by a temperature change, it is also possible to provide a humidity sensor in the image forming apparatus 1 and cause the movement mechanism control unit 312 to move the secondary transfer roller 210 according to the humidity detected with the humidity sensor.

The image forming apparatus 1 according to the third embodiment of the present invention is now explained with reference to foregoing FIG. 1. In the third embodiment, the image forming apparatus 1 does not comprise a mechanism for moving the secondary transfer roller 210 as with the first embodiment, and comprises a mechanism for moving the driven roller 125*b*. Note that the third embodiment is configured the same as the first embodiment with respect to the constituent elements which are not specifically referred to.

In the third embodiment, the driven roller 125*b* shown in FIG. 1 also functions as a tension roller for applying tension to the intermediate transfer belt 125 tightly stretched across the driving roller 125*a* and the driven roller 125*b*. The driven roller 125*b* is biased movably toward the inward and outward directions of the revolving line of the intermediate transfer belt 125 tightly stretched across the driving roller 125*a* and the driven roller 125*b* and which revolves in an endless motion based on the movement mechanism 200 described later as a mechanism for moving the driven roller 125*b*. As a result of the position of the driven roller 125*b* is moved in a direction heading toward the inward and outward directions of the intermediate transfer belt 125 by the movement mechanism 200, the tension applied to the intermediate transfer belt 125 changes, and, pursuant to such change in tension, the tightly stretched state of the intermediate transfer belt 125 across the driving roller 125*a* will change. Based on the change in the tightly stretched state of the intermediate transfer belt 125, the pressed state of the intermediate transfer belt 125 by the secondary transfer roller 210 as a result of pressing the outer circumferential surface of the intermediate transfer belt 125 toward the driving roller 125*a* is changed.

Note that details concerning the movement of the driven roller 125*b* by the movement mechanism 200 and the change in the pressed state of the intermediate transfer belt 125 pressed by the driving roller 125*a* and the secondary transfer roller 210 pursuant to the foregoing movement will be described later.

Moreover, the electrical configuration of the image forming apparatus 1 according to the third embodiment is basically the same as the configuration shown in foregoing FIG. 3.

However, in the third embodiment, the movement mechanism 200 is a mechanism for moving the position of the driven roller 125*b* in a direction heading toward the inside and outside of the intermediate transfer belt 125. The movement mechanism 200 comprises, as described later, a tension spring 201*a*, and a positioning mechanism 202. The movement mechanism control unit 312 controls the operation of the positioning mechanism 202.

The movement mechanism control unit 312 in the third embodiment controls the travel distance of the driven roller 125*b* by outputting, to the cam drive mechanism (stepping motor) 220 of the movement mechanism 200, a drive pulse of the cam drive mechanism (stepping motor) 220 according to the amount of temperature change calculated based on the temperature of the intermediate transfer belt 125 detected with the temperature sensor 40, or the drive pulse of the cam drive mechanism (stepping motor) 220 according to the variation in the paper thickness (for example, paper thickness variation based on the type of recording paper when the paper thickness of plain paper is used as the reference) corresponding to the type of recording paper P set with the input operation unit 35, or a drive pulse obtained by adding the foregoing drive pulses.

Figure 10A:
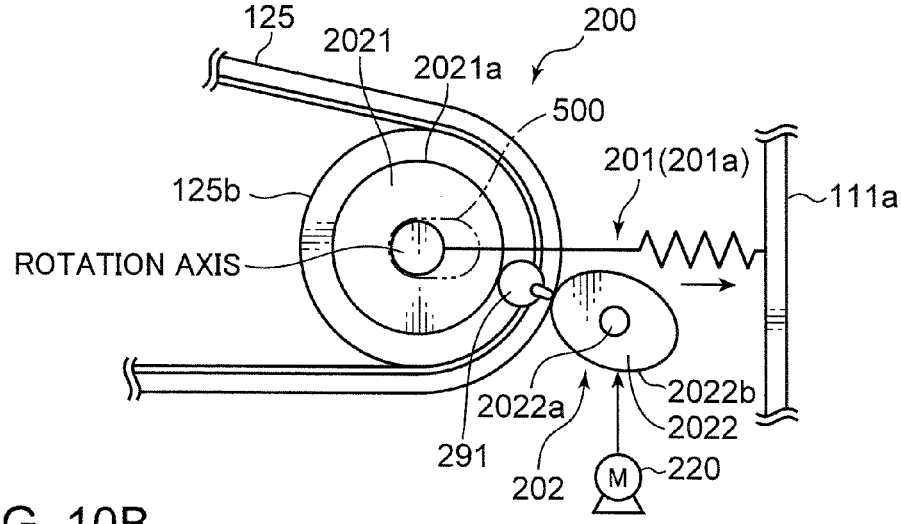
FIGS. 10A, 10B, 10C are side views showing an example of the movement mechanism according to the third embodiment.
Figure 10B:
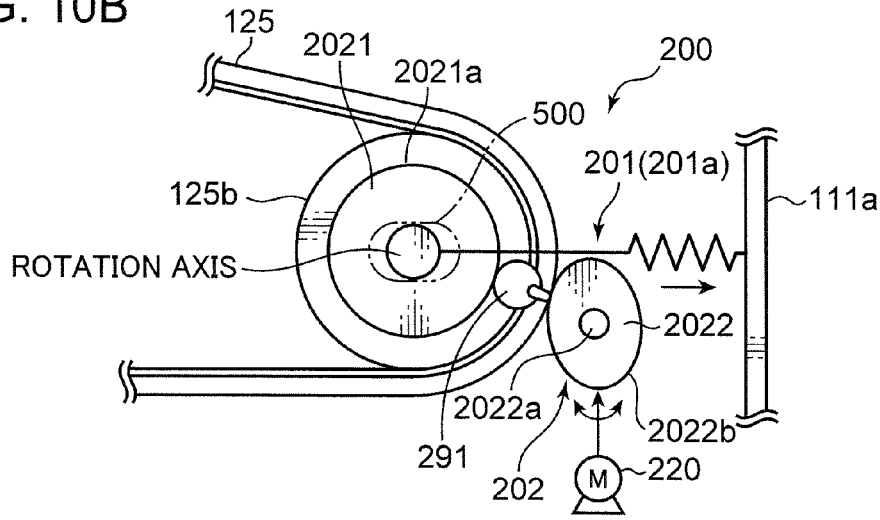
Figure 10C:
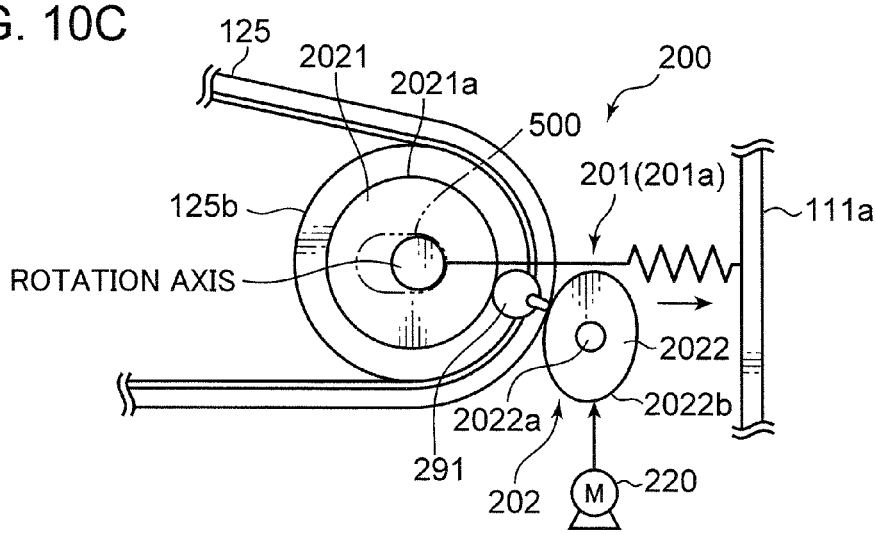

FIGS. 10A, 10B, 10C are side views showing an example of the movement mechanism 200 in the image forming apparatus 1 of the third embodiment.

The movement mechanism 200 includes a biasing mechanism 201 and a positioning mechanism 202. The biasing mechanism 201 comprises a tension spring 201*a* for connecting the rotation axis of the driven roller 125*b*, and an apparatus body inner wall part 111*a* positioned outside the revolving line of the intermediate transfer belt 125 tightly stretched across the driving roller 125*a* and the driven roller 125*b* and which revolves in endless motion. The tension spring 201*a* is used to bias the driven roller 125*b* toward the outward direction (arrow direction in FIGS. 10A, 10B, 10C) of the revolving line of the intermediate transfer belt 125.

The positioning mechanism 202 comprises a guide member 2021, a cam member 2022, and a cam drive mechanism 220. The guide member 2021 is concentric with the rotation axis of the driven roller 125*b* and configured to co-rotate with the rotation axis, and is of a circular shape as shown in FIGS. 10A, 10B, 10C. The cam member 2022 is configured to be freely rotatable in a state of being in contact with the guide member 2021. The cam drive mechanism 220 is configured from a stepping motor or the like, and rotates the cam member 2022 around the rotation axis of the cam member 2022.

The cam member 2022 comprises a rotation axis 2022*a* rotatably fixed to the case of the lower body 111, is rotatably driven by the rotating drive force from the cam drive mechanism 220, and rotates at an angle of rotation according to the drive pulse number of the cam drive mechanism (stepping motor) 220 around the rotation axis 2022*a*.

The roller 291 slidingly contacts the outer circumferential surface 2021*a* of the guide member 2021 of the driven roller 125*b*, and is configured to move along the inter-axis direction of the rotation axis of the driven roller 125*b* and the rotation axis of the cam member 2022.

Although the driven roller 125*b* is biased in the outward direction of the foregoing intermediate transfer belt 125 by the tension spring 201*a*, movement of the driven roller 125*b* in the foregoing outward direction is stopped against the biasing force of the tension spring 201*a* at the point where the roller 291 comes in contact with the circumferential surface 2022*b* of the cam member 2022. Thus, when the cam member 2022 rotates based on the rotating drive force from the cam drive mechanism 220, the position of the driven roller 125*b* heading toward the outward direction of the foregoing intermediate transfer belt 125 moves in the direction of moving toward and away from the shaft center of the driven roller 125*b* (direction of moving toward and away from the driving roller 125*a*) in the inter-axis direction of the rotation axis 2022*a* of the cam member 2022 and the rotation axis of the driven roller 125*b*. FIG. 10B shows a state where the arrangement position of the driven roller 125*b* is in the reference position, FIG. 10A shows a state where the arrangement position of the driven roller 125*b* moves to a position that is farthest from the rotation axis 2022*a* of the cam member 2022, and FIG. 10C shows a state where the arrangement position of the driven roller 125*b* moves to a position that is closest from the rotation axis 2022*a* of the cam member 2022. As a result of selectively turning the cam member 2022 from the arrangement position of the driven roller 125*b* in the reference position shown in FIG. 10B (position where the travel distance of the cam member 2022 moving the driven roller 125*b* is smallest) to either arrow direction shown in FIG. 10B at the angle of rotation according to the drive pulse number of the cam drive mechanism (stepping motor) 220, the arrangement position of the driven roller 125*b* can thereby be controlled.

Specifically, the cam member 2022 positions the position of the driven roller 125*b* in the outward direction against the bias of the tension spring 201*a* regarding the driven roller 125*b* that is biased toward the outward direction of the foregoing intermediate transfer belt 125 by the tension spring 201*a*.

If the travel distance of the driven roller 125*b* heading toward the outward direction of the foregoing intermediate transfer belt 125 increases, the tension applied by the driven roller 125*b* to the intermediate transfer belt 125 will become stronger. Contrarily, if the travel distance of the driven roller 125*b* heading toward the outward direction of the foregoing intermediate transfer belt 125 decreases, the tension applied by the driven roller 125*b* to the intermediate transfer belt 125 will become weaker.

Consequently, the tension of the intermediate transfer belt 125 can be adjusted by drive-controlling the positioning mechanism 202. Note that, for example, preferably, the portion that is used for the control in the circumferential surface of the cam member 2022 has a cam profile in which the cam diagram is a straight line, and the drive pulse number of the cam drive mechanism 220 and the travel distance of the driven roller 125*b* are made to be proportional from the perspective of positioning control of the driven roller 125*b* and tension control of the intermediate transfer belt 125 according to the expansion and contraction of the intermediate transfer belt 125. The cam member 2022 may also be configured from an eccentric cam if it is able to obtain the same effect as the foregoing cam member 2022. Moreover, the configuration may also be such that the roller 291 is omitted and the circumferential surface of the cam member 2022 and the guide member 2021 come into direct sliding contact.

Moreover, the bearing 500 of the rotation axis of the driven roller 125*b* is formed on the case of the lower body 111, and the shape of the bearing 500 is formed in accordance with the travel distance of the driven roller 125*b* which moves pursuant to the rotation of the cam member 2022.

Note that the configuration of the movement mechanism 200 which uses the cam member 2022 as described above is merely an example, and the movement mechanism 200 may also adopt another configuration of moving the arrangement position of the driven roller 125*b* in a direction of heading toward the outside of the foregoing intermediate transfer belt 125.

Figure 11A:
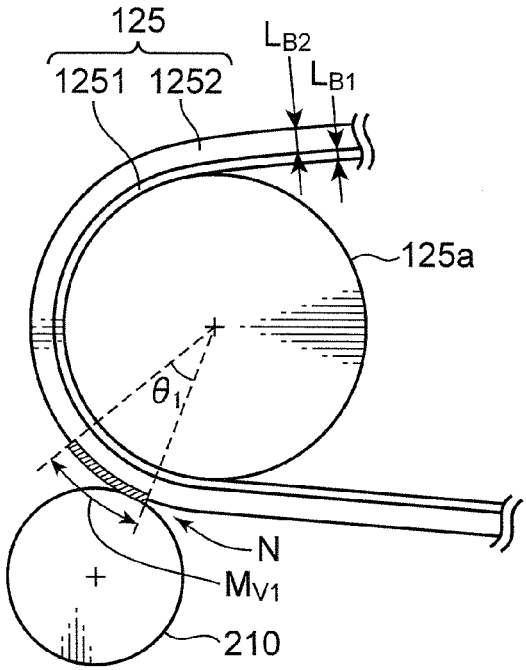
FIGS. 11A, 11B, 11C are views schematically showing a state where the intermediate transfer belt is subjected to expansion and contraction at the nip part based on pressing.
Figure 11B:
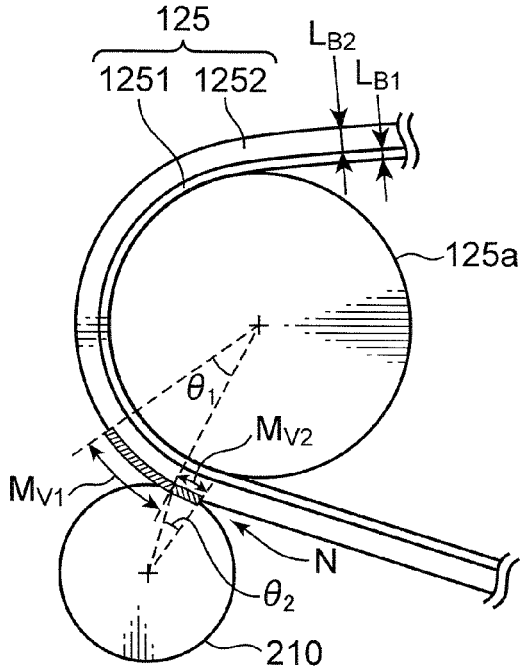
Figure 11C:
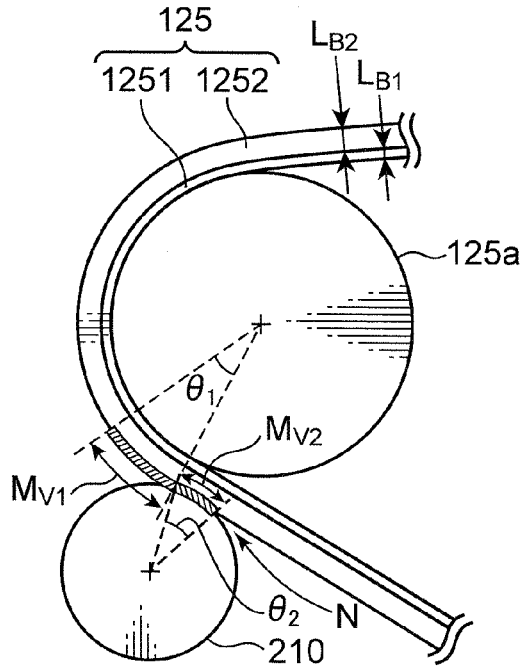

FIGS. 11A, 11B, 11C are diagrams schematically showing a state where the intermediate transfer belt 125 is subjected to expansion and contraction at the nip part N based on pressing. FIG. 11A to FIG. 11C sequentially show a state where stronger tension is applied to the intermediate transfer belt 125.

At the nip part N (area where the toner image is transferred) of FIGS. 11A, 11B, 11C shown as $Mv_1$ or/and $Mv_2$, the toner image becomes elongated at the portion that is convex in the outer circumferential direction shown in $Mv_1$, and the toner image becomes contracted at the portion that is convex in the inner circumferential direction shown in $Mv_2$. If the arrangement position of the driven roller 125*b* is moved by the movement mechanism 200 toward the inside of the foregoing intermediate transfer belt 125 (direction of approaching the driving roller 125*a*), and the tension of the intermediate transfer belt 125 is changed from a strong state to a weak state, since the state of tension of the intermediate transfer belt 125 tightly stretched across the driving roller 125*a* will weaken, at the upstream side in the traveling direction of the intermediate transfer belt 125 relative to the nip part N, the intermediate transfer belt 125 will change from the state shown in FIG. 11A to the state of sinking downward as shown in FIG. 11B. Here, since the outer circumferential surface of the intermediate transfer belt 125 will sink and contract to the inside at the nip part N as a result of being subjected to the pressure of the secondary transfer roller 210 ($Mv_2$), the toner image formed on the outer circumferential surface of the intermediate transfer belt 125 is reduced for the amount of $Mv_2$.

If the arrangement position of the driven roller 125*b* is moved with the movement mechanism 200 further toward the inside of the foregoing intermediate transfer belt 125 (direction of approaching the driving roller 125*a*) and the tension of the intermediate transfer belt 125 is changed to a further weakened state, since the state of tension of the intermediate transfer belt 125 tightly stretched across the driving roller 125*a* will further weaken, the intermediate transfer belt 125 will change from the state shown in FIG. 11B to a state of further sinking downward as shown in FIG. 11C at the upstream side in the traveling direction of the intermediate transfer belt 125 relative to the nip part N. Here, since the outer circumferential surface of the intermediate transfer belt 125 will further sink and contract to the inside at the nip part N ($Mv_2$), the toner image formed on the outer circumferential surface of the intermediate transfer belt 125 is further reduced for the amount of $Mv_2$.

Meanwhile, if the arrangement position of the driven roller 125*b* is moved toward the outside of the foregoing intermediate transfer belt 125 with the movement mechanism 200, the state of the intermediate transfer belt 125 will change from the state of FIG. 11C to FIG. 11B, FIG. 11A.

Here, if the boundary of the base layer 1251 and the elastic layer 1252 of the intermediate transfer belt 125 is to be used as the rate deciding surface, and $D_1$: Roller outer diameter (mm) of the driving roller 125*a*

$D_2$: Roller outer diameter (mm) of the secondary transfer roller 210

$L_{B1}$: Thickness (mm) of the base layer 1251

$L_{B2}$: Thickness (mm) of the elastic layer 1252

$\theta_1$: Angle (radian) formed by both ends of $Mv_1$ and the center of the driving roller 125*a*

$\theta_2$: Angle (radian) formed by both ends of $Mv_2$ and the center of the secondary transfer roller 210, lengths of $Mv_1$ and $Mv_2$ relative to the rotating direction of the intermediate transfer belt can be respectively represented with the following formulae.

$$Mv_1=\pi\times(D_1+2(L_{B1}+L_{B2}))\times\theta_1 \text{ (mm)} \quad \text{Formula (1)}$$

$$Mv_2=\pi\times D_2\times\theta_2 \text{ (mm)} \quad \text{Formula (2)}$$

Here, if the length of the rate reference surface corresponding to $Mv_1$ is $A_1$, and the length of the rate reference surface corresponding to $Mv_2$ is $A_2$, $$A_1=\pi\times(D_1+2L_{B1})\times\theta_1 \text{ (mm)} \quad \text{Formula (3)}$$

$$A_2=\pi\times(D_2+2L_{B2})\times\theta_2 \text{ (mm)} \quad \text{Formula (4)}$$

and, therefore, $Mv_1$ and $Mv_2$ can be represented as $$Mv_1=A_1+2\pi\times L_{B2}\times\theta_1 \text{ (mm)} \quad \text{Formula (5)}$$

$$Mv_2=\pi\times(D_2+2(L_{B2}-L_{B2}))\times\theta_2=A_2-2\pi\times L_{B2}\times\theta_2 \text{ (mm)} \quad \text{Formula (6).}$$

Here, if the secondary transfer magnification is $M_2$, since $$M_2=(Mv_1+Mv_2)/(A_1+A_2),$$

$$M_2=(A_1+A_2+2\pi\times L_{B2}\times(\theta_1-\theta_2))/(A_1+A_2) \quad \text{Formula (7).}$$

Specifically, if $\theta_1$ is set to be greater than $\theta_2$, the toner image on the intermediate transfer belt 125 is enlarged and secondarily transferred to the recording paper P, and if $\theta_1$ is set to be smaller than $\theta_2$, the toner image on the intermediate transfer belt 125 is reduced and secondarily transferred to the recording paper P.

Thus, as a result of the movement mechanism 200 changing the travel distance from the disposition reference position of the driven roller 125*b* and changing the tension applied to the intermediate transfer belt 125 according to the increase and decrease of contraction of the intermediate transfer belt 125, as shown in FIGS. 11A, 11B, 11C, by changing the angle of the intermediate transfer belt 125 entering the nip part N of the driving roller 125*a* and the secondary transfer roller 210 and changing the secondary transfer magnification $M_2$ by changing the foregoing $\theta_1$ and $\theta_2$, it is possible to correct the magnification deviation of the sub scanning direction (traveling direction of the intermediate transfer belt 125) which occurs pursuant to the expansion and contraction of the intermediate transfer belt 125.

Meanwhile, if the temperature of the intermediate transfer belt 125 increases, since the intermediate transfer belt 125 will expand, the toner image formed on the outer circumferential surface of the intermediate transfer belt 125 becomes elongated. Specifically, the secondary transfer magnification $M_2$ increases. Contrarily, if the temperature of the intermediate transfer belt 125 decreases, since the intermediate transfer belt 125 will contract, the toner image becomes contracted. Specifically, the secondary transfer magnification $M_2$ decreases.

As described above, for example, rubber such as chloroprene rubber and urethane rubber has a greater coefficient of thermal expansion than a resin material such as PVDF. Accordingly, in cases as with this embodiment where an elastic layer 1252 made of chloroprene rubber or urethane rubber is formed on the outer circumferential side of the intermediate transfer belt 125, for example, magnification deviation is more likely to occur in comparison to cases of configuring the intermediate transfer belt 125 only with a resin material such as PVDF.

Thus, in this embodiment, the movement mechanism control unit 312 reads the temperature of the intermediate transfer belt 125 detected with the temperature sensor 40 at prescribed sampling intervals, outputs a drive pulse number DP1 proportional to a variation $\Delta T$ of the temperature T of the intermediate transfer belt 125 detected with the temperature sensor 40, moves the arrangement position of the driven roller 125*b* by a travel distance proportional to the drive pulse number DP1, and thereby corrects the magnification deviation in the sub scanning direction that occurs pursuant to the increase and decrease of the temperature T of the intermediate transfer belt 125.

For example, in order to reduce the secondary transfer magnification $M_2$ according to the increase in the temperature T of the intermediate transfer belt 125 detected with the temperature sensor 40, the movement mechanism control unit 312 moves the driven roller 125*b* to the inward direction (direction of approaching the driving roller 125*a*) to weaken the tension of the intermediate transfer belt 125. The movement mechanism control unit 312 outputs the drive pulse number DP1 corresponding to the variation ΔT at such time to the cam drive mechanism (stepping motor) 220, and moves the driven roller 125*b* to the inward direction (direction of approaching the driving roller 125*a*).

Note that, in this embodiment, a table which associates the drive pulse number DP1 of the cam drive mechanism (stepping motor) 220 for deciding the position of the driven roller 125*b* and the variation ΔT is stored in the storage unit 313 in advance, and the movement mechanism control unit 312 reads the drive pulse number DP1 corresponding to the variation ΔT from the foregoing table. In addition, the drive pulse number DP1 takes on both positive and negative values, and the cam drive mechanism (stepping motor) 220 is able to output the drive force bi-directionally in the clockwise direction and the counterclockwise direction. Thus, in FIGS. 10A to 10C, the cam member 2022 rotates bi-directionally in the clockwise direction and the counterclockwise direction.

Moreover, if the paper thickness increases according to the type of recording paper P that is transported to the nip part N, the intermediate transfer belt 125 is pressed more in the inner circumferential direction at the nip part N due to the recording paper P. Specifically, $\theta_2$ increases and the secondary transfer magnification $M_2$ decreases.

Thus, in this embodiment, with the paper thickness of plain paper as the reference paper thickness th, the movement mechanism control unit 312 decides the paper thickness difference d1, d2, . . . , between the reference paper thickness th and each paper thickness th1, th2, . . . , of the other types of recording paper, and outputs the drive pulse number DP2 corresponding to the paper thickness difference d1, d2, . . . , moves the driven roller 125*b* from the conventional position by a travel distance according to the drive pulse number DP2, and corrects the magnification deviation of the sub scanning direction which occurs pursuant to the increase and decrease in the paper thickness of the recording paper. Specifically, the movement mechanism control unit 312 adjusts the secondary transfer magnification $M_2$ by increasing or decreasing the value of $\theta_2$ according to the variation in the paper thickness of the recording paper used for the image formation relative to the reference paper thickness th of plain paper. In this embodiment, a table which associates the paper thickness difference d1, d2, . . . , and the drive pulse number DP2 corresponding to the paper thickness difference d1, d2, . . . , is stored in the storage unit 313 in advance. The movement mechanism control unit 312 reads the drive pulse number DP2 corresponding to the paper thickness difference d1, d2, . . . , from the foregoing table. Note that if the paper thickness difference d1, d2, . . . , relative to the reference paper thickness th is less than 0, the drive pulse number DP2 of increasing the value of $\theta_2$ and decreasing the secondary transfer magnification $M_2$ is stored in the foregoing table.

Specifically, in this embodiment, the movement mechanism control unit 312 outputs a drive pulse number DP2 corresponding to the variation of $\theta_2$ which changes according to the type of recording paper P set with the input operation unit, moves the arrangement position of the driven roller 125*b* by a travel distance proportional to the drive pulse number, and thereby corrects the magnification deviation in the sub scanning direction that occurs pursuant to the difference in the type of recording paper P. Specifically, in order to reduce the value of $\theta_2$ and increase the secondary transfer magnification $M_2$ in cases where a sheet with a large paper thickness such as a cardboard is set as the recording paper with the input operation unit 35, the movement mechanism control unit 312 outputs the drive pulse number (drive pulse number which decreases the value of $\theta_2$ and increases the secondary transfer magnification $M_2$) DP2 corresponding to the variation of $\theta_2$ which occurs due to the difference in paper thickness between the recording paper and plain paper to the cam drive mechanism (stepping motor) 220, and moves the driven roller 125*b* in the foregoing outward direction (direction of being separated from the driving roller 125*a*).

Storing a table which associates the drive pulse number DP2 and the variation of $\theta_2$ in advance in the storage unit 313, the movement mechanism control unit 312 reading the drive pulse number DP2 corresponding to the variation ΔT of $\theta_2$ from the foregoing table, and the drive pulse number DP2 taking on both positive and negative values are the same as the case of the drive pulse number DP1 that is output by the movement mechanism control unit 312 upon correcting the magnification deviation in the sub scanning direction that occurs pursuant to the increase and decrease in the temperature T of the intermediate transfer belt 125.

In this embodiment, the movement mechanism control unit 312 outputs the drive pulse number (DP1+DP2) obtained by adding the drive pulse number DP2 to the drive pulse number DP1 to the cam drive mechanism (stepping motor) 220, and thereby moves the driven roller 125*b*.

The control of the movement mechanism control unit deciding the drive pulse number of the cam drive mechanism (stepping motor) 220 according to the internal temperature of the image forming apparatus detected with the temperature sensor 40 and the type of recording paper P set with the input operation unit 35, and causing the movement mechanism 200 to move the driven roller 125*b* is now explained with reference to foregoing FIG. 6.

When the image formation operation by the image forming unit 12 is started, the movement mechanism control unit 312 reads the temperature T of the intermediate transfer belt 125 detected with the temperature sensor 40 at prescribed sampling intervals (step S1), and calculates the variation ΔT of the temperature T of the intermediate transfer belt 125 in the sampling intervals (step S2). Subsequently, the movement mechanism control unit 312 reads the drive pulse number DP1 corresponding to the variation ΔT from the table stored in the storage unit 313 (step S3).

If the recording paper P set with the input operation unit 35 is plain paper (YES at step S4), the movement mechanism control unit 312 outputs the read drive pulse number DP1 to the cam drive mechanism (stepping motor) 220 since there is no variation in the paper thickness relative to the reference paper thickness th (step S5). Meanwhile, if the recording paper P set with the input operation unit 35 is not plain paper (NO at step S4), the movement mechanism control unit 312 reads the drive pulse number DP2 corresponding to the type of recording paper P from the table stored in the storage unit 313 (step S6), and outputs the drive pulse number (DP1+DP2) in which DP2 is added to DP1 to the cam drive mechanism (stepping motor) 220 (step S7). Consequently, the driven roller 125*b* moves by a travel distance proportional to the drive pulse number (DP1+DP2), and the magnification deviation in the sub scanning direction which occurs pursuant to the increase and decrease in the temperature T of the intermediate transfer belt 125 and the difference in the type of recording paper P is thereby corrected.

Note that it is also possible to adopt a mode where the movement mechanism control unit 312 decides the drive pulse number to be output only with respect to one of the variation ΔT of the temperature T of the intermediate transfer belt 125 detected with the temperature sensor 40, and the type of recording paper P set with the input operation unit.

According to the image forming apparatus 1 according to the third embodiment explained above, the driven roller 125*b* moves only in the travel distance proportional to the drive pulse value (DP1+DP2) and changes the tension of the intermediate transfer belt 125, and the magnification deviation in the sub scanning direction which occurs due to the increase and decrease in the intermediate transfer belt temperature T and the difference in the type (paper thickness) of the recording paper P is thereby corrected. Thus, since it is possible to correct the magnification deviation in the sub scanning direction, without deteriorating the productivity, in an image forming apparatus which performs image formation on recording paper based on a secondary transfer method using an intermediate transfer belt 125, it is possible to correct the magnification deviation in the sub scanning direction upon image information to the recording paper P without causing deterioration in the productivity caused by the deterioration in the printing rate.

The image forming apparatus 1 according to the third embodiment of the present invention was explained above, but such embodiment is merely an example. Specifically, the present invention is not limited to the foregoing embodiment, and may be variously modified and improved to the extent that it does not deviate from the gist thereof, and, for example, the present invention may take on the following modified embodiments.

For example, although the foregoing embodiment illustrated an example where the driven roller 125*b* functions as the tension roller referred to in the claims and the arrangement position of the driven roller 125*b* is moved by the movement mechanism 200, the foregoing movement mechanism 200 may also be provided on another roller across which the intermediate transfer belt 125 is tightly stretched. For example, a configuration may be adopted where the foregoing movement mechanism 200 is provided on the tension applying roller 125*c* shown in FIG. 1 (this movement mechanism 200 moves the tension applying roller 125*c* toward the inward and outward directions of the revolving line of the intermediate transfer belt 125), and the arrangement position of the tension applying roller 125*c* is moved by the movement mechanism control unit 312 and the movement mechanism 200 as with the movement control of the arrangement position of the driven roller 125*b* described above. In the foregoing case, the tension applying roller 125*c* is an example of the tension roller referred to in the claims.

Moreover, since the rubber such as chloroprene rubber and urethane rubber used as the elastic layer 1252 expands due to moisture absorption even though its influence is small in comparison to the expansion and contraction caused by a temperature change, it is also possible to provide a humidity sensor in the image forming apparatus 1 and cause the movement mechanism control unit 312 to change the arrangement position of the driven roller 125*b* according to the variation in the humidity detected with the humidity sensor.

The image forming apparatus 1 according to the fourth embodiment of the present invention is now explained with reference to foregoing FIG. 1. In the fourth embodiment, the image forming apparatus 1 does not comprise a mechanism for moving the secondary transfer roller 210 as with the first embodiment, and comprises a mechanism for moving the backup roller 125*d*. Note that the fourth embodiment is configured the same as the first embodiment with respect to the constituent elements which are not specifically referred to.

In the fourth embodiment, a backup roller (an example of the correction roller referred to in the claims) 125*d* for pressing the intermediate transfer belt 125 toward the outward direction (downward in FIG. 1) of the revolving line thereof is provided as an requisite element to the nip part N of the driving roller 125*a* and the secondary transfer roller 210 at the upstream side in the traveling direction of the intermediate transfer belt 125. This backup roller 125*d* corrects the approach angle of the intermediate transfer belt 125 to the nip part N by pressing the intermediate transfer belt 125 in the outward direction of the foregoing revolving line. The backup roller 125*d* presses the intermediate transfer belt 125 to cause the intermediate transfer belt 125 to approach the side of the secondary transfer roller 210 at the nip part N in order to increase the contact area of the secondary transfer roller 210 and the outer circumferential surface of the intermediate transfer belt 125 (surface on which the toner image is formed with the development unit 12) at the nip part N, and thereby improve the certainty of the secondary transfer of the foregoing toner image to the recording paper P that is transported to the nip part N.

Note that the backup roller 125*d* is biased movably toward the inward and outward directions of the revolving line of the intermediate transfer belt 125 tightly stretched across the driving roller 125*a* and the driven roller 125*b* and which revolves in an endless motion based on the movement mechanism 200 described later. As a result of the position of the backup roller 125*d* moving in the direction heading toward the inward and outward directions of the intermediate transfer belt 125 by the movement mechanism 200, the angle of the intermediate transfer belt 125 to enter the nip part N of the driving roller 125*a* and the secondary transfer roller 210 is changed, and, based on the change of the belt angle, the tightly stretched state of the intermediate transfer belt 125 relative to the driving roller 125*a* is changed. As a result of the change in the tightly stretched state of the intermediate transfer belt 125, the approach angle of the intermediate transfer belt 125 to enter the nip part N of the driving roller 125*a* and the secondary transfer roller 210 is made to differ, and the pressed state of the intermediate transfer belt 125 by the secondary transfer roller 210 as a result of pressing the outer circumferential surface of the intermediate transfer belt 125 toward the driving roller 125*a* is changed.

Note that details regarding the movement of the backup roller 125*d* by the movement mechanism 200 and the change in the pressed state of the intermediate transfer belt 125 pressed by the driving roller 125*a* and the secondary transfer roller 210 pursuant to the foregoing movement will be described later.

Moreover, the electrical configuration of the image forming apparatus 1 according to the fourth embodiment is basically the same as the configuration shown in foregoing FIG. 3. However, in the fourth embodiment, the movement mechanism 200 is a mechanism for moving the position of the backup roller 125*d* in a direction heading toward the inside and outside of the intermediate transfer belt 125. The movement mechanism 200 comprises, as described later, a tension spring 201*a*, and a positioning mechanism 202. The movement mechanism control unit 312 controls the operation of the positioning mechanism 202.

The movement mechanism control unit 312 controls the travel distance of the backup roller 125*d* by outputting, to the cam drive mechanism (stepping motor) 220 of the movement mechanism 200, a drive pulse of the cam drive mechanism (stepping motor) 220 according to the amount of temperature change calculated based on the temperature of the intermediate transfer belt 125 detected with the temperature sensor 40, or the drive pulse of the cam drive mechanism (stepping motor) 220 according to the variation in the paper thickness (for example, paper thickness variation based on the type of recording paper when the paper thickness of plain paper is used as the reference) corresponding to the type of recording paper P set with the input operation unit 35, or a drive pulse obtained by adding the foregoing drive pulses.

Figure 12A:
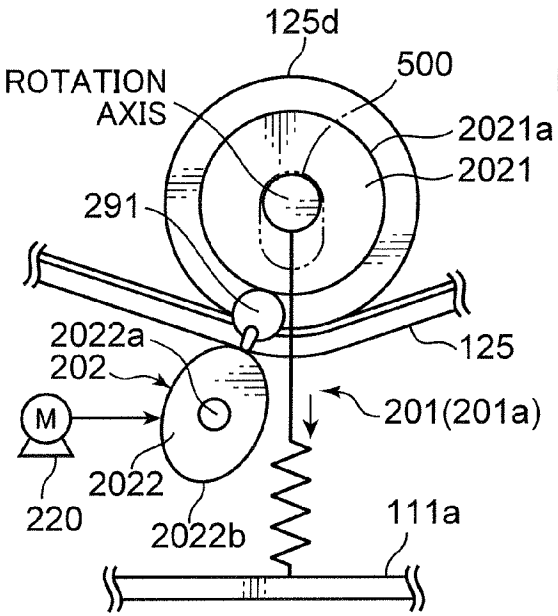
FIGS. 12A, 12B, 12C are side views showing an example of the movement mechanism according to the fourth embodiment.
Figure 12B:
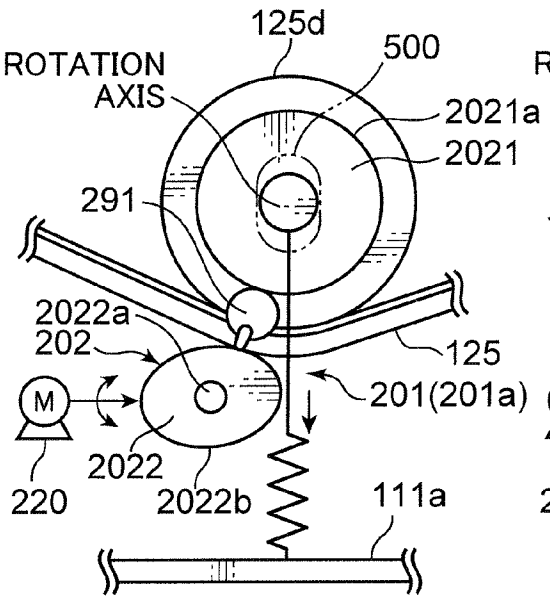
Figure 12C:
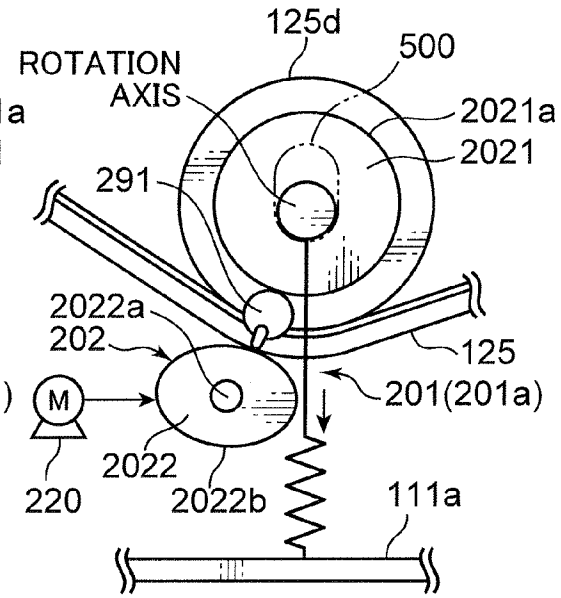

FIGS. 12A, 12B, 12C are side views showing an example of the movement mechanism 200.

The movement mechanism 200 includes a biasing mechanism 201 and a positioning mechanism 202. The biasing mechanism 201 comprises a tension spring 201*a* for connecting the rotation axis of the backup roller 125*d*, and an apparatus body inner wall part 111*a* positioned outside the revolving line of the intermediate transfer belt 125 tightly stretched across the driving roller 125*a* and the driven roller 125*b* and which revolves in endless motion. The tension spring 201*a* is used to bias the backup roller 125*d* toward the outward direction (arrow direction in FIGS. 12A, 12B, 12C) of the revolving line of the intermediate transfer belt 125.

The positioning mechanism 202 comprises a guide member 2021, a cam member 2022, and a cam drive mechanism 220. The guide member 2021 is concentric with the rotation axis of the backup roller 125*d* and configured to co-rotate with the rotation axis, and is of a circular shape as shown in FIGS. 12A, 12B, 12C. The cam member 2022 is configured to be freely rotatable in a state of being in contact with the guide member 2021. The cam drive mechanism 220 is configured from a stepping motor or the like, and rotates the cam member 2022 around the rotation axis of the cam member 2022.

The cam member 2022 comprises a rotation axis 2022*a* rotatably fixed to the case of the lower body 111, is rotatably driven by the rotating drive force from the cam drive mechanism 220, and rotates at an angle of rotation according to the drive pulse number of the cam drive mechanism (stepping motor) 220 around the rotation axis 2022*a*.

The roller 291 slidingly contacts the outer circumferential surface 2021*a* of the guide member 2021 of the backup roller 125*d*, and is configured to move along the inter-axis direction of the rotation axis of the backup roller 125*d* and the rotation axis of the cam member 2022.

Although the backup roller 125*d* is biased in the outward direction (downward direction in this embodiment shown in FIG. 1) of the foregoing intermediate transfer belt 125 by the tension spring 201*a*, movement of the backup roller 125*d* is stopped against the biasing force of the tension spring 201*a* at the point where the roller 291 comes in contact with the circumferential surface 2022*b* of the cam member 2022. Thus, when the cam member 2022 rotates based on the rotating drive force from the cam drive mechanism 220, the position of the backup roller 125*d* heading toward the outward direction of the foregoing intermediate transfer belt 125 moves in the direction of moving toward and away from the shaft center of the backup roller 125*d* (vertical direction in FIG. 12A, 12B, 12C, and FIG. 1) in the inter-axis direction of the rotation axis 2022*a* of the cam member 2022 and the rotation axis of the backup roller 125*d*.

FIG. 12B shows a state where the arrangement position of the backup roller 125*d* is in the reference position, FIG. 12A shows a state where the arrangement position of the backup roller 125*d* moved to the uppermost position, and FIG. 12C shows a state where the arrangement position of the backup roller 125*d* moved to the lowermost position. As a result of selectively turning the cam member 2022 from the arrangement position of the backup roller 125*d* in the reference position shown in FIG. 12B (position where the travel distance of the cam member 2022 moving the backup roller 125*d* is smallest) to either arrow direction shown in FIG. 12B at the angle of rotation according to the drive pulse number of the cam drive mechanism (stepping motor) 220, the arrangement position of the backup roller 125*d* can thereby be controlled.

Specifically, the cam member 2022 positions the position of the backup roller 125*d* in the outward direction against the bias of the tension spring 201*a* regarding the backup roller 125*d* that is biased toward the outward direction of the foregoing intermediate transfer belt 125 by the tension spring 201*a*.

If the travel distance of the backup roller 125*d* heading toward the outward direction of the foregoing intermediate transfer belt 125 increases, at the nip part N of the driving roller 125*a* and the secondary transfer roller 210 positioned more downstream than the backup roller 125*d* in the traveling direction of the intermediate transfer belt 125, the intermediate transfer belt 125 that is tightly stretched across the driving roller 125*a* is separated from the driving roller 125*a* at the point of entering the nip part N, and approaches the secondary transfer roller 210 disposed lower than the driving roller 125*a* in this embodiment. Specifically, the approach angle of the intermediate transfer belt 125 to the nip part N relative to the tangent of the circumferential surface of the driving roller 125*a* will increase. Contrarily, if the travel distance of the backup roller 125*d* heading toward the outward direction of the foregoing intermediate transfer belt 125 decreases, the intermediate transfer belt 125 that is tightly stretched across the driving roller 125*a* will approach the driving roller 125*a* and be separated from the secondary transfer roller 210 at the point of entering the nip part N. Specifically, the approach angle of the intermediate transfer belt 125 to the nip part N relative to the tangent of the circumferential surface of the driving roller 125*a* will decrease.

Consequently, the approach angle of the intermediate transfer belt 125 to enter the nip part N of the driving roller 125*a* and the secondary transfer roller 210 can be adjusted by drive-controlling the positioning mechanism 202. Note that, for example, preferably, the portion that is used for the control in the circumferential surface of the cam member 2022 has a cam profile in which the cam diagram is a straight line, and the drive pulse number of the cam drive mechanism 220 and the travel distance of the backup roller 125*d* are made to be proportional from the perspective of positioning control of the backup roller 125*d* and approach angle control of the intermediate transfer belt 125 to the nip part N according to the expansion and contraction of the intermediate transfer belt 125. The cam member 2022 may also be configured from an eccentric cam if it is able to obtain the same effect as the foregoing cam member 2022. Moreover, the configuration may also be such that the roller 291 is omitted and the circumferential surface of the cam member 2022 and the guide member 2021 come into direct sliding contact.

Moreover, the bearing 500 of the rotation axis of the backup roller 125*d* is formed on the case of the lower body 111, and the shape of the bearing 500 is formed in accordance with the travel distance of the backup roller 125*d* which moves pursuant to the rotation of the cam member 2022.

Note that the configuration of the movement mechanism 200 which uses the cam member 2022 as described above is merely an example, and the movement mechanism 200 may also adopt another configuration of moving the arrangement position of the backup roller 125*d* in a direction of heading toward the inside and outside of the foregoing intermediate transfer belt 125.

The state where the intermediate transfer belt 125 is subjected to expansion and contraction at the nip part N in the fourth embodiment is now explained with reference to foregoing FIG. 11.

At the nip part N (area where the toner image is transferred) of FIGS. 11A, 11B, 11C shown as $M_{v1}$ or/and $M_{v2}$, the toner image becomes elongated at the portion that is convex in the outer circumferential direction shown in $M_{v1}$, and the toner image becomes contracted at the portion that is convex in the inner circumferential direction shown in $M_{v2}$. If the arrangement position of the backup roller 125*d* is moved by the movement mechanism 200 toward the outside of the revolving line of the foregoing intermediate transfer belt 125, and the approach angle of the intermediate transfer belt 125 to the nip part N is changed from a state where the approach angle of the intermediate transfer belt to the nip part N relative to the tangent of the circumferential surface of the driving roller 125*a* is small to a state where the approach angle is great, the intermediate transfer belt 125 tightly stretched across the driving roller 125*a* will change from the state shown in FIG. 11A to the state of sinking downward as shown in FIG. 11B at the upstream side in the traveling direction of the intermediate transfer belt 125 relative to the nip part N. Here, since the outer circumferential surface of the intermediate transfer belt 125 will sink and contract to the inside at the nip part N as a result of being subjected to the pressure of the secondary transfer roller 210 ($M_{v2}$), the toner image formed on the outer circumferential surface of the intermediate transfer belt 125 is reduced for the amount of $M_{v2}$.

If the arrangement position of the backup roller 125*d* is moved with the movement mechanism 200 toward the outside of the revolving line foregoing intermediate transfer belt 125, the intermediate transfer belt 125 will change from the state shown in FIG. 11B to a state of further sinking downward as shown in FIG. 11C at the upstream side in the traveling direction of the intermediate transfer belt 125 relative to the nip part N. Here, since the outer circumferential surface of the intermediate transfer belt 125 will further sink and contract to the inside at the nip part N ($M_{v2}$), the toner image formed on the outer circumferential surface of the intermediate transfer belt 125 is further reduced for the amount of $M_{v2}$.

Meanwhile, if the arrangement position of the backup roller 125*d* is moved toward the inside of the revolving line of the foregoing intermediate transfer belt 125 with the movement mechanism 200, the state of the intermediate transfer belt 125 will change from the state of FIG. 11C to FIG. 11B, FIG. 11A.

Here, if the boundary of the base layer 1251 and the elastic layer 1252 of the intermediate transfer belt 125 is to be used as the rate deciding surface, and $D_1$: Roller outer diameter (mm) of the driving roller 125*a*

$D_2$: Roller outer diameter (mm) of the secondary transfer roller 210

$L_{B1}$: Thickness (mm) of the base layer 1251

$L_{B2}$: Thickness (mm) of the elastic layer 1252

$\theta_1$: Angle (radian) formed by both ends of $M_{v1}$ and the center of the driving roller 125*a*

$\theta_2$: Angle (radian) formed by both ends of $M_{v2}$ and the center of the secondary transfer roller 210, lengths of $M_{v1}$ and $M_{v2}$ relative to the rotating direction of the intermediate transfer belt can be respectively represented with the following formulae.

$$M_{v1}=\pi\times(D_1+2(L_{B1}+L_{B2}))\times\theta_1 \text{ (mm)} \quad \text{Formula (1)}$$

$$M_{v2}=\pi\times D_2\times\theta_2 \text{ (mm)} \quad \text{Formula (2)}$$

Here, if the length of the rate reference surface corresponding to $M_{v1}$ is $A_1$, and the length of the rate reference surface corresponding to $M_{v2}$ is $A_2$, $$A_1=\pi\times(D_1+2L_{B1})\times\theta_1 \text{ (mm)} \quad \text{Formula (3)}$$

$$A_2=\pi\times(D_2+2L_{B2})\times\theta_2 \text{ (mm)} \quad \text{Formula (4)}$$

and, therefore, $M_{v1}$ and $M_{v2}$ can be represented as $$M_{v1}=A_1+2\pi\times L_{B2}\times\theta_1 \text{ (mm)} \quad \text{Formula (5)}$$

$$M_{v2}=\pi\times(D_2+2(L_{B2}-L_{B2}))\times\theta_2=A_2-2\pi\times L_{B2}\times\theta_2 \text{ (mm)} \quad \text{Formula (6).}$$

Here, if the secondary transfer magnification is $M_2$, since $$M_2=(M_{v1}+M_{v2})/(A_1+A_2),$$

$$M_2=(A_1+A_2+2\pi\times L_{B2}\times(\theta_1-\theta_2))/(A_1+A_2) \quad \text{Formula (7).}$$

Specifically, if $\theta_1$ is set to be greater than $\theta_2$, the toner image on the intermediate transfer belt 125 is enlarged and secondarily transferred to the recording paper P, and if $\theta_1$ is set to be smaller than $\theta_2$, the toner image on the intermediate transfer belt 125 is reduced and secondarily transferred to the recording paper P.

Thus, as a result of the movement mechanism 200 changing the travel distance from the disposition reference position of the backup roller 125*d* and changing the approach angle of the intermediate transfer belt 125 to the nip part N according to the increase and decrease of contraction of the intermediate transfer belt 125, as shown in FIGS. 11A, 11B, 11C, by changing the angle of the intermediate transfer belt 125 entering the nip part N of the driving roller 125*a* and the secondary transfer roller 210 and changing the secondary transfer magnification $M_2$ by changing the foregoing $\theta_1$ and $\theta_2$, it is possible to correct the magnification deviation of the sub scanning direction (traveling direction of the intermediate transfer belt 125) which occurs pursuant to the expansion and contraction of the intermediate transfer belt 125.

Meanwhile, if the temperature of the intermediate transfer belt 125 increases, since the intermediate transfer belt 125 will expand, the toner image formed on the outer circumferential surface of the intermediate transfer belt 125 becomes elongated. Specifically, the secondary transfer magnification $M_2$ increases. Contrarily, if the temperature of the intermediate transfer belt 125 decreases, since the intermediate transfer belt 125 will contract, the toner image becomes contracted. Specifically, the secondary transfer magnification $M_2$ decreases.

For example, rubber such as chloroprene rubber and urethane rubber has a greater coefficient of thermal expansion than a resin material such as PVDF. Accordingly, in cases as with this embodiment where an elastic layer 1252 made of chloroprene rubber or urethane rubber is formed on the outer circumferential side of the intermediate transfer belt 125, for example, magnification deviation is more likely to occur in comparison to cases of configuring the intermediate transfer belt 125 only with a resin material such as PVDF.

Thus, in this embodiment, the movement mechanism control unit 312 reads the temperature of the intermediate transfer belt 125 detected with the temperature sensor 40 at prescribed sampling intervals, outputs a drive pulse number DP1 proportional to a variation $\Delta T$ of the temperature T of the intermediate transfer belt 125 detected with the temperature sensor 40, moves the arrangement position of the backup roller 125*d* by a travel distance proportional to the drive pulse number DP1, and thereby corrects the magnification deviation in the sub scanning direction that occurs pursuant to the increase and decrease of the temperature T of the intermediate transfer belt 125.

For example, in order to reduce the secondary transfer magnification $M_2$ according to the increase in the temperature T of the intermediate transfer belt 125 detected with the temperature sensor 40, the movement mechanism control unit 312 moves the backup roller 125*d* to the outward direction to increase the approach angle of the intermediate transfer belt 125 relative to the tangent of the driving roller 125*a* at the nip part N. The movement mechanism control unit 312 outputs the drive pulse number DP1 corresponding to the variation ΔT at such time to the cam drive mechanism (stepping motor) 220, and moves the backup roller 125*d* to the foregoing outward direction.

Note that, in this embodiment, a table which associates the drive pulse number DP1 of the cam drive mechanism (stepping motor) 220 for deciding the position of the backup roller 125*d* and the variation ΔT is stored in the storage unit 313 in advance, and the movement mechanism control unit 312 reads the drive pulse number DP1 corresponding to the variation ΔT from the foregoing table. In addition, the drive pulse number DP1 takes on both positive and negative values, and the cam drive mechanism (stepping motor) 220 is able to output the drive force bi-directionally in the clockwise direction and the counterclockwise direction. Thus, in FIGS. 11A, 11B, 11C, the cam member 2022 rotates bi-directionally in the clockwise direction and the counterclockwise direction.

Moreover, if the paper thickness increases according to the type of recording paper P that is transported to the nip part N, the intermediate transfer belt 125 is pressed more in the inner circumferential direction at the nip part N due to the recording paper P. Specifically, $\theta_2$ increases and the secondary transfer magnification $M_2$ decreases.

Thus, in this embodiment, with the paper thickness of plain paper as the reference paper thickness th, the movement mechanism control unit 312 decides the paper thickness difference d1, d2, . . . , between the reference paper thickness th and each paper thickness th1, th2, . . . , of the other types of recording paper, and outputs the drive pulse number DP2 corresponding to the paper thickness difference d1, d2, . . . , moves the backup roller 125*d* from the conventional position by a travel distance according to the drive pulse number DP2, and corrects the magnification deviation of the sub scanning direction which occurs pursuant to the increase and decrease in the paper thickness of the recording paper. Specifically, the movement mechanism control unit 312 adjusts the secondary transfer magnification $M_2$ by increasing or decreasing the value of $\theta_2$ according to the variation in the paper thickness of the recording paper used for the image formation relative to the reference paper thickness th of plain paper. In this embodiment, a table which associates the paper thickness difference d1, d2, . . . , and the drive pulse number DP2 corresponding to the paper thickness difference d1, d2, . . . , is stored in the storage unit 313 in advance. The movement mechanism control unit 312 reads the drive pulse number DP2 corresponding to the paper thickness difference d1, d2, . . . , from the foregoing table. Note that if the paper thickness difference d1, d2, . . . , relative to the reference paper thickness th is less than 0, the drive pulse number DP2 of increasing the value of $\theta_2$ and decreasing the secondary transfer magnification $M_2$ is stored in the foregoing table.

Specifically, in this embodiment, the movement mechanism control unit 312 outputs a drive pulse number DP2 corresponding to the variation of $\theta_2$ which changes according to the type of recording paper P set with the input operation unit, moves the arrangement position of the backup roller 125*d* by a travel distance proportional to the drive pulse number, and thereby corrects the magnification deviation in the sub scanning direction that occurs pursuant to the difference in the type of recording paper P. Specifically, in order to reduce the value of $\theta_2$ and increase the secondary transfer magnification $M_2$ in cases where a sheet with a large paper thickness such as a cardboard is set as the recording paper with the input operation unit 35, the movement mechanism control unit 312 outputs the drive pulse number DP2 corresponding to the variation of $\theta_2$ which occurs due to the difference in paper thickness between the recording paper and plain paper to the cam drive mechanism (stepping motor) 220, and moves the backup roller 125*d* in the foregoing inward direction of the revolving line of the intermediate transfer belt 125.

Storing a table which associates the drive pulse number DP2 and the variation of $\theta_2$ in advance in the storage unit 313, the movement mechanism control unit 312 reading the drive pulse number DP2 corresponding to the variation ΔT of $\theta_2$ from the foregoing table, and the drive pulse number DP2 taking on both positive and negative values are the same as the case of the drive pulse number DP1 that is output by the movement mechanism control unit 312 upon correcting the magnification deviation in the sub scanning direction that occurs pursuant to the increase and decrease in the temperature T of the intermediate transfer belt 125.

In this embodiment, the movement mechanism control unit 312 outputs the drive pulse number (DP1+DP2) obtained by adding the drive pulse number DP2 to the drive pulse number DP1 to the cam drive mechanism (stepping motor) 220, and thereby moves the backup roller 125*d*.

The control of the movement mechanism control unit deciding the drive pulse number of the cam drive mechanism (stepping motor) 220 according to the internal temperature of the image forming apparatus detected with the temperature sensor 40 and the type of recording paper P set with the input operation unit 35, and causing the movement mechanism 200 to move the backup roller 125*d* is now explained with reference to foregoing FIG. 6.

When the image formation operation by the image forming unit 12 is started, the movement mechanism control unit 312 reads the temperature T of the intermediate transfer belt 125 detected with the temperature sensor 40 at prescribed sampling intervals (step S1), and calculates the variation ΔT of the temperature T of the intermediate transfer belt 125 in the sampling intervals (step S2). Subsequently, the movement mechanism control unit 312 reads the drive pulse number DP1 corresponding to the variation ΔT from the table stored in the storage unit 313 (step S3).

If the recording paper P set with the input operation unit 35 is plain paper (YES at step S4), the movement mechanism control unit 312 outputs the read drive pulse number DP1 to the cam drive mechanism (stepping motor) 220 since there is no variation in the paper thickness relative to the reference paper thickness th (step S5). Meanwhile, if the recording paper P set with the input operation unit 35 is not plain paper (NO at step S4), the movement mechanism control unit 312 reads the drive pulse number DP2 corresponding to the type of recording paper P from the table stored in the storage unit 313 (step S6), and outputs the drive pulse number (DP1+DP2) in which DP2 is added to DP1 to the cam drive mechanism (stepping motor) 220 (step S7). Consequently, the backup roller 125*d* moves by a travel distance proportional to the drive pulse number (DP1+DP2), and the magnification deviation in the sub scanning direction which occurs pursuant to the increase and decrease in the temperature T of the intermediate transfer belt 125 and the difference in the type of recording paper P is thereby corrected.

Note that it is also possible to adopt a mode where the movement mechanism control unit 312 decides the drive pulse number to be output only with respect to one of the variation ΔT of the temperature T of the intermediate transfer belt 125 detected with the temperature sensor 40, and the type of recording paper P set with the input operation unit.

According to the image forming apparatus 1 according to the foregoing embodiment explained above, the backup roller 125*d* moves only in the travel distance proportional to the drive pulse value (DP1+DP2) from the original position and changes the foregoing approach angle to the nip part N, and the magnification deviation in the sub scanning direction which occurs due to the increase and decrease in the belt temperature T and the difference in the type of the recording paper P is thereby corrected. Thus, since it is possible to correct the magnification deviation in the sub scanning direction, without deteriorating the productivity, in an image forming apparatus which performs image formation on recording paper based on a secondary transfer method using an intermediate transfer belt 125, it is possible to correct the magnification deviation in the sub scanning direction upon image information to the recording paper P without causing deterioration in the productivity caused by the deterioration in the printing rate.

Specifically, if the intermediate transfer belt 125 sags to the outer circumferential side at the foregoing nip part N, the outer circumferential surface of the intermediate transfer belt 125 formed with the toner image will be stretched, and the toner image will also be stretched. Meanwhile, if the intermediate transfer belt 125 sags to the inner circumferential side at the nip part N, the outer circumferential surface of the intermediate transfer belt 125 formed with the toner image will shrink, and the toner image will also shrink. In this embodiment, as a result of changing the approach angle of the intermediate transfer belt 125 to the foregoing nip part N based on the travel distance control of the arrangement position of the foregoing backup roller 125*d* (correction roller) by the movement mechanism, it is possible to change the pressed state of the intermediate transfer belt 125 by the secondary transfer opposing roller 125*a* and the secondary transfer roller 210. Thus, as a result of the movement mechanism control unit 312 controlling the travel distance of the arrangement position of the foregoing backup roller 125*d* by the movement mechanism 200 according to the expansion and contraction of the intermediate transfer belt 125 in the endless motion direction (sub scanning direction upon image formation) of the intermediate transfer belt 125 which occurs due changes in the peripheral environment and the like, the amount of sagging of the foregoing intermediate transfer belt 125 can be made to correspond to the amount of expansion and contraction, and the magnification deviation in the sub scanning direction which occurs upon image formation to recording paper can thereby be corrected.

The image forming apparatus 1 according to the fourth embodiment of the present invention was explained above, but the fourth embodiment is merely an example. Specifically, the present invention is not limited to the foregoing embodiment, and may be variously modified and improved to the extent that it does not deviate from the gist thereof.

For example, although the foregoing embodiment illustrated an example where the backup roller 125*d* functions as the correction roller referred to in the claims and the arrangement position of the backup roller 125*d* is moved by the movement mechanism 200, a separate roller disposed on the upstream side in the traveling direction of the intermediate transfer belt 125 relative to the foregoing nip part N and which biases the intermediate transfer belt 125 toward the outward direction (downward in FIG. 1) of its revolving line as shown in FIG. 1 may be used as the correction roller, and the arrangement position of the foregoing roller may be moved by the movement mechanism control unit 312 and the movement mechanism 200 as with the movement control of the arrangement position of the backup roller 125*d* described above.

Moreover, since the rubber such as chloroprene rubber and urethane rubber used as the elastic layer 1252 expands due to moisture absorption even though its influence is small in comparison to the expansion and contraction caused by a temperature change, it is also possible to provide a humidity sensor in the image forming apparatus 1 and cause the movement mechanism control unit 312 to change the arrangement position of the backup roller 125*d* according to the variation in the humidity detected with the humidity sensor.

Figure 13:
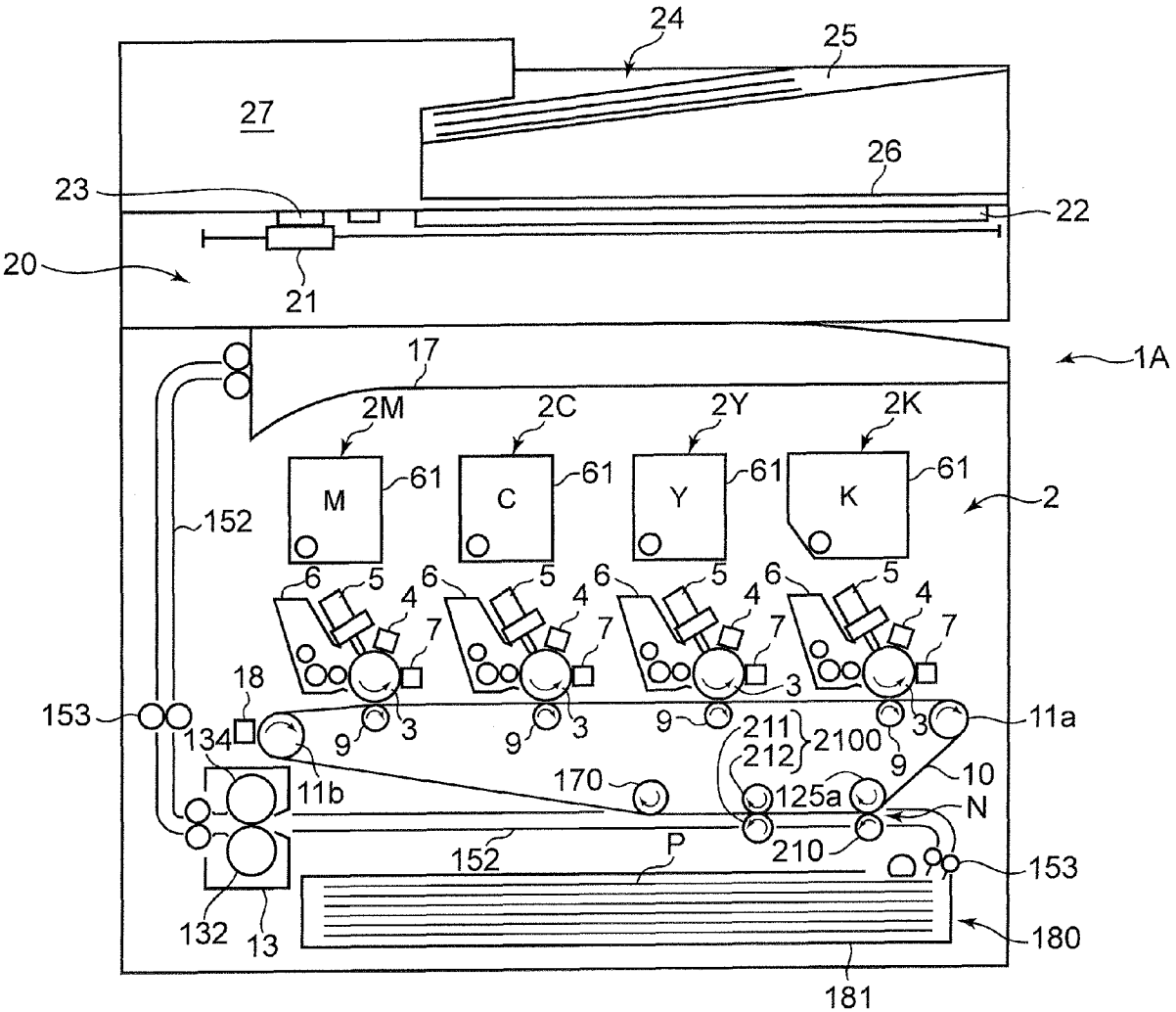
FIG. 13 is a front cross section showing the structure of the image forming apparatus.

The image forming apparatus 1A as an example of the image forming apparatus according to the fifth embodiment of the present invention is now explained with reference to the drawings. FIG. 13 is a front cross section showing the structure of the image forming apparatus 1A.

Based on the control of the movement mechanism control unit 312, the movement mechanism 200 according to the fifth embodiment moves, in the inner circumferential direction and the outer circumferential direction of the intermediate transfer belt 10, a movable roller pair 2100 which sandwiches the intermediate transfer belt 10 at a portion where it is tightly stretched across the sheet transport path 152 in parallel with a parallel roller 170, which tightly stretches the intermediate transfer belt 10 in parallel with the sheet transport path 152 in the sheet transport path 152 together with the driving roller 125*a*, and moves the intermediate transfer belt 10 bi-directionally in the inner circumferential direction and the outer circumferential direction. Consequently, the movement mechanism 200 changes the pressed state of the intermediate transfer belt 10 by the secondary transfer roller 210 at the nip part N of the driving roller 125*a* and the secondary transfer roller 210.

As shown in FIG. 13, the image forming apparatus 1A internally comprises an image forming unit 2. The image forming unit 2 forms (prints) a color image on the recording paper P.

The image forming unit 2 comprises development units 2M, 2C, 2Y, 2K arranged internally based on the respective colors of magenta (M), cyan (C), yellow (Y) and black (K), an intermediate transfer belt 10 which is tightly stretched across a plurality of rollers such as a driving roller 11*a* and a secondary transfer opposing roller 125*a* so as to be able to move endlessly in a sub scanning direction upon image formation, a secondary transfer roller 210 which comes into contact with the outer circumferential surface of the intermediate transfer belt 10 at a portion where the intermediate transfer belt 10 is tightly stretched across the secondary transfer opposing roller 125*a* and which transfers the toner image on the intermediate transfer belt 10 to the recording paper P, and a belt cleaning device 18.

The development units 2M, 2C, 2Y and 2K comprise a photoreceptor drum 3 made of amorphous silicon or the like, and a charging device 4, an exposure device 5, a development device 6, an intermediate transfer roller 9 and a drum cleaning device 7 disposed around the photoreceptor drum 3, and forms a toner image according to the image data on the circumferential surface of the photoreceptor drum 3.

The charging device 4 uniformly charges the circumferential surface of the photoreceptor drum 3. The exposure device 5 irradiates a laser beam created based on the image data send from the image memory 33 (refer to FIG. 3) described later onto the circumferential surface of the charged photoreceptor drum 3, and forms an electrostatic latent image on the circumferential surface of the photoreceptor drum 3. The development device 6 affixes the toner supplied from the toner supply part to the electrostatic latent image formed on the photoreceptor drum 3, and actualizes the electrostatic latent image as a toner image. The drum cleaning device 7 cleans the toner remaining on the circumferential surface of the photoreceptor drum 3 after the completion of the primary transfer of the toner image to the intermediate transfer belt 10 described later.

An intermediate transfer belt 10 to which the toner image actualized on the circumferential surface of the photoreceptor drum 3 is intermediately transferred (primarily transferred) is disposed below the development units 2M to 2K. In a state of being pressed to the photoreceptor drum 3 by the intermediate transfer roller 9 disposed opposite to the respective photoreceptor drums 3, the intermediate transfer belt 10 is tightly stretched across the driving roller 11*a* on the right side of FIG. 13, the driving roller 11*b* on the left side of FIG. 13, and the roller 170 and the secondary transfer opposing roller 125*a* positioned below the driving roller 11*a* and the driven roller 11*b* so as to be able to move endlessly.

The intermediate transfer belt 10 is driven by the driving roller 11*a* and achieves an endless motion among the respective rollers described above. The toner image of the respective colors formed on the photoreceptor drum 3 is transferred and superposed on the intermediate transfer belt 10 moving in endless motion in the order of M, C, Y, K according to the timing of each color. A color image made of the four colors of M, C, Y, K is thereby formed on the intermediate transfer belt 10.

The secondary transfer roller 210 applies a prescribed transfer bias to the recording paper P based on a command from the control unit 31 (refer to FIG. 3), and secondarily transfers the color image on the intermediate transfer belt 10 to the recording paper P.

In this embodiment, the length of the portion where the secondary transfer is performed in contact with the secondary transfer roller 210 on the outer circumferential surface of the intermediate transfer belt 10 is secured in the transporting direction of the recording paper to become the sub scanning direction of the image formation, a roller 170 is provided to the downstream side of the secondary transfer opposing roller 125*a* on the downstream side in the traveling direction (to become the sub scanning direction) of the intermediate transfer belt 10 in order to stabilize the secondary transfer, and the intermediate transfer belt 10 is tightly stretched across between the roller 170 and the secondary transfer opposing roller 125*a* in parallel with the sheet transport path 152 in the sheet transport path 152.

A movable roller pair 2100 for sandwiching the intermediate transfer belt 10 is provided at the portion where the intermediate transfer belt 10 is tightly stretched across between the secondary transfer opposing roller 125*a* and the roller 170 in parallel with the sheet transport path 152. The movable roller pair 2100 comprises a pair of rollers 211 and 212 biased in mutually approaching directions based on the biasing member 213 as a tension coil spring or the like, and sandwiches the intermediate transfer belt 10 between the roller 211 and the roller 212 (refer to FIG. 14). In addition, the movable roller pair 2100 is configured to be movable in a direction that is orthogonal to the traveling direction of the intermediate transfer belt 10 and bi-directionally to the inner circumferential side and the outer circumferential side of the intermediate transfer belt 10.

Note that the intermediate transfer belt 10 is configured based on the lamination of a base layer 10*a* made of a resin material such as polyvinylidene fluoride (PVDF) formed on the inner circumferential side, and an elastic layer 10*b* made or chloroprene rubber, urethane rubber or the like formed on the outer circumferential side (refer to FIG. 15). Since the following performance of the intermediate transfer belt 10 to the recording paper P will improve by providing the elastic layer 10*b* on the intermediate transfer belt 10, the transfer characteristics of the color image to the recording paper P will improve, and the image quality of the color image that is secondarily transferred to the recording paper P will consequently improve.

Moreover, the image forming apparatus 1A comprises a paper feed unit 180 for feeding paper to the development units 2Y to 2K. The paper feed unit 180 comprises a paper feed cassette 181 for housing the recording paper P, a sheet transport path 152 as the path on which the recording paper P is transported, and a transport roller 153 for transporting the recording paper P in the sheet transport path 152, and transports the recording paper P fed one by one from the paper feed cassette 181 toward the position of the secondary transfer roller 210. Note that the paper feed unit 180 transports the recording paper P subjected to the secondary transfer to the fixing device 13, and discharges the recording paper P subjected to the fixation treatment to the discharge tray 17 at the upper part of the image forming apparatus 1A.

The fixing device 13 is provided more downstream than the roller 170 in the sheet transport path 152, and fixes the toner image transferred to the recording paper P. The fixing device 13 is configured from a heating roller 132 and a pressure roller 134, melts the toner on the recording paper P with the heat from the heating roller 132, applies pressure with the pressure roller 134 and fixes the toner on the recording paper P.

A belt cleaning device 18 is provided at the position opposite to the driven roller 11*b* in the outer circumferential direction of the intermediate transfer belt 10. The belt cleaning device 18 removes (recovers) the residual toner on the intermediate transfer belt 10. The belt cleaning device 18 is configured from a cleaning electrode and a cleaning brush (rotating brush) not shown, applies a cleaning bias of a reverse polarity as the electrification charge of the toner to the cleaning brush using the cleaning electrode, moves the toner on the intermediate transfer belt 10 to the cleaning brush with the electrostatic force, and thereby removes the toner.

A manuscript reading unit 20 and a manuscript feed part 24 are provided at the upper part of the image forming apparatus 1A. The manuscript reading unit 20 comprises a scanner unit 21 configured from a CCD (Charge Coupled Device) sensor including a plurality of pixels and an exposure lamp, a manuscript table 22 configured from a transparent member such as glass, and a manuscript reading slit 23. The scanner unit 21 is configured movably by a driving unit not shown, and, upon reading the manuscript mounted on the manuscript table 22, moves along the manuscript surface at a position opposite to the manuscript table 22, scans the manuscript image and simultaneously outputs the acquired image data (respective pixel data) to the control unit 31 described later. Moreover, upon reading the manuscript fed from the manuscript feed part 24, the scanner unit 21 moves to the position opposite to the manuscript reading slit 23 and acquires the manuscript image in synch with the transport operation of the manuscript based on the manuscript feed part 24 via the manuscript reading slit 23, and outputs such image data to the control unit 31.

The manuscript feed part 24 comprises a manuscript mounting part 25 for mounting the manuscript, a manuscript discharge part 26 for discharging the read manuscript, and a manuscript transport mechanism 27 configured from a paper feed roller or a transport roller (not shown) for feeding the manuscript mounted on the manuscript mounting part 25 one by one and transporting it to the position opposite to the manuscript reading slit 23, and discharging it to the manuscript discharge part 26. The manuscript transport mechanism 27 further comprises a sheet reversal mechanism (not shown) for reversing the front and rear of the manuscript and transporting it once again to the position opposite to the manuscript reading slit 23, and is able to read the two-sided image of the manuscript from the scanner unit 21 via the manuscript reading slit 23.

Moreover, the manuscript feed part 24 is provided in a freely rotatable manner to the image forming apparatus 1A so that its front surface side can move upward. As a result of moving the front surface side of the manuscript feed part 24 upward and opening the upper surface of the manuscript table 22, the manuscript to be read; for instance, an open book or the like can be mounted by the user on the upper surface of the manuscript table 22.

The electrical configuration of the image forming apparatus 1A is now explained with reference to foregoing FIG. 3. The electrical configuration of the image forming apparatus 1A according to the fifth embodiment is basically the same as the configuration shown in foregoing FIG. 3. However, in the fifth embodiment, the movement mechanism 200 moves the movable roller pair 2100 bi-directionally to the inner circumferential side and the outer circumferential side of the intermediate transfer belt 10 based on the drive of the stepping motor 220. Details regarding the movement mechanism 200 will be described later.

In the fifth embodiment, the movement mechanism control unit 312 outputs, to the stepping motor 220 of the movement mechanism 200, the internal temperature of the image forming apparatus 1A detected with the temperature sensor 40 and the drive pulse number according to the paper thickness corresponding to the type of recording paper P set with the input operation unit 35, and thereby controls the position of the movable roller pair 2100.

Figure 14A:
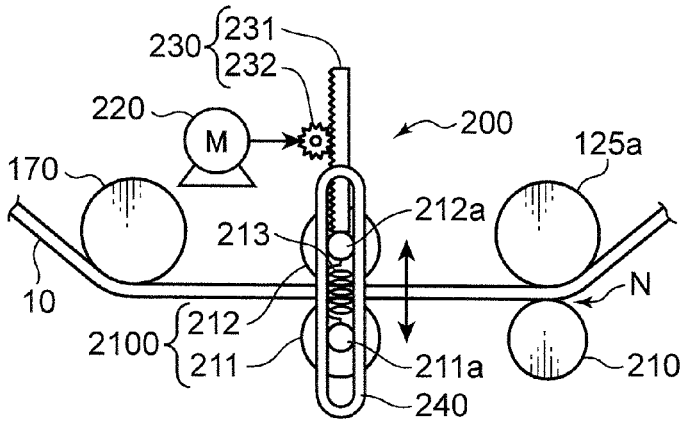
FIGS. 14A, 14B, 14C are front cross sections showing an example of the movement mechanism according to the fifth embodiment.
Figure 14B:
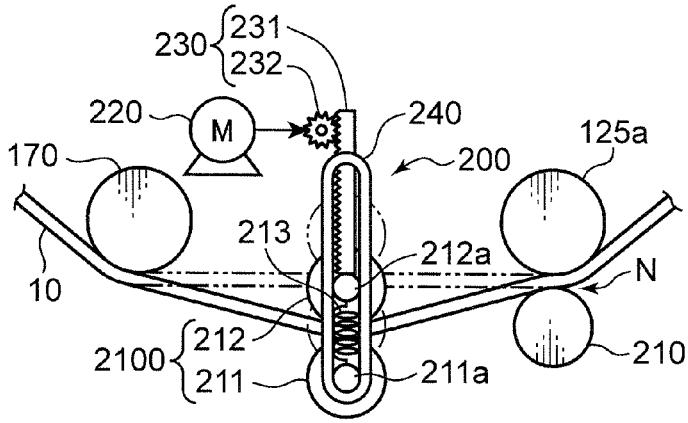
Figure 14C:
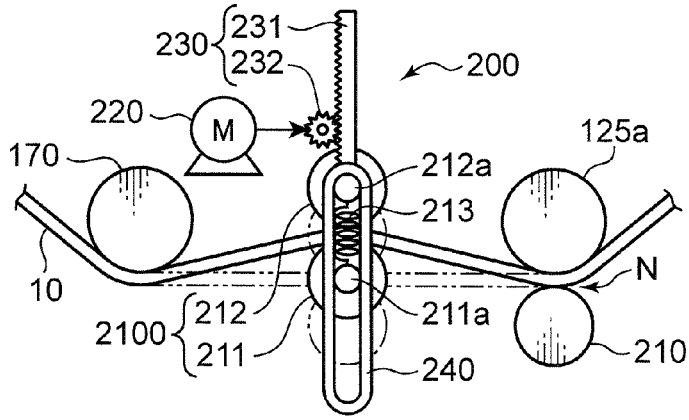

FIG. 14 is a front cross section showing an example of the movement mechanism 200. FIG. 14A shows a state where the movable roller pair 2100 is in a position of not pressing the intermediate transfer belt 10 to the inner circumferential side or the outer circumferential side, FIG. 14B shows a state where the movable roller pair 2100 is in a position of pressing the intermediate transfer belt 10 to the outer circumferential side, and FIG. 14C shows a state where the movable roller pair 2100 is in a position of pressing the intermediate transfer belt 10 to the inner circumferential side, respectively.

The movement mechanism 200 comprises a stepping motor 220, a rack-and-pinion mechanism 230 as an example of the drive force transmission unit, and a guide member 240, and changes the pressed state of the intermediate transfer belt 10 by the secondary transfer roller 210 at the nip part N of the secondary transfer opposing roller 125*a* and the secondary transfer roller 210 where the toner image on the intermediate transfer belt 10 is transferred from the intermediate transfer belt 10 to the recording paper P.

The guide member 240 is a member for pivotally supporting both ends of the rotation axes 211*a* and 212*a* of the rollers 211 and 212 configuring the movable roller pair 2100 in a loosely fitted state, and is formed as a part of the case of the image forming apparatus 1A in a direction that is orthogonal to the inner circumferential direction and the outer circumferential direction of the intermediate transfer belt 10; in a direction that is orthogonal to the outer circumferential surface of the intermediate transfer belt 10 in this embodiment.

The rack-and-pinion mechanism 230 comprises a rack 231 and a pinion 232 and functions as a drive force transmission unit for transmitting the drive force of the stepping motor 220 to the movable roller pair 2100, and drives the movable roller pair 2100 along the guide member 240. One end of the rack 231 engages with an end of the rotation axis 212*a* of the roller 212 in a loosely fitted state. The pinion 232 which engages with the rack 231 is driven by the stepping motor 220, and rotates at a rotation frequency according to the number of driving steps of the stepping motor 220.

Since the rollers 211 and 212 configuring the movable roller pair 2100 are biased in mutually approaching directions by the biasing member 213, when the rack 231 engaged with the end of the rotation axis 212*a* of the roller 212 moves to a direction that is orthogonal to the outer circumferential surface of the intermediate transfer belt 10; that is, to the inner circumferential direction and the outer circumferential direction of the intermediate transfer belt 10 (vertical direction of FIGS. 14A, 14B, 14C) pursuant to the rotation of the pinion 232, the movable roller pair 2100 also moves in a direction that is orthogonal to the transporting direction of the intermediate transfer belt 10 in a state of sandwiching the intermediate transfer belt 10.

The movement mechanism control unit 312 causes the movable roller pair 2100 to move to the outer circumferential side of the intermediate transfer belt 10 by outputting a drive pulse to the stepping motor 220 for rotating the pinion 232 in the clockwise direction in FIGS. 14A, 14B, 14C. Here, the intermediate transfer belt 10 will sag to the outer circumferential side as shown in FIG. 14B. In addition, the movement mechanism control unit 312 causes the movable roller pair 2100 to move to the inner circumferential side of the intermediate transfer belt 10 by outputting a drive pulse to the stepping motor 220 for rotating the pinion 232 in the counterclockwise direction in FIG. 14. Here, the intermediate transfer belt 10 will sag to the inner circumferential side as shown in FIG. 14C.

Figure 15A:
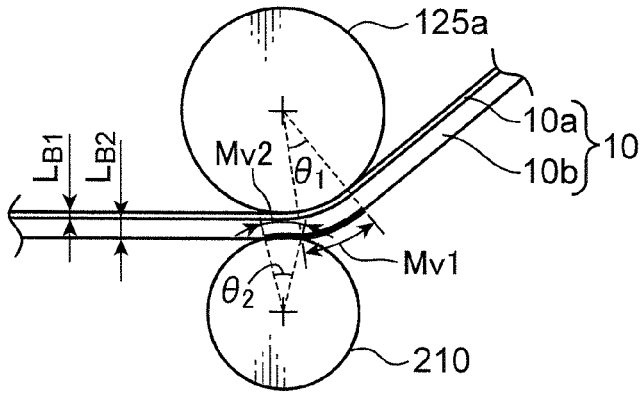
FIGS. 15A, 15B, 15C are diagrams schematically showing a state where the pressed state of the intermediate transfer belt changes at the nip part (portion where secondary transfer is performed on the outer circumferential surface of the intermediate transfer belt) of the secondary transfer opposing roller and the secondary transfer roller pursuant to the movement of the movable roller pair based on the movement mechanism.
Figure 15B:
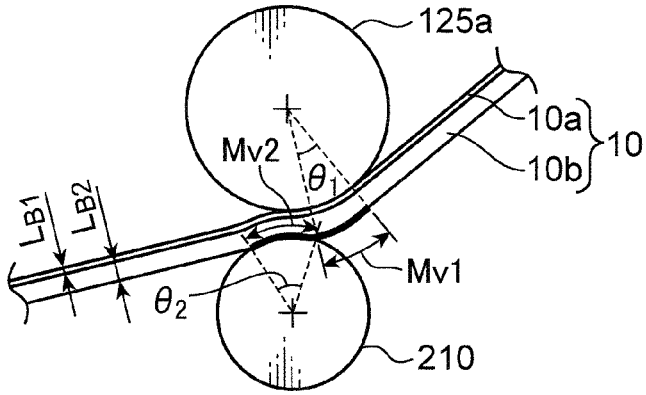
Figure 15C:
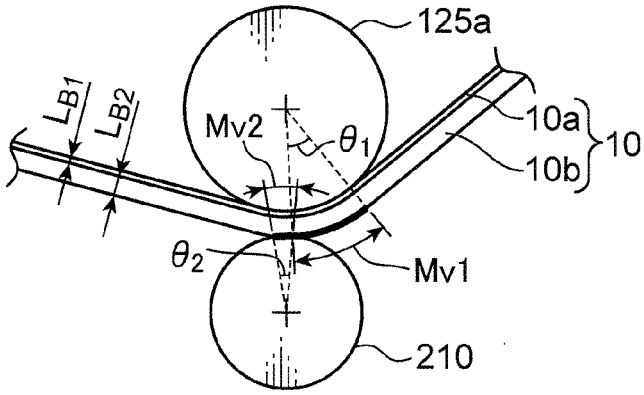

FIGS. 15A, 15B, 15C are diagrams schematically showing a state where the pressed state of the intermediate transfer belt 10 changes at the nip part N (portion where secondary transfer is performed on the outer circumferential surface of the intermediate transfer belt 10) of the secondary transfer opposing roller 125*a* and the secondary transfer roller 210 pursuant to the movement of the movable roller pair 2100 based on the movement mechanism 200. FIG. 15A to FIG. 15C are diagrams which respectively correspond to FIG. 14A to FIG. 14C.

With respect to the portions of FIG. 15 shown as $M_{v1}$ and $M_{v2}$ where secondary transfer is performed at the outer circumferential surface of the intermediate transfer belt 10, the toner image becomes elongated at the portion $M_{v1}$ that is convex in the outer circumferential direction, and the toner image becomes contracted at the portion $M_{v2}$ that is convex in the inner circumferential direction. When the movement mechanism control unit 312 moves the movable roller pair 2100 from the state shown in FIG. 14A (the position of the movable roller pair 2100 and the intermediate transfer belt 10 in the foregoing state is hereinafter referred to as the "reference position") to the outer circumferential side of the intermediate transfer belt 10 (state of FIG. 14B), the length of $M_{v1}$ in the traveling direction of the intermediate transfer belt 10 becomes shorter than the length of $M_{v1}$ at the reference position, and the length of $M_{v2}$ in the traveling direction of the intermediate transfer belt 10 becomes longer than the length of $M_{v2}$ at the reference position. Meanwhile, if the movement mechanism control unit 312 moves the movable roller pair 2100 from the reference position to the inner circumferential side of the intermediate transfer belt 10 (state of FIG. 14C), the length of $M_{v1}$ in the traveling direction of the intermediate transfer belt 10 becomes longer than the length of $M_{v1}$ at the reference position, and the length of $M_{v2}$ in the traveling direction of the intermediate transfer belt 10 becomes shorter than the length of $M_{v2}$ at the reference position.

If the boundary of the base layer 10*a* and the elastic layer 10*b* of the intermediate transfer belt 10 is to be used as the rate deciding surface, and $D_1$: Roller outer diameter (mm) of the secondary transfer opposing roller 125*a*

$D_2$: Roller outer diameter (mm) of secondary transfer roller 210

$L_{B1}$: Thickness (mm) of the base layer 10*a*

$L_{B2}$: Thickness (mm) of the elastic layer 10*b*

$\theta_1$: Angle (radian) formed by both ends of $M_{v1}$ and the center of the secondary transfer opposing roller 125*a*

$\theta_2$: Angle (radian) formed by both ends of $M_{v2}$ and the center of the secondary transfer roller 210, lengths of $M_{v1}$ and $M_2$ relative to the rotating direction of the intermediate transfer belt can be respectively represented with the following formulae.

$$M_{v1}=\pi\times(D_1+2(L_{B1}+L_{B2}))\times\theta_1 \text{ (mm)} \quad \text{Formula (1)}$$

$$M_{v2}=\pi\times D_2\times\theta_2 \text{ (mm)} \quad \text{Formula (2)}$$

Here, if the length of the rate reference surface corresponding to $M_{v1}$ is $A_1$, and the length of the rate reference surface corresponding to $M_{v2}$ is $A_2$, $$A_1=\pi\times(D_1+2L_{B1})\times\theta_1 \text{ (mm)} \quad \text{Formula (3)}$$

$$A_2=\pi\times(D_2+2L_{B2})\times\theta_2 \text{ (mm)} \quad \text{Formula (4)}$$

and, therefore, $M_{v1}$ and $M_{v2}$ can be represented as $$M_{v1}=A_1+2\pi\times L_{B2}\times\theta_1 \text{ (mm)} \quad \text{Formula (5)}$$

$$M_{v2}=\pi\times(D_2+2(L_{B2}-L_{B2}))\times\theta_2=A_2-2\pi\times L_{B2}\times\theta_2 \text{ (mm)} \quad \text{Formula (6).}$$

Here, if the secondary transfer magnification is $M_2$, since $$M_2=(M_{v1}+M_{v2})/(A_1+A_2),$$

$$M_2=(A_1+A_2+2\pi\times L_{B2}\times(\theta_1-\theta_2))/(A_1+A_2) \quad \text{Formula (7).}$$

Specifically, if $\theta_1$ is set to be greater than $\theta_2$, the toner image on the intermediate transfer belt 10 is enlarged and secondarily transferred to the recording paper P, and if $\theta_1$ is set to be smaller than $\theta_2$, the toner image on the intermediate transfer belt 10 is reduced and secondarily transferred to the recording paper P.

Meanwhile, if the temperature of the intermediate transfer belt 10 increases, since the intermediate transfer belt 10 will expand, the toner image formed on the outer circumferential surface of the intermediate transfer belt 10 becomes elongated. Specifically, the secondary transfer magnification $M_2$ increases. Contrarily, if the temperature of the intermediate transfer belt 10 decreases, since the intermediate transfer belt 10 will contract, the toner image becomes contracted. Specifically, the secondary transfer magnification $M_2$ decreases.

As described above, for example, rubber such as chloroprene rubber and urethane rubber has a greater coefficient of thermal expansion than a resin material such as PVDF. Accordingly, in cases as with this embodiment where the elastic layer made of chloroprene rubber or urethane rubber is formed on the outer circumferential side of the intermediate transfer belt 10, for example, magnification deviation is more likely to occur in comparison to cases of configuring the intermediate transfer belt 10 only with a resin material such as PVDF. Specifically, if the temperature of the intermediate transfer belt 10 increases, the toner image becomes elongated pursuant to the expansion of the elastic layer, and, if the temperature of the intermediate transfer belt 10 decreases, the toner image becomes contracted pursuant to the contraction of the elastic layer.

Thus, the movement mechanism control unit 312 reads the temperature of the intermediate transfer belt 10 detected with the temperature sensor 40 at prescribed sampling intervals, outputs a drive pulse number DP1 proportional to a variation $\Delta T$ of the temperature T of the intermediate transfer belt 10 detected with the temperature sensor 40, moves the movable roller pair 2100 by a travel distance proportional to the drive pulse number DP1, and thereby corrects the magnification deviation in the sub scanning direction that occurs pursuant to the increase and decrease of the temperature T of the intermediate transfer belt 10. Specifically, in order to reduce the secondary transfer magnification $M_2$ according to the increase in the temperature T of the intermediate transfer belt 10 detected with the temperature sensor 40, the movement mechanism control unit 312 outputs the drive pulse number DP1 corresponding to the variation $\Delta T$ at such time to the stepping motor 220 and moves the movable roller pair 2100 to the outer circumferential side of the intermediate transfer belt 10.

Note that, in this embodiment, a table which associates the drive pulse number DP1 of the stepping motor 220 for deciding the position of the movable roller pair 2100 and the variation $\Delta T$ is stored in the storage unit 313 in advance, and the movement mechanism control unit 312 reads the drive pulse number DP1 corresponding to the variation $\Delta T$ from the foregoing table. In addition, the drive pulse number DP1 takes on both positive and negative values, and the stepping motor 220 is able to output the drive force bi-directionally in the clockwise direction and the counterclockwise direction (thus, in FIGS. 15A, 15B, 15C, the pinion 232 rotates bi-directionally in the clockwise direction and the counterclockwise direction).

Moreover, if the paper thickness increases according to the type of recording paper P that is transported to the nip part N, the intermediate transfer belt 10 is pressed more in the inner circumferential direction at the nip part N due to the recording paper P. Specifically, $\theta_2$ increases and the secondary transfer magnification $M_2$ decreases.

Thus, in this embodiment, the movement mechanism control unit 312 outputs a drive pulse number DP2 corresponding to the variation of $\theta_2$ which changes according to the type of recording paper P set with the input operation unit 35, moves the movable roller pair 2100 by a travel distance proportional to the drive pulse number, and thereby corrects the magnification deviation in the sub scanning direction that occurs pursuant to the difference in the type of recording paper P. Specifically, in order to reduce the value of $\theta_2$ and increase the secondary transfer magnification $M_2$ in cases where a sheet with a large paper thickness such as a cardboard is set as the recording paper with the input operation unit 35, the movement mechanism control unit 312 outputs the drive pulse number DP2 corresponding to the variation of $\theta_2$ which occurs due to the difference in paper thickness between the recording paper and plain paper to the stepping motor 220, and moves the movable roller pair 2100 more to the inner circumferential side of the intermediate transfer belt 10 than the position upon printing plain paper.

Storing a table which associates the drive pulse number DP2 and the variation of $\theta_2$ in advance in the storage unit 313, the movement mechanism control unit 312 reading the drive pulse number DP2 corresponding to the variation of $\theta_2$ from the foregoing table, and the drive pulse number DP2 taking on both positive and negative values are the same as the case of the drive pulse number DP1 that is output by the movement mechanism control unit 312 upon correcting the magnification deviation in the sub scanning direction that occurs pursuant to the increase and decrease in the temperature T of the intermediate transfer belt 10.

In this embodiment, the movement mechanism control unit 312 outputs the drive pulse number (DP1+DP2) obtained by adding the drive pulse number DP2 to the drive pulse number DP1 to the stepping motor 220, and thereby moves the movable roller pair 2100.

The control of the movement mechanism control unit 312 deciding the drive pulse number of the stepping motor 220 according to the variation ΔT of the temperature T of the intermediate transfer belt 10 detected with the temperature sensor 40 and the type of recording paper P set with the input operation unit 35, and causing the movement mechanism 200 to move the movable roller pair 2100 is now explained with reference to foregoing FIG. 6. When the image formation operation by the image forming unit 2 is started, the movement mechanism control unit 312 reads the temperature T of the intermediate transfer belt 10 detected with the temperature sensor 40 at prescribed sampling intervals (step S1), and calculates the variation ΔT of the temperature T of the intermediate transfer belt 10 in the sampling intervals (step S2). Subsequently, the movement mechanism control unit 312 reads the drive pulse number DP1 corresponding to the variation ΔT from the table stored in the storage unit 313 (step S3).

If the recording paper P set with the input operation unit 35 is plain paper (YES at step S4), the movement mechanism control unit 312 outputs the read drive pulse number DP1 to the stepping motor 220 (step S5). Meanwhile, if the recording paper P set with the input operation unit 35 is not plain paper (NO at step S4), the movement mechanism control unit 312 reads the drive pulse number DP2 corresponding to the type of recording paper P from the table stored in the storage unit 313 (step S6), and outputs the drive pulse number (DP1+DP2) in which DP2 is added to DP1 to the stepping motor 220 (step S7). Consequently, the movable roller pair 2100 moves by a travel distance proportional to the drive pulse number (DP1+DP2), and the magnification deviation in the sub scanning direction which occurs pursuant to the increase and decrease in the temperature T of the intermediate transfer belt 10 and the difference in the type of recording paper P is thereby corrected.

According to the image forming apparatus 1A according to the foregoing embodiment explained above, a roller for tightly stretching the intermediate transfer belt is provided to the downstream side of the secondary transfer opposing roller in the sub scanning direction upon image formation in an image forming apparatus which performs image formation on recording paper based on a secondary transfer method using an intermediate transfer belt, and the intermediate transfer belt is tightly stretched across between the foregoing roller and the secondary transfer opposing roller in parallel with the sheet transport path in the sheet transport path. Thus, it is possible to correct the magnification deviation in the sub scanning direction without deteriorating the productivity.

The image forming apparatus 1A according to an embodiment of the present invention was explained above, but such embodiment is merely an example. Specifically, the present invention is not limited to the foregoing embodiment, and may be variously modified and improved to the extent that it does not deviate from the gist thereof, and, for example, the present invention may take on the following modified embodiments.

Figure 16:
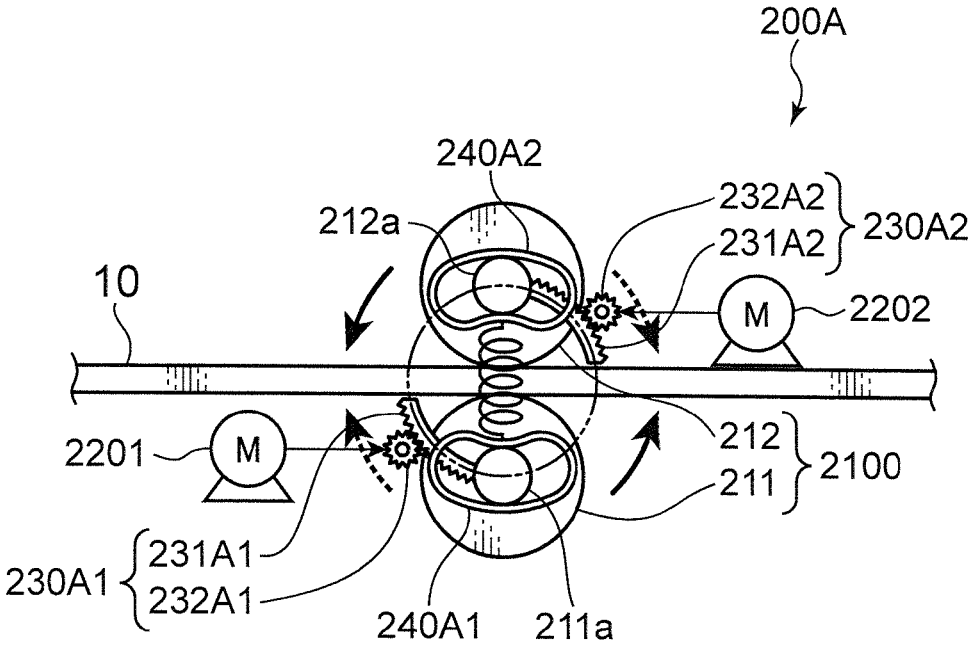
FIG. 16 is a diagram showing another example of the movement mechanism.

(1) In the foregoing embodiment, the movable direction of the movable roller pair 2100 to be moved by the movement mechanism 200 is a direction that is orthogonal to the outer circumferential surface of the intermediate transfer belt 10. However, the movable direction of the movable roller pair 2100 is not limited thereto, and it will suffice so as long as the roller 211 and the roller 212 configuring the movable roller pair 2100 are able to move bi-directionally in the inner circumferential direction and the outer circumferential direction of the intermediate transfer belt 10. Another example of the movement mechanism is shown in FIG. 16. With the movement mechanism 200A shown in FIG. 16, the roller 211 and the roller 212 are configured to rotate while maintaining their mutual inter-axis distance; that is, configured such that the rollers 211 and 212 move in the clockwise direction and the counterclockwise direction on a circle with the respective centers of the roller 211 and the roller 212 as the diameter.

The movement mechanism 200A comprises, as with the movement mechanism 200, a stepping motor 2201 and a stepping motor 2202, a rack-and-pinion mechanism 230A1 (drive force transmission unit) including a rack 231A1 and a pinion 232A1 and a rack-and-pinion mechanism 230A2 (drive force transmission unit) including a rack 231A2 and a pinion 232A2, and a guide member 240A1 and a guide member 240A2, but differs in that the shape of the rack 231A1 and the rack 231A2 and the shape of the guide member 240A1 and the guide member 240A2 differ from the movement mechanism 200 shown in FIG. 14.

Specifically, the guide member 240A1 is provided at both ends of the rotation axis 211*a* of the roller 211, the guide member 240A2 is provided at both ends of the rotation axis 212*a* of the roller 212, and the guide member 240A1 and the guide member 240A2 are formed as a part of the case of the image forming apparatus 1A in a shape following the circular arc with the respective centers of the roller 211 and the roller 212 as the diameter, which is a shape heading bi-directionally in the inner circumferential direction and the outer circumferential direction of the intermediate transfer belt 10.

The rack 231A1 is provided at both ends of the rotation axis 211*a* of the roller 211. The rack 231A1 is a circular flex member with approximately the same curvature as the center line (line shown with a dashed line) in the longitudinal direction forming the circular shape of the guide member 240A1, and one end thereof is loosely fitted in an end of the rotation axis 211*a* in a state where the circular arc forming the longitudinal direction becomes approximately parallel with the center line in the longitudinal direction of the guide member 240A1. As with the rack 231A1, the rack 231A2 is provided at both ends of the rotation axis 212*a* of the roller 212, and is a circular flex member with approximately the same curvature as the center line in the longitudinal direction forming the circular shape of the guide member 240A2, and one end thereof is loosely fitted in an end of the rotation axis 212*a* in a state where the circular arc forming the longitudinal direction becomes approximately parallel with the center line in the longitudinal direction of the guide member 240A2.

When the pinion 232A1 applied with the drive force from the stepping motor 2201 and the pinion 232A2 applied with the drive force from the stepping motor 2202 are rotated in the clockwise direction, the rollers 211 and 212 biased in mutually approaching directions by the biasing member 213 move in the arrow direction shown with the solid line in FIG. 16 along the guide member 240A1 and the guide member 240A2 in a state of sandwiching the intermediate transfer belt 10, and, when the pinion 232A1 and the pinion 232A2 rotate in the counterclockwise direction, the rollers 211 and 212 move in the arrow direction shown with the dotted line in FIG. 16 along the guide member 240A1 and the guide member 240A2 in a state of sandwiching the intermediate transfer belt 10.

(2) Since the rubber such as chloroprene rubber and urethane rubber used as the elastic layer 10*b* of the intermediate transfer belt 10 expands due to moisture absorption even though its influence is small in comparison to the expansion and contraction caused by a temperature change, it is also possible to provide a humidity sensor in the image forming apparatus 1A and cause the movement mechanism control unit 312 to control the pressing amount to the intermediate transfer belt 10 by changing the travel distance of the movable roller pair 2100 according to the humidity detected with the humidity sensor.

(3) The present invention can also be applied to an image forming apparatus comprising a sheet transport belt in the sheet transport path 152 opposite to the portion where the intermediate transfer belt 10 is tightly stretched across between the roller 170 and the secondary transfer opposing roller 125*a* in parallel with the sheet transport path 152 in the sheet transport path 152.

Another embodiment regarding the control for correcting the magnification deviation in the sub scanning direction in the image forming apparatus 1, 1A according to the foregoing first to fifth embodiments is now explained.

With the image forming apparatus 1, 1A according to the foregoing first to fifth embodiments, the movement mechanism control unit 312 controls the travel distance of the secondary transfer roller 210, the driven roller 125*b*, the backup roller 125*d*, and the movable roller pair 2100 by outputting, to the stepping motor 220 of the movement mechanism 200, a drive pulse number according to the temperature of the intermediate transfer belt 125 and 10 of the image forming apparatus 1, 1A detected with the temperature sensor 40, and the paper thickness corresponding to the type of recording paper P set with the input operation unit 35. In substitute for the travel distance control by the movement mechanism control unit 312 based on the temperature of the intermediate transfer belt 125 and the paper thickness corresponding to the type of recording paper P, in this other embodiment, whether the image forming apparatus 1, 1A is to perform image formation processing to the rear surface of the recording paper is determined, and, if the image forming apparatus 1, 1A is to perform image formation processing to the rear surface of the recording paper, the movement mechanism control unit 312 decides the travel distance of the foregoing roller to be moved by the movement mechanism 200 according to a predetermined shrinkage ratio, and causes the movement mechanism 200 to move the foregoing roller based on the decided roller travel distance.

For example, when performing two-sided printing with the image forming apparatus 1, 1A, the recording paper P is dehumidified with the heat from the thermal fixation after printing is performed on the front surface and becomes contracted, image formation is performed on the rear surface of the contracted recording paper P, the image formed on the rear surface becomes elongated when the printed recording paper P absorbs moisture and becomes elongated to its original size, and magnification deviation occurs to the image on the front and rear surfaces of the recording paper P. Thus, the table stored in the storage unit 313 stores, in advance, a drive pulse number DP1 corresponding to the travel distance of the roller (respective rollers to be moved by the movement mechanism 200 of each of the embodiments) capable of contracting the intermediate transfer belt 125 for an amount according to the recording paper shrinkage ratio ΔSh of the foregoing recording paper P.

The drive pulse number DP1 takes on both positive and negative values, and the cam drive mechanism (stepping motor) 220 is able to output the drive force bi-directionally in the clockwise direction and the counterclockwise direction. Thus, the movement mechanism 200 is able to move the roller to be moved bi-directionally to the inside and outside of the revolving line of the intermediate transfer belt 125.

When the image forming apparatus 1 is to perform two-sided image formation operation, the movement mechanism control unit 312 reads, from the foregoing table stored in the storage unit 313, a drive pulse number DP1 of the stepping motor 220 corresponding to the recording paper shrinkage ratio ΔSh upon thermal fixation which differs according to the type of recording paper P set with the input operation unit 35, and, after completing the front surface image formation to the recording paper P, drive-controls the stepping motor 220 with the read drive pulse number DP1 at the timing before the rear surface image formation is performed.

Specifically, the movement mechanism control unit 312 rotates the stepping motor 220 for the amount of rotation according to the foregoing drive pulse number DP1 and causes the rear surface image formation to be performed on the recording paper P in a state where the respective rollers to be moved by the movement mechanism 200 are moved from the predetermined roller reference position by a travel distance according to the foregoing drive pulse number DP1, and thereby corrects the image magnification deviation in the sub scanning direction which occurs in the rear surface image formation during the two-sided image formation.

Figure 17:
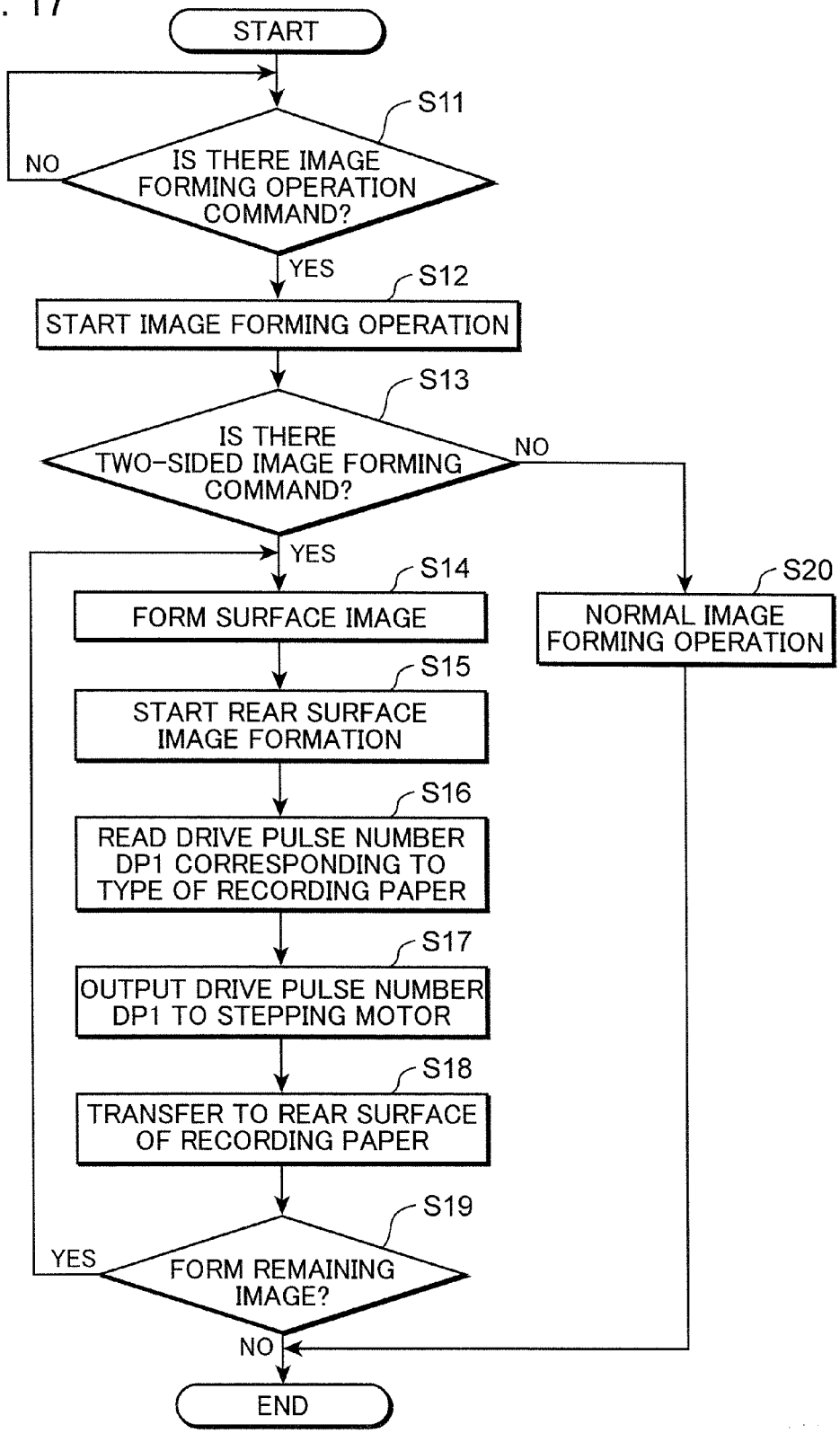
FIG. 17 is a flowchart showing the control of the movement mechanism according to the contraction of recording paper upon forming an image on the rear surface in the two-sided image formation.

The control performed by the movement mechanism control unit 312 to the movement mechanism 200 according to the recording paper contraction upon the rear surface image formation during the two-sided image formation is now explained. FIG. 17 is a flowchart showing the control of the movement mechanism 200 according to the recording paper contraction upon the rear surface image formation during the two-sided image formation.

When a command for specifying the recording paper type to be used in the image formation is input by the operator using the input operation unit 35 and the image formation operation execution command is input (YES at S11), the image formation operation by the image forming unit 12 is started (S12).

The movement mechanism control unit 312 determines whether the two-sided image formation command was set as the foregoing image formation operation execution command with the input operation unit 35 by the operator (S13). If the two-sided image formation command is not set (NO at S13), the overall control unit 311 performs the standard single-sided image formation operation (image formation operation in which the movement mechanism 200 is not driven by the movement mechanism control unit 312) (S20).

Meanwhile, if the two-sided image formation command is set (YES at S13), the overall control unit 311 foremost transports the recording paper P from the paper feed cassette 142 and causes the image forming unit 12 to perform the image formation operation to the front surface of the recording paper P (S14).

After the image formation operation to the front surface of the recording paper P is complete, the overall control unit 311 causes the sheet transport mechanism to reverse the recording paper P, and once again transports the recording paper P toward the nip part N of the driving roller 125*a* and the secondary transfer roller 210. Specifically, the overall control unit 311 starts the image formation operation to the rear surface of the recording paper P (S15).

Here, at the timing before the recording paper P arrives at the nip part N of the driving roller 125*a* and the secondary transfer roller 210 by the sheet transport mechanism, the movement mechanism control unit 312 reads, from the table stored in the storage unit 313, the drive pulse number DP1 of the stepping motor 220 of the movement mechanism 200 corresponding to the type of recording paper P set with the input operation unit 35 at 51 (S16). The movement mechanism control unit 312 subsequently outputs the read drive pulse number DP1 to the stepping motor 220 (S17). The overall control unit 311 thereafter causes the image forming unit 12 to perform transfer to the rear surface of the recording paper (S18). The processes of S14 to S18 are performed to all recording paper subjected to the image formation based on a job of the image formation operation by the overall control unit 311 and the movement mechanism control unit 312 (YES at S19), and the control is ended at the point in time that the image formation to all recording paper based on the job of the image formation operation is complete.

Since the respective rollers to be moved by the respective movement mechanisms 200 described above will be moved by a travel distance proportional to the drive pulse number DP1, the intermediate transfer belt 125 is contracted in the amount of contraction according to the contraction of the recording paper P which became contracted due to the heat from the image formation of the front surface. Thus, the image magnification deviation in the sub scanning direction which occurs due to the contraction of the recording paper during the rear surface image formation is corrected according to the type of recording paper P.

Note that the present invention is not limited to the configuration of the foregoing embodiments, and may be modified in various ways. For example, the foregoing embodiment explained a case where the storage unit 313 stores in advance a table which associates recording paper shrinkage ratio ΔSh obtained in advance for each type of recording paper P, and the drive pulse number DP1 of the stepping motor 220 corresponding to the recording paper shrinkage ratio ΔSh, and during two-sided image formation operation performed by the image forming apparatus 1, the movement mechanism control unit 312 reads, from the foregoing table stored in the storage unit 313, the drive pulse number DP1 of the stepping motor 220 corresponding to the recording paper shrinkage ratio ΔSh upon thermal fixation which differs according to the type of recording paper P set with the input operation unit 32, and, after completing the front surface image formation to the recording paper P, drive-controls the stepping motor 220 with the read drive pulse number DP1 at the timing before the rear surface image formation is performed. Alternatively, without performing the drive control of the stepping motor 220 corresponding to the recording paper shrinkage ratio ΔSh of each type of recording paper as described above, the movement mechanism control unit 312 may also cause the movement mechanism 200 to move the rollers by drive-controlling the stepping motor 220 with the drive pulse number DP2 corresponding to the roller travel distance by using the travel distance of the roller (roller to be moved by the movement mechanism 200 in the respective embodiments) to be moved by the movement mechanism 200 according to a predetermined fixed recording paper shrinkage ratio regardless of the type of recording paper at the timing before the rear surface image formation is performed after the front surface image formation to the recording paper P is complete.

The image forming apparatus 1 according to the fifth embodiment of the present invention was explained above, but the fifth embodiment is merely an example. Specifically, the present invention is not limited to the fifth embodiment (for example, configuration of the movement mechanism 200), and may be variously modified and improved to the extent that it does not deviate from the gist thereof.

This application is based on Japanese Patent application serial Nos. 2010-018879, 2010-018880, 2010-018881, 2010-018882 and 2010-018883 filed in Japan Patent Office on Jan. 29, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a development unit that forms a toner image according to image data;

an intermediate transfer belt tightly stretched across a plurality of rollers so as to be able to move endlessly in a sub scanning direction upon image formation, and having an outer circumferential surface to which the toner image formed with the development unit is transferred;

a secondary transfer opposing roller which is one of the plurality of rollers and across which the intermediate transfer belt is tightly stretched;

a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper;

a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper;

a movement mechanism control unit that controls a travel distance of the roller to be moved by the movement mechanism; and a temperature detection unit that detects temperature of the intermediate transfer belt, wherein the movement mechanism control unit controls the travel distance of the roller according to the temperature detected with the temperature detection unit.

2. The image forming apparatus according to claim 1, further comprising:

a paper thickness setting unit that sets a paper thickness of the recording paper, wherein the movement mechanism control unit controls the travel distance of the roller according to the paper thickness set with the paper thickness setting unit.

3. An image forming apparatus, comprising:

a development unit that forms a toner image according to image data;

an intermediate transfer belt tightly stretched across a plurality of rollers so as to be able to move endlessly in a sub scanning direction upon image formation, and having an outer circumferential surface to which the toner image formed with the development unit is transferred;

a secondary transfer opposing roller which is one of the plurality of rollers and across which the intermediate transfer belt is tightly stretched;

a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper;

a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper; and a movement mechanism control unit that controls a travel distance of the roller to be moved by the movement mechanism;

wherein the secondary transfer roller is disposed movably in the sub scanning direction relative to the secondary transfer opposing roller, and the movement mechanism moves the secondary transfer roller in the sub scanning direction, and changes the pressed state of the intermediate transfer belt by the secondary transfer roller at the nip part of the secondary transfer opposing roller and the secondary transfer roller where the toner image is transferred from the intermediate transfer belt to the recording paper.

4. The image forming apparatus according to claim 3, wherein both ends of a rotation axis of the secondary transfer roller in a longitudinal direction are pivotally supported by a guide member in a state of being loosely fitted thereinto, the guide member being formed in a shape following a circumferential surface of the secondary transfer opposing roller, the movement mechanism includes a stepping motor, and a drive force transmission unit that drives the secondary transfer roller along the guide member with drive force of the stepping motor, and the movement mechanism control unit outputs a drive pulse according to the travel distance of the secondary transfer roller to the stepping motor.

5. An image forming, comprising:

a development unit that forms a toner image according to image data an intermediate transfer belt tightly stretched across a plurality of rollers so as to be able to move endlessly in a sub scanning direction upon image formation, and having an outer circumferential surface to which the toner image formed with the development unit is transferred;

a secondary transfer opposing roller which is one of the plurality of rollers and across which the intermediate transfer belt is tightly stretched;

a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper;

a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper; and a movement mechanism control unit that controls a travel distance of the roller to be moved by the movement mechanism;

wherein at least an outer circumferential side of the secondary transfer roller in a radial direction is formed from an elastic member, and the secondary transfer roller presses the outer circumferential surface of the intermediate transfer belt at a position to become an end on an upstream side, in the sub scanning direction, of the portion where the intermediate transfer belt is tightly stretched across the secondary transfer opposing roller, and transfers the toner image on the intermediate transfer belt to the recording paper, and the movement mechanism moves the secondary transfer roller, in a state of being in contact with the intermediate transfer belt, in a direction in which the secondary transfer roller moves toward and away from a shaft center of the secondary transfer opposing roller in an inter-axis direction of the secondary transfer roller and the secondary transfer opposing roller, and changes the pressed state of the intermediate transfer belt by the secondary transfer roller at the nip part of the secondary transfer opposing roller and the secondary transfer roller where the toner image is transferred from the intermediate transfer belt to the recording paper.

6. The image forming apparatus according to claim 5, wherein both ends of a rotation axis of the secondary transfer roller in a longitudinal direction are pivotally supported by a guide member in a state of being loosely fitted thereinto, the guide member being formed in a shape following the inter-axis direction of the secondary transfer roller and the secondary transfer opposing roller, the movement mechanism includes a stepping motor, and a drive force transmission unit that drives the secondary transfer roller along the guide member with drive force of the stepping motor, and the movement mechanism control unit outputs a drive pulse according to the travel distance of the roller to the stepping motor.

7. The image forming apparatus according to claim 6, wherein the drive force transmission unit is a cam, and the movement mechanism control unit outputs, to the stepping motor, a drive pulse in which an angle of rotation of the cam is set as an angle of rotation according to the travel distance of the roller.

8. A method of adjusting image magnification in an image forming apparatus that includes a development unit that forms a toner image according to image data, an intermediate transfer belt tightly stretched across a plurality of rollers so as to be able to move endlessly in a sub scanning direction upon image formation and having an outer circumferential surface to which the toner image formed with the development unit is transferred, a secondary transfer opposing roller which is one of the plurality of rollers and across which the intermediate transfer belt is tightly stretched, and a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper, the method adjusting image magnification in the sub scanning direction upon transferring the toner image from the intermediate transfer belt to the recording paper by the image forming apparatus and comprising:

a first step of acquiring a value corresponding to an amount of expansion and contraction of the intermediate transfer belt in the sub scanning direction at a nip part of the secondary transfer opposing roller and the secondary transfer roller where the toner image is transferred from the intermediate transfer belt to the recording paper; and a second step of causing a movement mechanism, which moves at least one of the plurality of rollers across which the intermediate transfer belt is tightly stretched, or the secondary transfer roller and changes a pressed state of the intermediate transfer belt by the secondary transfer roller at the nip part, to move one of the rollers at a roller travel distance according to the value corresponding to the amount of expansion and contraction of the intermediate transfer belt acquired in the first step.

9. An image forming apparatus, comprising:

a development unit that forms a toner image according to image data;

an intermediate transfer belt tightly stretched across a plurality of rollers so as to be able to move endlessly in a sub scanning direction upon image formation, and having an outer circumferential surface to which the toner image formed with the development unit is transferred;

a secondary transfer opposing roller which is one of the plurality of rollers and across which the intermediate transfer belt is tightly stretched;

a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper;

a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper;

a movement mechanism control unit that controls a travel distance of the roller to be moved by the movement mechanism; and a tension roller, as one of the plurality of rollers, that applies tension to the intermediate transfer belt by pressing the intermediate transfer belt tightly stretched across the roller from its inner circumferential surface side toward an outward direction, wherein the movement mechanism moves an arrangement position of the tension roller as the roller to be moved, and includes:

a biasing mechanism which is mounted on a rotation axis of the tension roller and biases the tension roller toward an outward direction of a revolving line of the intermediate transfer belt tightly stretched across and revolving around the rollers so as to be able to move endlessly; and a positioning mechanism that positions, in the outward direction, the tension roller that is biased toward the outward direction by the biasing mechanism, against the bias of the biasing mechanism; and wherein the biasing mechanism of the movement mechanism includes a tension spring that connects the rotation axis of the tension roller and an apparatus body inner wall part positioned outside the intermediate transfer belt tightly stretched so as to be able to move endlessly, and the positioning mechanism includes:

a circular guide member which is concentric with the rotation axis of the tension roller and co-rotates with the rotation axis;

a freely rotatable cam member which directly or indirectly comes in contact with the guide member; and a cam drive mechanism that rotates the cam member around a rotation axis of the cam, and the movement mechanism control unit controls the travel distance of the tension roller moved by the movement mechanism with an amount of rotation of the cam member performed by the cam drive mechanism.

10. The image forming apparatus according to claim 9, wherein the secondary transfer opposing roller is a driving roller that applies drive force to the intermediate transfer belt to achieve the endless motion, and the tension roller is a driven roller provided at a position opposite to the secondary transfer opposing roller, and drivenly rotated in accordance with the endless motion of the intermediate transfer belt.

11. The image forming apparatus according to claim 9, further comprising:

a driven roller provided at a position opposite to the secondary transfer opposing roller, and drivenly rotated in accordance with the endless motion of the intermediate transfer belt, wherein the secondary transfer opposing roller is a driving roller that applies drive force to the intermediate transfer belt to achieve the endless motion, and the tension roller is a tension applying roller that causes the intermediate transfer belt tightly stretched across and revolving around the rollers so as to be able to move endlessly to have a shape of being projected toward an outward direction of the revolving line.

12. An image forming apparatus, comprising:

a development unit that forms a toner image according to image data;

an intermediate transfer belt tightly stretched across a plurality of rollers so as to be able to move endlessly in a sub scanning direction upon image formation and having an outer circumferential surface to which the toner image formed with the development unit is transferred;

a secondary transfer opposing roller which is one of the plurality of rollers and across which the intermediate transfer belt is tightly stretched;

a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper;

a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper;

a movement mechanism control unit that controls a travel distance of the roller to be moved by the movement mechanism; and a correction roller, as one of the plurality of rollers, that corrects an approach angle of the intermediate transfer belt to a nip part formed by the secondary transfer roller pressing the secondary transfer opposing roller, at a position that is more upstream than the nip part in a traveling direction of the intermediate transfer belt, by pressing the intermediate transfer belt tightly stretched so as to be able to rotate endlessly from its inner circumferential surface side toward an outward direction, wherein the movement mechanism moves an arrangement position of the correction roller, and includes:

a biasing mechanism which is mounted on a rotation axis of the correction roller and biases the correction roller toward an outward direction of a revolving line of the intermediate transfer belt tightly stretched across and revolving around the rollers so as to be able to move endlessly; and a positioning mechanism that positions, in the outward direction, the correction roller that is biased toward the outward direction by the biasing mechanism, against the bias of the biasing mechanism, wherein the biasing mechanism of the movement mechanism includes a tension spring that connects the rotation axis of the correction roller and an apparatus body inner wall part positioned outside the intermediate transfer belt tightly stretched so as to be able to move endlessly, the positioning mechanism includes:

a circular guide member which is concentric with the rotation axis of the correction roller and co-rotates with the rotation axis;

a cam member which freely rotates, and directly or indirectly comes in contact with the guide member; and a cam drive mechanism that rotates the cam member around a rotation axis of the cam, the movement mechanism control unit controls the travel distance of the correction roller moved by the movement mechanism, with an amount of rotation of the cam member performed by the cam drive mechanism.

13. An image forming apparatus, comprising:

a development unit that forms a toner image according to image data;

an intermediate transfer belt tightly stretched across a plurality of rollers so as to be able to move endlessly in a sub scanning direction upon image formation, and having an outer circumferential surface to which the toner image formed with the development unit is transferred;

a secondary transfer opposing roller which is one of the plurality of rollers and across which the intermediate transfer belt is tightly stretched;

a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper;

a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper;

a movement mechanism control unit that controls a travel distance of the roller to be moved by the movement mechanism;

a sheet transport path on which the recording paper to which the toner image has been transferred is transported;

a parallel roller, as one of the plurality of rollers, that tightly stretches the intermediate transfer belt at a downstream side in the sub scanning direction relative to the secondary transfer opposing roller, and causing the intermediate transfer belt to be tightly stretched parallel to the sheet transport path within the sheet transport path together with the secondary transfer opposing roller; and a movable roller pair which sandwiches the intermediate transfer belt at a portion where the intermediate transfer belt is tightly stretched parallel to the sheet transport path by the parallel roller at the downstream side in the sub scanning direction relative to the secondary transfer opposing roller, and which moves bi-directionally in an inner circumferential direction and an outer circumferential direction of the intermediate transfer belt, wherein both ends of a rotation axis of each of the rollers configuring the movable roller pair in a longitudinal direction are pivotally supported by a guide member in a state of being loosely fitted thereinto, the guide member being formed in the inner circumferential direction and the outer circumferential direction of the intermediate transfer belt, the movement mechanism moves, as the roller to be moved, the movable roller pair in the inner circumferential direction and the outer circumferential direction of the intermediate transfer belt, and includes a stepping motor, and a drive force transmission unit that drives the movable roller pair along the guide member with drive force of the stepping motor, and the movement mechanism control unit controls the travel distance of the movable roller pair moved by the movement mechanism and outputs a drive pulse according to the travel distance of the movable roller pair to the stepping motor.

14. An image forming apparatus, comprising:

a development unit that forms a toner image according to image data;

an intermediate transfer belt tightly stretched across a plurality of rollers so as to be able to move endlessly in a sub scanning direction upon image formation, and having an outer circumferential surface to which the toner image formed with the development unit is transferred;

a secondary transfer opposing roller which is one of the plurality of rollers and across which the intermediate transfer belt is tightly stretched;

a secondary transfer roller which comes into contact with the outer circumferential surface of the intermediate transfer belt at a portion where the intermediate transfer belt is tightly stretched across the secondary transfer opposing roller, and transfers the toner image on the intermediate transfer belt to recording paper;

a movement mechanism that moves at least one of the plurality of rollers across which the intermediate transfer belt is tightly stretched, or the secondary transfer roller, and changing a pressed state of the intermediate transfer belt by the secondary transfer roller at a nip part of the secondary transfer opposing roller and the secondary transfer roller where the toner image is transferred from the intermediate transfer belt to the recording paper;

a movement mechanism control unit that controls a travel distance of the roller to be moved by the movement mechanism; and a two-sided image formation mechanism that performs image formation on both sides of the recording paper, wherein the movement mechanism control unit determines the travel distance of the roller moved by the movement mechanism, according to a predetermined shrinkage ratio when image formation processing is performed on a rear surface of the recording paper the front surface of which has been subjected to fixation treatment, and causes the movement mechanism to move the roller with the determined roller travel distance as the travel distance.

15. The image forming apparatus according to claim 14, further comprising:

a sheet setting unit that receives an input from a user and setting a type of the recording paper with different shrinkage ratios during thermal fixation, wherein when image formation processing is performed on the rear surface of the recording paper the front surface of which has been subjected to fixation treatment, the movement mechanism control unit causes the movement mechanism to move the roller based on the roller travel distance of the movement mechanism stored in advance according to the shrinkage ratio of the recording paper that is set with the sheeting setting unit.

16. The image forming apparatus according to claim 14, wherein the secondary transfer roller is disposed movably in the sub scanning direction relative to the secondary transfer opposing roller, and the movement mechanism moves the secondary transfer roller in the sub scanning direction, and changes the pressed state of the intermediate transfer belt by the secondary transfer roller at the nip part of the secondary transfer opposing roller and the secondary transfer roller where the toner image is transferred from the intermediate transfer belt to the recording paper.

17. The image forming apparatus according to claim 14, wherein at least an outer circumferential side of the secondary transfer roller in a radial direction is formed from an elastic member, and the secondary transfer roller presses the outer circumferential surface of the intermediate transfer belt at a position to become an end on an upstream side, in the sub scanning direction, of the portion where the intermediate transfer belt is tightly stretched across the secondary transfer opposing roller, and under the control of the movement mechanism control unit, the movement mechanism moves the secondary transfer roller, in a state of being in contact with the intermediate transfer belt, in a direction in which the secondary transfer roller moves toward and away from a shaft center of the secondary transfer opposing roller in an inter-axis direction of the secondary transfer roller and the secondary transfer opposing roller, and changes the pressed state of the intermediate transfer belt by the secondary transfer roller at the nip part of the secondary transfer opposing roller and the secondary transfer roller where the toner image is transferred from the intermediate transfer belt to the recording paper.

18. The image forming apparatus according to claim 14, further comprising:

a tension roller, as one of the plurality of rollers, that applies tension to the intermediate transfer belt by pressing the intermediate transfer belt tightly stretched across the roller from its inner circumferential surface side toward an outward direction, and wherein the movement mechanism moves an arrangement position of the tension roller under the control of the movement mechanism control unit.

19. The image forming apparatus according to claim 14, further comprising:

a correction roller, as one of the plurality of rollers, that corrects an approach angle of the intermediate transfer belt to a nip part formed by the secondary transfer roller pressing the secondary transfer opposing roller, at a position that is more upstream than the nip part in a traveling direction of the intermediate transfer belt, by pressing the intermediate transfer belt tightly stretched so as to be able to rotate endlessly from its inner circumferential surface side toward an outward direction, and wherein the movement mechanism moves an arrangement position of the correction roller under the control of the movement mechanism control unit.

20. The image forming apparatus according to claim 14, further comprising:

a sheet transport path on which the recording paper to which the toner image has been transferred is transported;

a parallel roller, as another of the plurality of rollers, that tightly stretches the intermediate transfer belt at a downstream side in the sub scanning direction relative to the secondary transfer opposing roller, and causing the intermediate transfer belt to be tightly stretched parallel to the sheet transport path within the sheet transport path together with the secondary transfer opposing roller; and a movable roller pair which sandwiches the intermediate transfer belt at a portion where the intermediate transfer belt is tightly stretched parallel to the sheet transport path by the parallel roller at the downstream side in the sub scanning direction relative to the secondary transfer opposing roller, and which moves bi-directionally in an inner circumferential direction and an outer circumferential direction of the intermediate transfer belt, wherein the movement mechanism moves, under the control of the movement mechanism control unit, the movable roller pair in the inner circumferential direction and the outer circumferential direction of the intermediate transfer belt, and changes the pressed state of the intermediate transfer belt by the secondary transfer roller at the nip part of the secondary transfer opposing roller and the secondary transfer roller where the toner image is transferred from the intermediate transfer belt to the recording paper.

* * * * *